US011040541B2

(12) United States Patent
Tanaka et al.

(10) Patent No.: US 11,040,541 B2
(45) Date of Patent: Jun. 22, 2021

(54) RECORDING APPARATUS

(71) Applicant: SEIKO EPSON CORPORATION, Tokyo (JP)

(72) Inventors: Yoshiyuki Tanaka, Matsumoto (JP); Atsuya Hirabayashi, Chino (JP); Nobuhisa Nomoto, Matsumoto (JP); Masahide Nakagawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/935,878

(22) Filed: Jul. 22, 2020

(65) Prior Publication Data

US 2020/0346458 A1 Nov. 5, 2020

Related U.S. Application Data

(63) Continuation of application No. 16/282,915, filed on Feb. 22, 2019, now Pat. No. 10,766,260.

(30) Foreign Application Priority Data

Feb. 23, 2018 (JP) ..... 2018-030482

(51) Int. Cl.

| | |
|---|---|
| ***B41J 2/175*** | (2006.01) |
| ***B41J 2/165*** | (2006.01) |
| ***B41J 2/185*** | (2006.01) |
| ***B41J 29/13*** | (2006.01) |

(52) U.S. Cl.

CPC ..... *B41J 2/16523* (2013.01); *B41J 2/17509* (2013.01); *B41J 2/17566* (2013.01); *B41J 2/185* (2013.01); *B41J 29/13* (2013.01); *B41J 2002/17573* (2013.01); *B41J 2002/1856* (2013.01)

(58) Field of Classification Search

CPC .... B41J 2/16523; B41J 2/17509; B41J 2/185; B41J 2/17566; B41J 29/13; B41J 2002/1856; B41J 2002/17573

See application file for complete search history.

(56) References Cited

U.S. PATENT DOCUMENTS

| | | | |
|---|---|---|---|
| 2007/0035578 | A1 | 2/2007 | Suzuki |
| 2009/0180931 | A1 | 7/2009 | Silbert et al. |
| 2009/0278905 | A1 | 11/2009 | Onuma et al. |

(Continued)

FOREIGN PATENT DOCUMENTS

| | | |
|---|---|---|
| JP | 2016-000505 | 1/2016 |

*Primary Examiner* — Yaovi M Ameh

(74) *Attorney, Agent, or Firm* — Workman Nydegger

(57) ABSTRACT

A recording apparatus includes: a recording unit that performs a recording by ejecting a liquid on a medium; a carriage that includes the recording unit and is movable in a width direction; a casing that has the carriage therein and constitutes an external appearance of the apparatus; an adapter that is mounted on an upper portion of the recording unit and accommodates the liquid to be supplied to the recording unit; at least one liquid accommodating unit that supplies the liquid to the adapter through a tube and includes a filling port into which the liquid can be filled; and a waste liquid receiving unit that receives the liquid discharged as a waste liquid during a maintenance operation of the recording unit, in which the casing has a cover for covering both the liquid accommodating unit and the waste liquid receiving unit.

5 Claims, 61 Drawing Sheets

(56) References Cited

U.S. PATENT DOCUMENTS

| | | | | |
|---|---|---|---|---|
| 2013/0057605 | A1* | 3/2013 | Miwa | 347/6 |
| 2014/0104349 | A1* | 4/2014 | Kimura | B41J 2/17509 347/85 |
| 2014/0262985 | A1* | 9/2014 | Dorsett | B01D 21/262 210/86 |

* cited by examiner

RECORDING APPARATUS

BACKGROUND

1. Technical Field

The present invention relates to a recording apparatus.

2. Related Art

In the related art, there is known a liquid consumption apparatus including a tank in which liquid is stored and a cover movable to a closed position and an opened position. A window is formed in the cover, and a transparent member is provided in the window. Then, in a state where the cover is in the closed position, the tank can be visually recognized from an outside of the cover through the transparent member (for example, see JP-A-2016-505).

The liquid consumption apparatus as described above includes a waste liquid receiving unit for receiving a liquid discharged as a waste liquid. The waste liquid receiving unit needs to be exchanged appropriately according to a liquid receiving state. Therefore, there is a need to provide a protective cover for the waste liquid receiving unit. However, when the cover is provided for each of a tank and the waste liquid receiving unit, there is a problem that it is necessary to open/close the respective covers to perform an operation, and a convenience of a user is reduced.

SUMMARY

According to an aspect of the invention, there is provided a recording apparatus including: a recording unit that performs a recording by ejecting a liquid on a medium; a carriage that includes the recording unit in a bottom portion and is movable in a width direction intersecting a medium transporting direction; a casing that has the carriage therein and constitutes an external appearance of the apparatus; an adapter that is mounted on an upper portion of the recording unit and accommodates the liquid to be supplied to the recording unit; at least one liquid accommodating unit that supplies the liquid to the adapter through a tube and includes a filling port into which the liquid can be filled; and a waste liquid receiving unit that receives the liquid discharged as a waste liquid during a maintenance operation of the recording unit, in which the casing has a cover for covering both the liquid accommodating unit and the waste liquid receiving unit.

In the recording apparatus, it is preferable that the waste liquid receiving unit be provided below the liquid accommodating unit.

It is preferable that the cover of the recording apparatus be provided with a visual recognition unit capable of checking a remaining amount of the liquid of the liquid accommodating unit and a state of the waste liquid receiving unit.

It is preferable that the visual recognition unit of the recording apparatus be made of a light transmitting member capable of transmitting a visible light.

It is preferable that the visual recognition unit of the recording apparatus be provided at a position where the liquid accommodating unit can be visually recognized and at a position where the waste liquid receiving unit can be visually recognized.

It is preferable that the cover of the recording apparatus have a switching mechanism capable of switching a state of the visual recognition unit between a first state which is a visually recognizable state and a second state which has a low visibility.

It is preferable that the switching mechanism of the recording apparatus have a configuration in which the visual recognition unit (light transmitting member) can be attached/detached.

It is preferable that the switching mechanism of the recording apparatus include a configuration that can be electrically switched.

BRIEF DESCRIPTION OF THE DRAWINGS

The invention will be described with reference to the accompanying drawings, wherein like numbers reference like elements.

DESCRIPTION OF EXEMPLARY EMBODIMENTS

Each embodiment will be described as an example of an ink jet printer (hereinafter referred to as a printer) which is an example of a recording apparatus. The printer according to each embodiment can perform printing on a recording medium such as a recording paper with ink which is an example of a liquid.

Note that, for the printer according to each embodiment, a basic configuration is common. Embodiments are prepared in which an external appearance of the printer is varied.

Hereinafter, embodiments of the invention will be described with reference to the drawings. In each of the following drawings, the size of each member or the like is shown differently from the actual size in order to make each member or the like to be recognizable.

First Embodiment

Figure 1A:
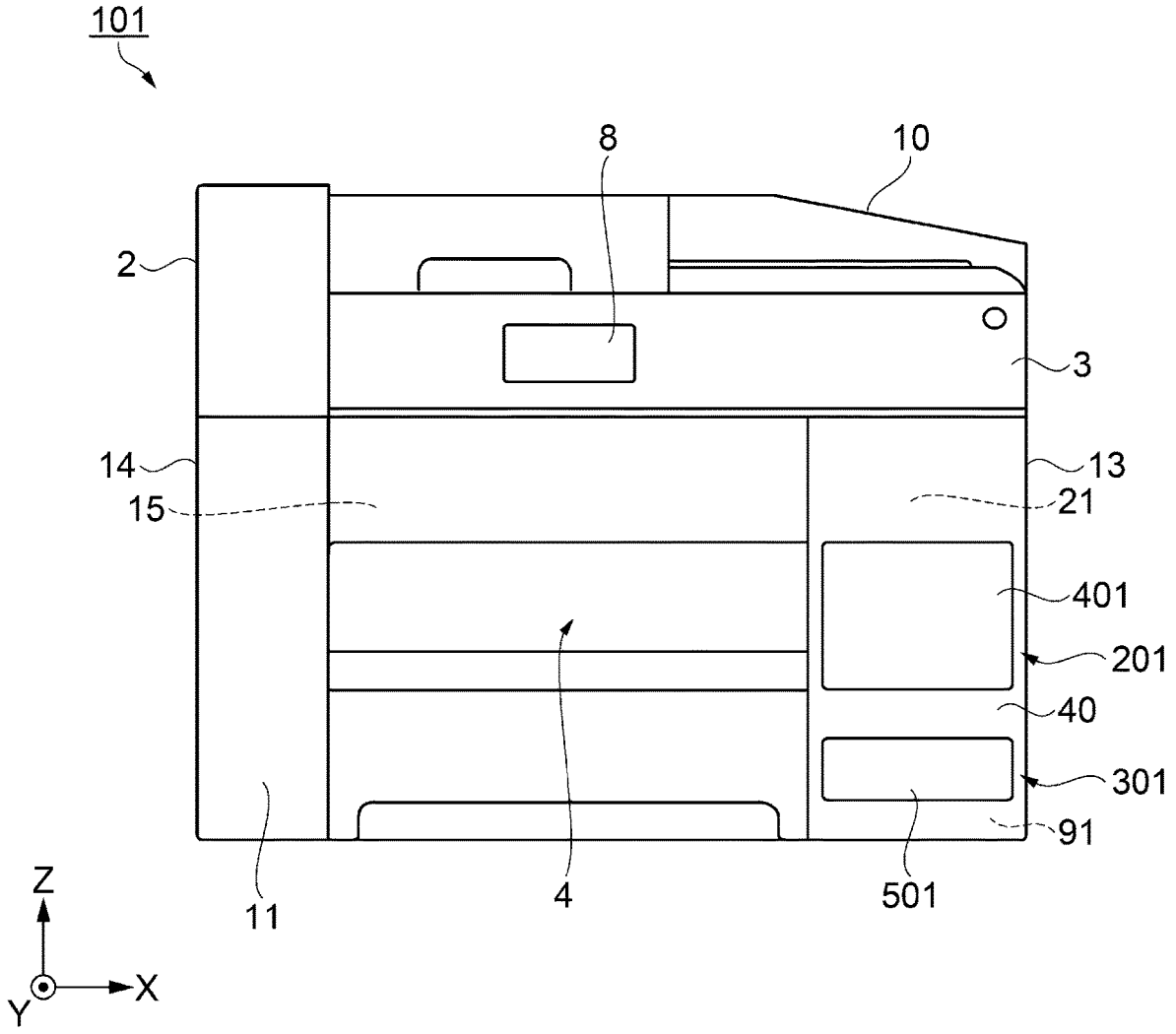
FIG. 1A is a front view showing an external appearance of a printer according to a first embodiment.
Figure 1B:
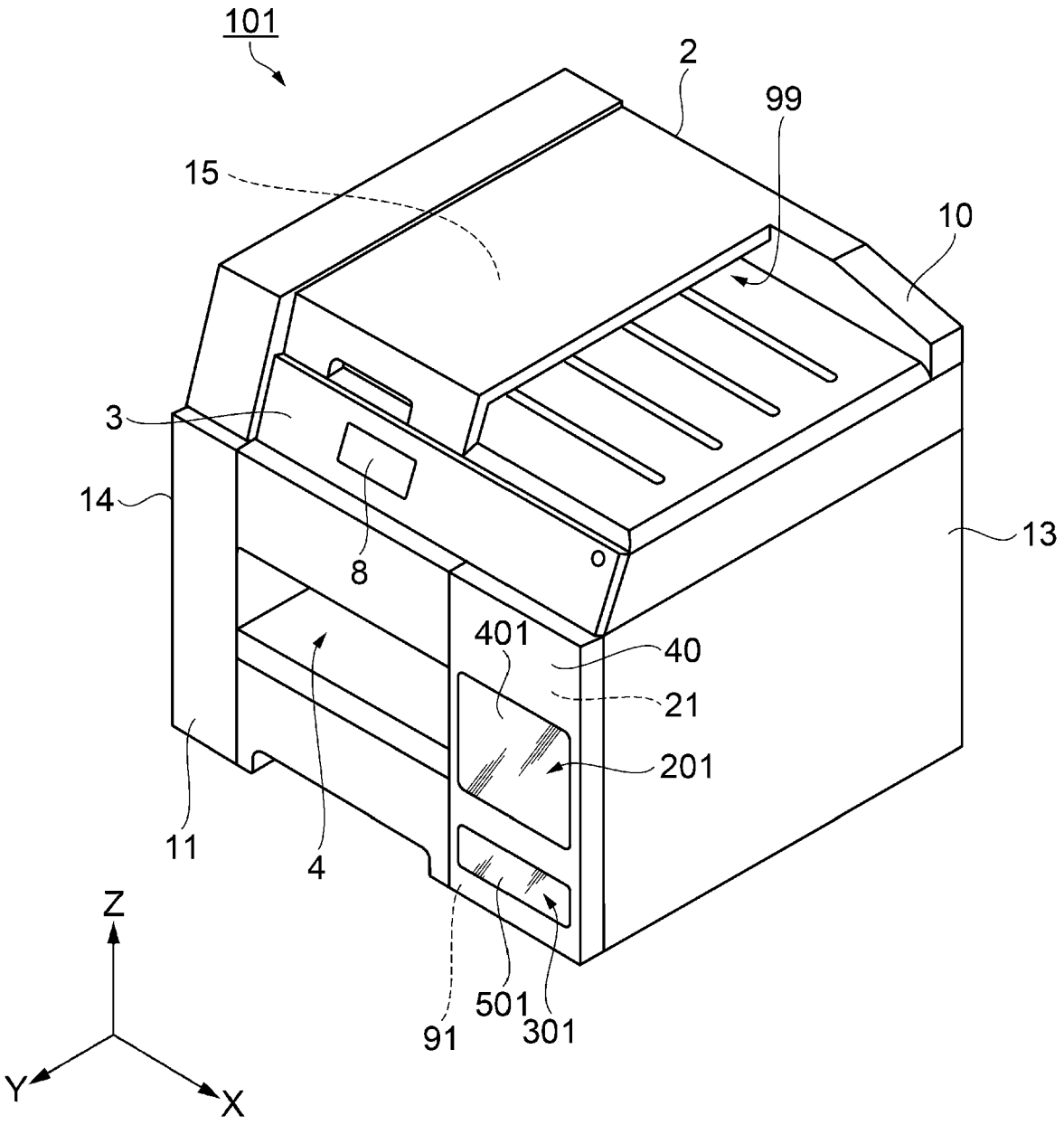
FIG. 1B is a perspective view showing the external appearance of the printer according to the first embodiment.
Figure 1C:
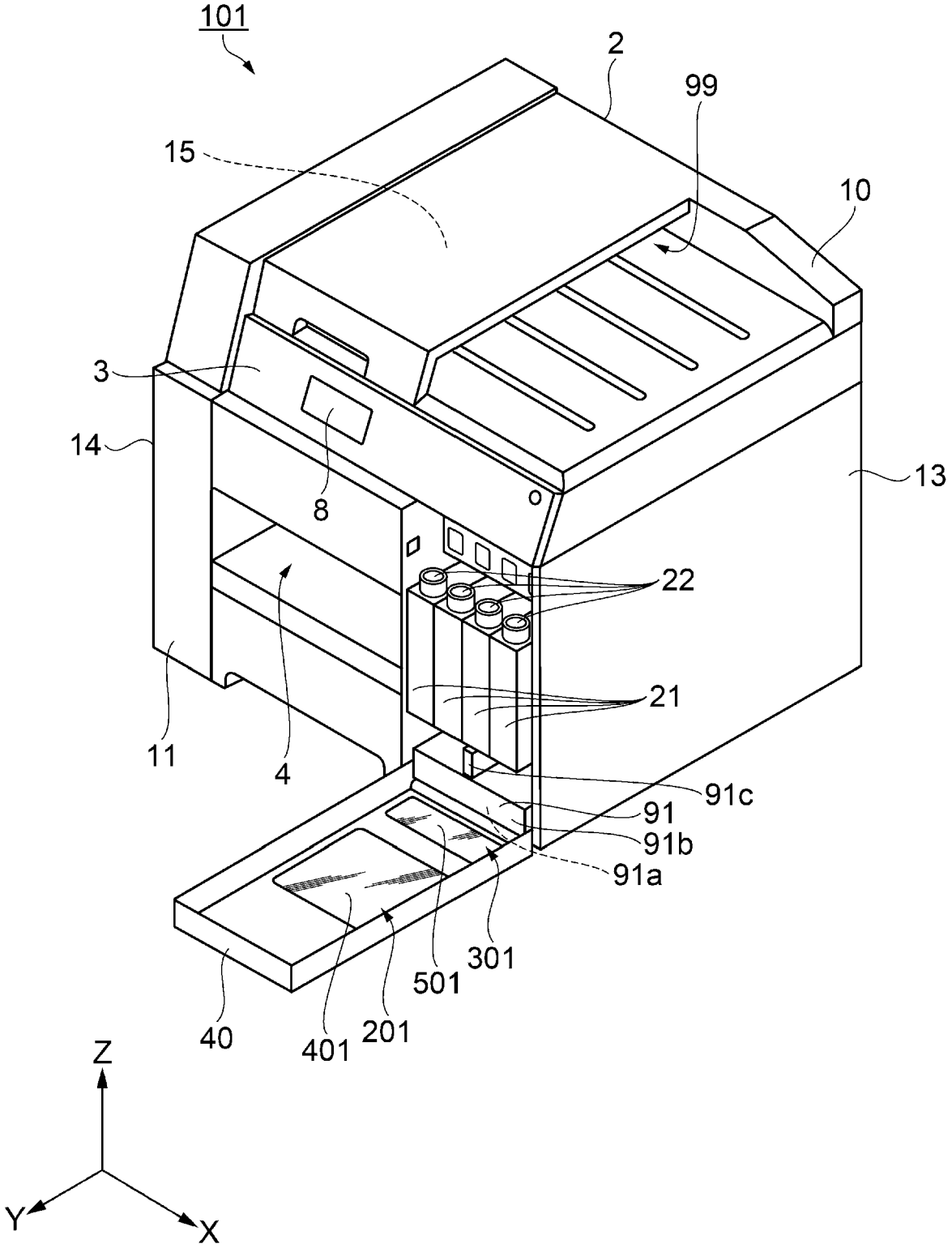
FIG. 1C is a perspective view showing the external appearance of the printer according to the first embodiment.
Figure 1D:
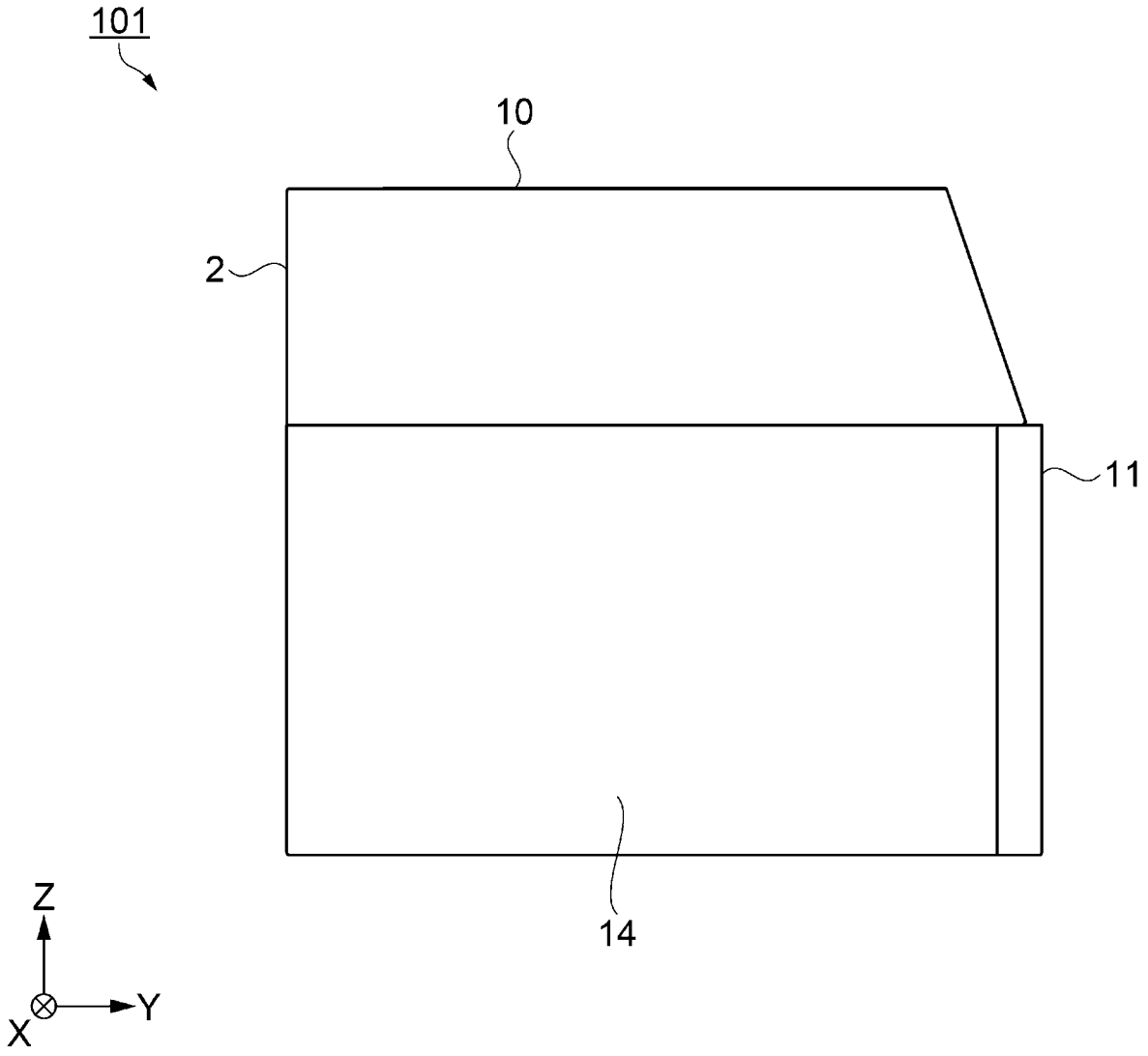
FIG. 1D is a side view showing the external appearance of the printer according to the first embodiment.
Figure 1E:
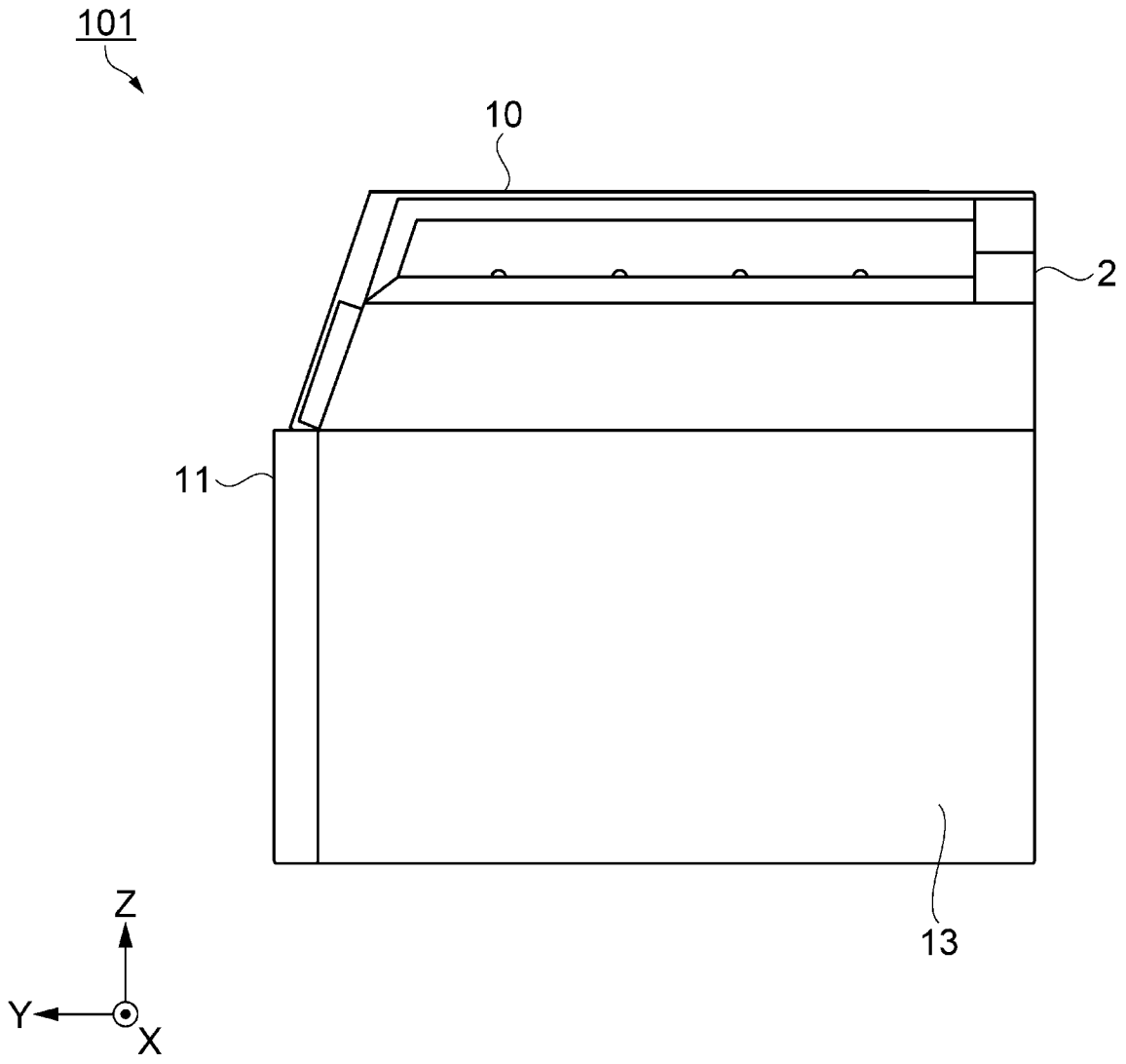
FIG. 1E is a side view showing the external appearance of the printer according to the first embodiment.
Figure 1F:
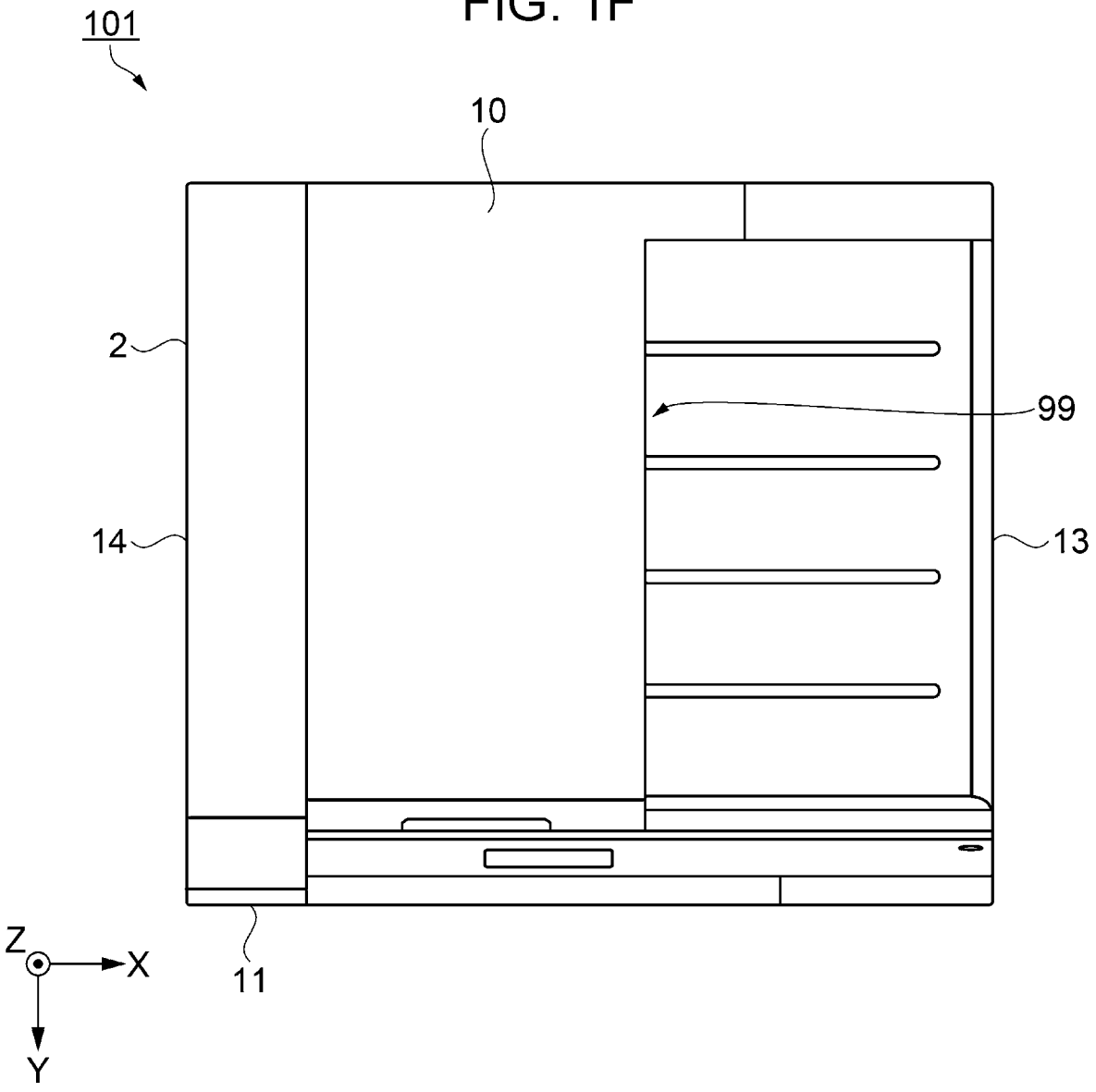
FIG. 1F is a plan view showing the external appearance of the printer according to the first embodiment.
Figure 1G:
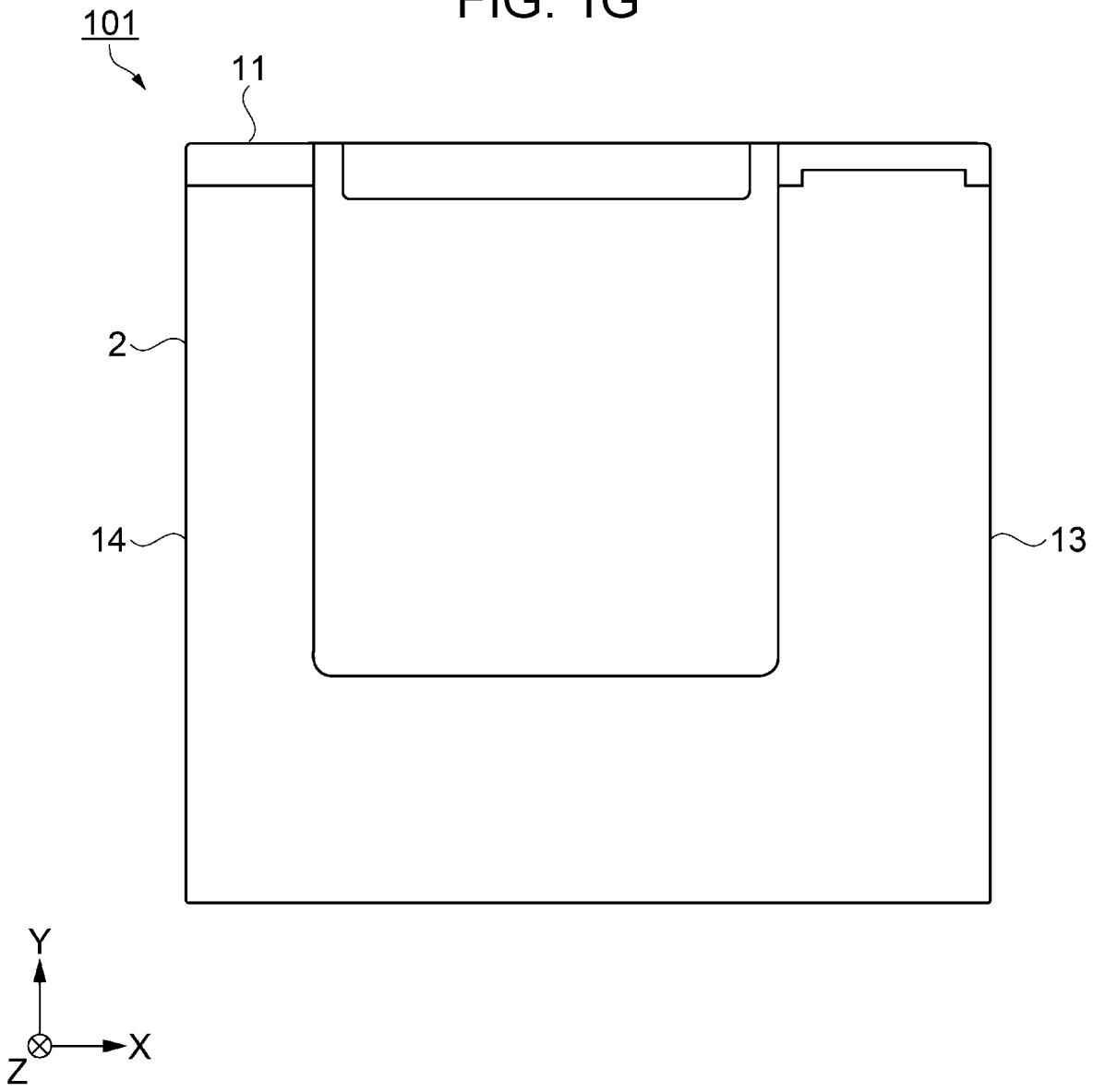
FIG. 1G is a bottom view showing the external appearance of the printer according to the first embodiment.
Figure 1H:
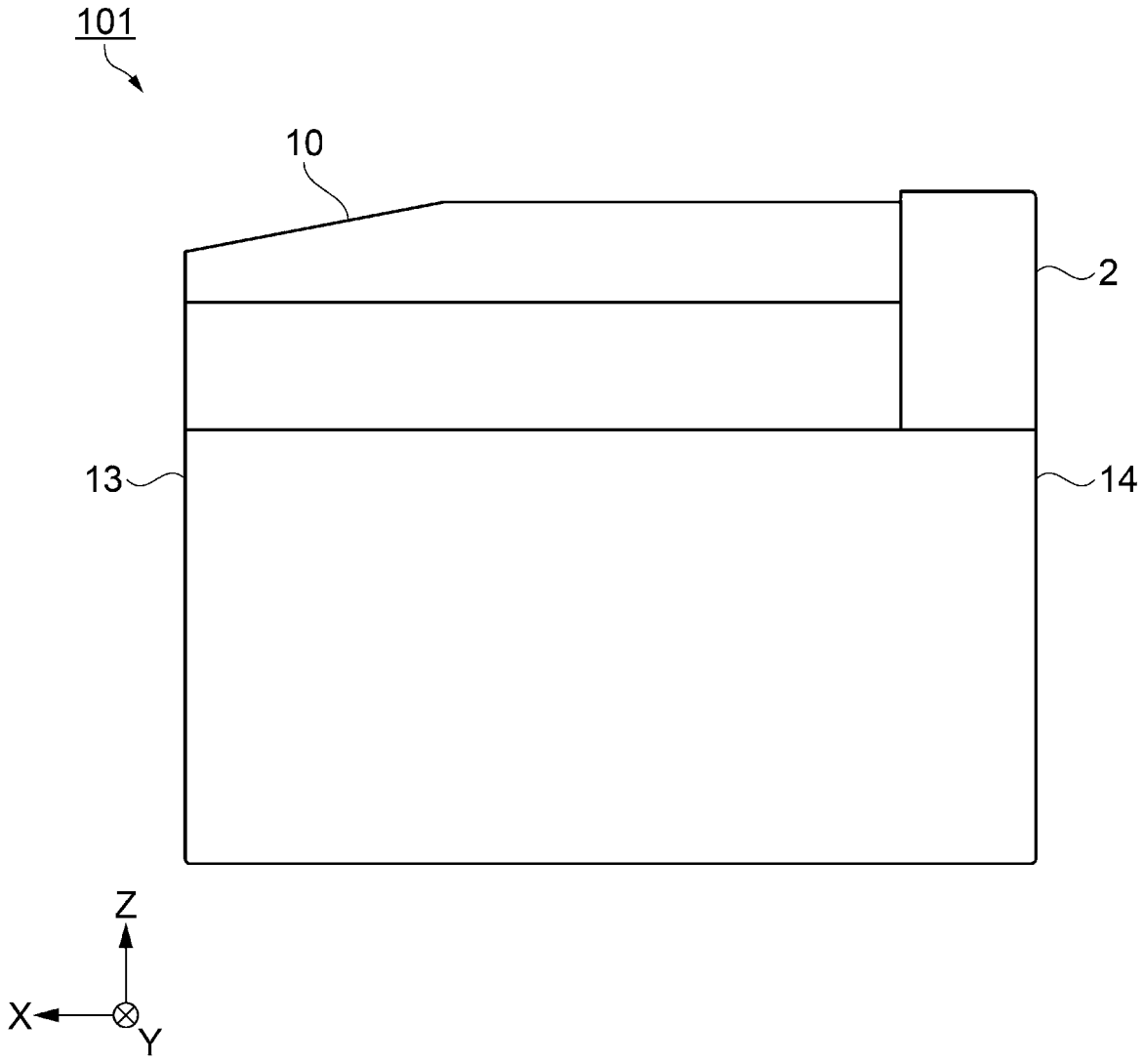
FIG. 1H is a rear view showing the external appearance of the printer according to the first embodiment.

FIG. 1A is a front view showing an external appearance of a printer according to the present embodiment, and FIGS. 1B and 1C are perspective views showing the external appearance of the printer according to the present embodiment. FIGS. 1D and 1E are side views showing the external appearance of the printer according to the present embodiment, and FIG. 1F is a plan view showing the external appearance of the printer according to the present embodiment. FIG. 1G is bottom view showing the external appearance of the printer according to the present embodiment, and FIG. 1H is a rear view showing the external appearance of the printer according to the present embodiment. In FIGS. 1A to 1H, X, Y, and Z axes which are mutually orthogonal coordinate axes are attached. The X, Y, and Z axes are attached to the drawings shown thereafter as necessary.

In the present embodiment, a state in which the printer 101 is disposed on a horizontal plane (XY plane) that is defined by an X axis and a Y axis, is a using state of the printer 101. A posture of the printer 101 when the printer 101 is disposed on the XY plane is referred to as a using posture of the printer 101.

A Z axis is an axis orthogonal to the horizontal plane. In the using state of the printer 101, a direction along the Z axis is a vertical direction. In the using state of the printer 101, a −Z direction is a vertically downward direction in FIGS. 1A, 1B, and 1C. In each of the X, Y, and Z axes, a direction of an arrow indicates a direction of + (positive), and a direction opposite to the direction of the arrow indicates a direction of − (negative). FIG. 1A is a front view of the printer 101 as viewed from a +Y direction side. FIGS. 1B and 1C are perspective views of the printer 101 as viewed from a +X direction side.

As shown in FIGS. 1A, 1B, and 1C, the printer 101 has a recording head 15 (recording unit), a casing 2, a tank 21

(liquid accommodating unit), a waste liquid receiving unit 91, and an opening/closing unit 40. The printer 101 has an operation panel 3, a paper discharging unit 4, a lid unit 10, and the like. Further, the printer 101 according to the present embodiment includes a scanner unit (not shown). That is, the printer 101 is a multifunction peripheral including the scanner unit. Note that, the printer 101 may not be a multifunction peripheral but a printer that does not include a scanner unit.

The casing 2 accommodates the recording head 15 and the like, and constitutes an outer shell (external appearance) of the printer 101. The operation panel 3 is disposed outside the casing 2. In the printer 101, the operation panel 3 is disposed on a face where the paper discharging unit 4 is disposed (front 11).

The operation panel 3 includes a display panel 8, a power button, an operation button, or the like (none of which are shown). Note that, as the display panel 8, for example, it is possible to adopt a panel that can accept inputs by a user such as a touch panel. Further, a structure capable of adjusting an inclination of the operation panel 3 (also called tilt adjustment) may be adopted. If the inclination of the operation panel 3 can be adjusted, convenience can be enhanced since the user can view and operate the operation panel 3 with a desired inclination.

The paper discharging unit 4 is provided on a same side of the operation panel 3 in the casing 2. In the printer 101, a recording medium P (see FIG. 1I) is discharged from the paper discharging unit 4. In the printer 101, a face on which the paper discharging unit 4 is provided is a front 11. The front 11 of the printer 101 is also a front 11 of the casing 2.

The casing 2 has a side wall 13 and a side wall 14 that intersect the front 11. When the front 11 is seen in front, that is, when the front 11 is viewed from the +Y direction side in a plan view, the side wall 13 is positioned on the +X direction side of the front 11 and the side wall 14 is positioned on the −X direction side of the front 11.

The opening/closing unit 40 covers both the tank 21 and the waste liquid receiving unit 91, and is provided on the front 11 side of the casing 2. The opening/closing unit 40 is disposed on substantially the same plane as the front 11. That is, in the present embodiment, the opening/closing unit 40 does not protrude toward the +Y direction side with respect to the front 11.

Further, the opening/closing unit 40 is not recessed toward the −Y direction side with respect to the front 11.

The opening/closing unit 40 is configured to be openable/closable to the casing 2. Specifically, as shown in FIGS. 1B and 1C, when the YZ plane is viewed from the +X direction side in a plan view with an axis (not shown) along the X axis as a rotation axis, the opening/closing unit 40 can be moved clockwise and counterclockwise. Also, in a case where the opening/closing unit 40 is to be opened, by rotating the opening/closing unit 40 in a counterclockwise direction when the YZ plane is viewed from the +X direction side in plan view in a state in FIG. 1B (the opening/closing unit 40 is in a closed state) with the axis along the X axis as the rotation axis, the opening/closing unit 40 can be opened to the casing 2 as shown in FIG. 1C. On the other hand, in a case where the opening/closing unit 40 is to be closed, by rotating the opening/closing unit 40 in a clockwise direction when the YZ plane is viewed from the +X direction side in plan view in a state in FIG. 1C (the opening/closing unit 40 is in an open state) with the axis along the X axis as the rotation axis, the opening/closing unit 40 can be closed to the casing 2 as shown in FIG. 1B.

When the opening/closing unit 40 is in the open state (see FIG. 1C), the tank 21 and the waste liquid receiving unit 91 accommodated in the casing 2 are exposed.

The waste liquid receiving unit 91 receives ink discharged as waste liquid from the recording head 15 or the like, and is configured to be attachable to and detachable from the casing 2. For example, the waste liquid receiving unit 91 can be attached to and detached from the casing 2 by using a slide mechanism or the like. The waste liquid receiving unit 91 includes a receptor 91*a* (for example, a non woven fabric or a sponge (an open cell foam obtained by foaming foamed polyurethane as a raw material), or the like.) for receiving the ink and a frame body 91*b* covering at least a part of the receptor. Further, the frame body 91*b* is formed with a protruding unit 91*c*. The protruding unit 91*c* is a grip unit which can be gripped by the user's fingers.

As shown in FIG. 1C, the user can supply the ink into the tank 21 via a filling port 22 of the tank 21 by setting the opening/closing unit 40 in the open state (see FIG. 1C). The user can grip the protruding unit 91*c* of the waste liquid receiving unit 91 and pull it out in the +Y direction to detach the waste liquid receiving unit 91 from the casing 2. Further, by pressing a new waste liquid receiving unit 91 in the −Y direction, the waste liquid receiving unit 91 can be attached in the casing 2.

The waste liquid receiving unit 91 according to the present embodiment is provided in a lower part of the tank 21. Since the waste liquid receiving unit 91 is disposed in a lower part in the gravity direction, the waste liquid (ink) can be efficiently received.

The opening/closing unit 40 is provided with visual recognition units 201 and 301. The visual recognition units 201 and 301 have opening ports. The visual recognition units 201 and 301 check a remaining amount of ink in the tank 21 and a state of the waste liquid receiving unit 91 in the closed state (see FIG. 1B) of the opening/closing unit 40. The visual recognition units 201 and 301 are provided at a position at which the tank 21 can be visually recognized when the opening/closing unit 40 is in the closed state and at a position at which the waste liquid receiving unit 91 can be visually recognized.

Further, the opening/closing unit 40 of the present embodiment includes the visual recognition unit 201 capable of visually recognizing the tank 21 and the visual recognition unit 301 capable of visually recognizing the waste liquid receiving unit 91. It is possible to easily check a status of the tank (the remaining amount of the ink or the state near the filling port 22) and a status of the waste liquid receiving unit 91 through the visual recognition units 201 and 301.

Light transmitting members 401 and 501 capable of transmitting the visible light are provided at the opening port portions of the visual recognition units 201 and 301. The light transmitting members 401 and 501 are film members or the like. For example, the light transmitting members 401 and 501 are attached to the opening port portions of the visual recognition units 201 and 301 with an adhesive material or the like. By installing the light transmitting members 401 and 501 on the visual recognition units 201 and 301, it is possible to check the status of the tank 21 and the waste liquid receiving unit 91, and to prevent the tank 21 and the waste liquid receiving unit 91 from being contacted by the user's fingers or the like. Note that, the visual recognition units 201 and 301 according to the present embodiment are formed in a rectangular shape.

The lid unit 10 is configured to be a part of the casing 2. The lid unit 10 is provided on an upper portion of the casing 2. The lid unit 10 covers a scanner unit (not shown). The lid unit 10 is configured to be rotatable about an axis (not shown) along the X axis as a rotation axis. By rotating the lid unit 10 in one direction to the casing 2, the lid unit 10 can be opened to the casing 2.

Further, by rotating the lid unit 10 in another direction in a state where the lid unit 10 is opened, the lid unit 10 can be closed to the casing 2. In this manner, the lid unit 10 is configured to be openable/closable to the casing 2. Further, the lid unit 10 is provided with a paper feeding port 99 for feeding the recording medium P. By supplying the recording medium P from the paper feeding port 99, it is possible to easily perform copying, scanning processing or the like.

When the lid unit 10 is opened to the casing 2, a scanner unit is exposed. The scanner unit is a flat bed type and has an image capturing device (not shown) such as an image sensor. The scanner unit can read an image or the like recorded on a medium such as paper as image data via the image capturing device. Therefore, the scanner unit functions as a reading apparatus such as an image.

In the X axis direction, the length of the casing 2 and the length of the lid unit 10 are substantially the same. In the Y axis direction, the length at the position where the operation panel 3 of the casing 2 is provided and the length of the lid unit 10 are substantially the same. However, the length at the position where the opening/closing unit 40 of the casing 2 is provided is longer than the length of the lid unit 10.

Therefore, when the printer 101 is viewed from the +X direction side in a plan view, the lid unit 10 overlaps with a portion other than the portion protruding toward the +Y direction side of the casing 2. That is, when the lid unit 10 of the printer 101 is viewed from the +X direction side in a plan view, the opening/closing unit 40 provided in the portion protruding toward the +Y direction side of the casing 2 is disposed so as not to overlap with the lid unit 10. Thus, upon rotating the opening/closing unit 40, it can be rotated without being hindered by the lid unit 10.

Figure 1I:
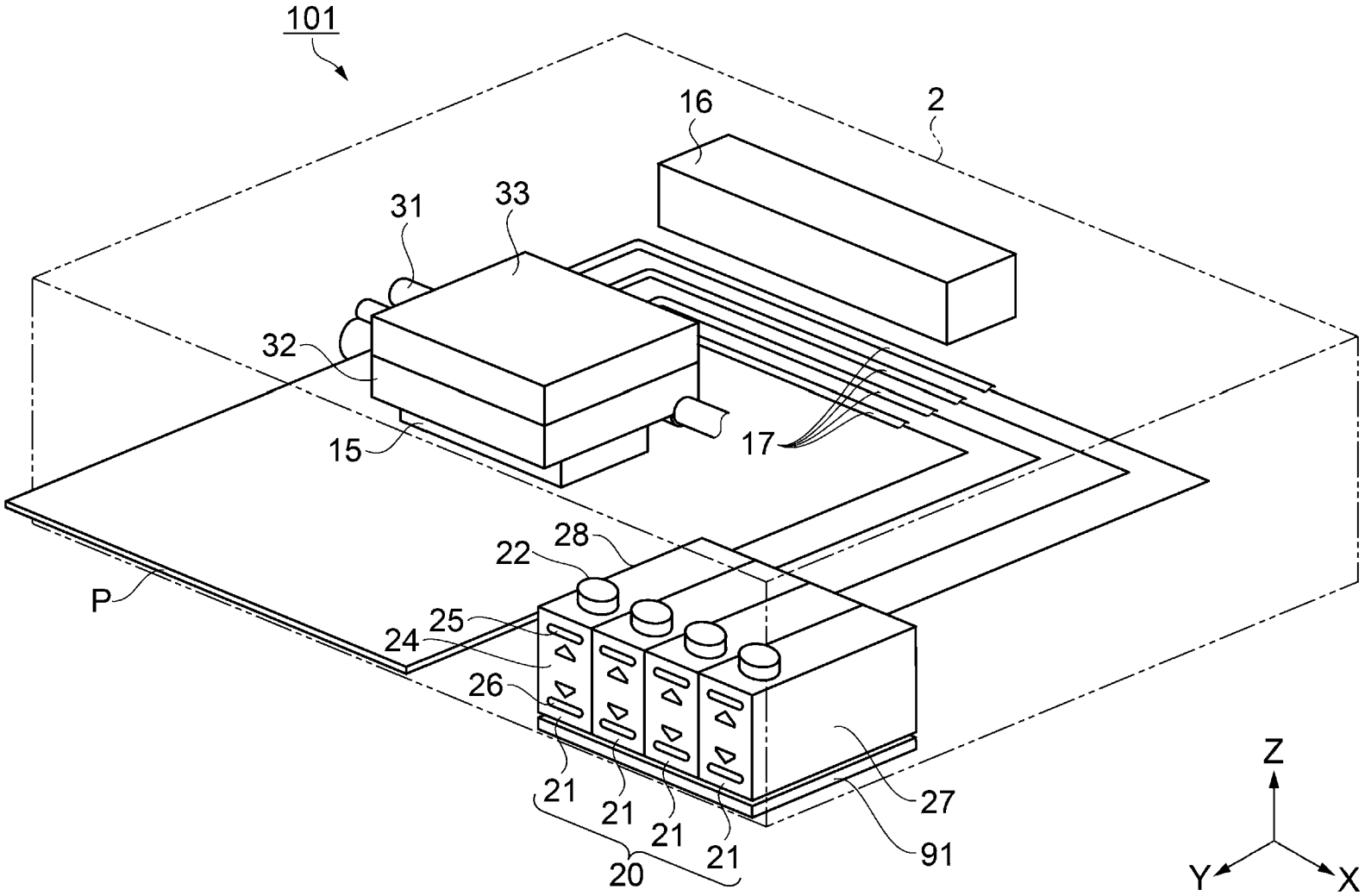
FIG. 1I is a schematic view showing a main configuration inside the printer according to the first embodiment.

Next, a main configuration inside the casing 2 of the printer 101 will be described. FIG. 1I is a schematic view showing a main configuration inside the printer. As shown in FIG. 1I, the printer 101 has a recording head 15 mounted on a carriage 32, a control unit 16, a tank unit 20, and a waste liquid receiving unit 91. The recording head 15, the control unit 16, the tank unit 20, and the waste liquid receiving unit 91 are accommodated in the casing 2.

The recording head 15 ejects ink as ink droplets and performs a recording on the recording medium P. The recording head 15 is mounted on the carriage 32 supported by a guide rail 31 disposed in the X axis direction. A moving mechanism (not shown) including a motor is connected to the carriage 32, and the carriage 32 is reciprocated along the X axis direction (the width direction intersecting the transporting direction of the recording medium P) by driving the moving mechanism. As the carriage 32 moves, the recording head 15 reciprocates along the X axis direction.

In addition, the printer 101 includes a transporting unit (not shown) that can transport the recording medium P in the +Y direction. Also, recording is performed with the ink while reciprocating the carriage 32 and the recording head 15 along the X axis direction to the recording medium P transported in the +Y direction by the transporting unit. The transporting unit intermittently transports the recording medium P such as a recording paper in the +Y direction.

The control unit 16 controls driving of each of the above-described configurations. The control unit 16 includes a central processing unit (CPU) for executing various programs, a random access memory (RAM) for temporarily storing data and programs and the like, a read only memory (ROM) in which various data, various programs and the like are recorded in advance in a nonvolatile manner, and an interface. Also, the CPU processes various signals input via the interface based on the data of the RAM and the ROM, and outputs a control signal to each unit via the interface.

The tank unit 20 is disposed inside the portion (opening/closing unit 40) of the casing 2 further protruding toward the +Y direction side than the operation panel 3 and the paper discharging unit 4. That is, when viewing the printer 101 from the +Y direction side, the tank unit 20 is disposed inside of the opening/closing unit 40 (−Y direction side). Further, the tank unit 20 is positioned between the operation panel 3 and the paper discharging unit 4, and the side wall 13 in the X axis direction.

The tank unit 20 is configured with a plurality of tanks 21. The tank unit 20 of the present embodiment includes four tanks 21. Note that, the number of the tanks 21 in the tank unit 20 is not limited to four, but may be less than four or more than four.

In the embodiment, four tanks 21 are arranged side by side along the X axis.

Further, in the present embodiment, the plurality of tanks 21 is configured separately from each other. However, the configuration of the tank 21 is not limited to this. The tank unit 20 may be configured as one liquid accommodating container by integrating the plurality of tanks 21. In such a configuration, the tank unit 20 is partitioned into individual tanks 21 so as to be able to accommodate different kinds of liquids. In this case, for example, it is possible to individually accommodate inks of different colors in the plurality of tanks 21.

The tank 21 is a container for accommodating the ink. In the tank 21, a filling port 22 communicating with the inside of the tank 21 is formed. The filling port 22 is configured as an opening port unit formed on a side positioned in the +Z direction side of the tank 21. In the tank 21, it is possible to fill the ink into the tank 21 from the outside of the tank 21 via the filling port 22. Note that, the filling port 22 may be configured to be sealed with a cap. In such a configuration, when filling the ink into the tank 21, the user can fill the ink after opening the filling port 22 by opening the cap.

The configuration of the tank 21 is not limited to the above. As the configuration of the tank 21, for example, a tubular liquid filling portion protruding from an outer surface of the tank 21 may be provided.

At least a part of the tank 21 is configured to a member having light transmitting property. In a property of a material through which light passes, the term "having light transmitting property" includes not only the property of a state in which the other side of a material is visible through the material but also of a state in which a shape or the like of the other side of a material is not clearly recognized through the material. The visual recognition face 24 positioned in the +Y direction of the tank 21 has the light transmitting property, and it is possible to visually recognize the amount of ink accommodated in the tank 21 from the visual recognition face 24. On the visual recognition face 24, for example, an upper limit mark 25, a lower limit mark 26, or the like are added. The user can grasp the amount of ink in the tank 21 using the upper limit mark 25 and the lower limit mark 26 as reference marks.

The upper limit mark 25 indicates a measure of the amount of ink so that ink does not leak from the filling port 22 when the ink is filled from the filling port 22. The lower limit mark 26 indicates a measure of the amount of ink when prompting the filling of ink. One of the upper limit mark 25 and the lower limit mark 26 may be provided.

The tank 21 has a sides 27 and 28 that intersect the visual recognition face 24. When the visual recognition face 24 of the tank 21 is viewed from the +Y direction side, the side 27 is positioned on the side wall 13 side (+X direction side) of the casing 2, and the side 28 is positioned on the side wall 14 side (−X direction side) of the casing 2.

An ink supply tube 17 is connected to each tank 21. An adapter 33 is mounted an upper part of the recording head 15. Then, the ink in the tank 21 is supplied to the adapter 33 via the ink supply tube 17 and accommodated therein. The ink accommodated in the adapter 33 is supplied to the recording head 15. Then, the ink supplied to the recording head 15 is ejected as ink droplets from nozzles (not shown) directed to the recording medium P side.

The ink is not limited to either an aqueous ink or an oil based ink. The aqueous ink may be either one having a constitution in which a solute such as a dye is dissolved in an aqueous solvent or one having a constitution in which a dispersoid such as a pigment is dispersed in an aqueous dispersion medium. The oil based ink may be either one having a constitution in which a solute such as a dye is dissolved in an oil based solvent or one having a constitution in which a dispersoid such as a pigment is dispersed in an oil based dispersion medium.

As shown in FIG. 1A, the tank unit 20 (four tanks 21) is provided at a position overlapping with the opening/closing unit 40 provided with the visual recognition unit 201 when the front 11 of the printer 101 is viewed from the +Y direction side in plan view. Therefore, even if a surface of the tank 21 is not exposed to the outside, the user can visually recognize the tank 21 from the outside of the printer 101 via the visual recognition unit 201. Then, for example, from the outside of the printer 101, the user can grasp the amount of ink in the tank 21 using the upper limit mark 25 and the lower limit mark 26 as reference marks.

Further, by providing the light transmitting members 401 and 501 for closing the opening ports of the visual recognition units 201 and 301, it is possible to prevent dust from entering which is from the outside of the printer 101 (casing 2) into the tank 21 or the waste liquid receiving unit 91, or to prevent damage to the tank unit 20 and the waste liquid receiving unit 91 due to external contact or the like. Therefore, as compared with a case where the surfaces of the tank 21 or the waste liquid receiving unit 91 are exposed to the outside, it is possible to prevent adverse influences on the visibility due to dust, damage or the like from the outside.

The opening/closing unit 40 of the printer 101 may be configured to include a switching mechanism capable of switching states of the visual recognition units 201 and 301 between a first state which is a visually recognizable state and a second state which has a low visibility. For example, the switching mechanism is configured so that the opening/closing unit 40 can be attached/detached.

Figure 1J:
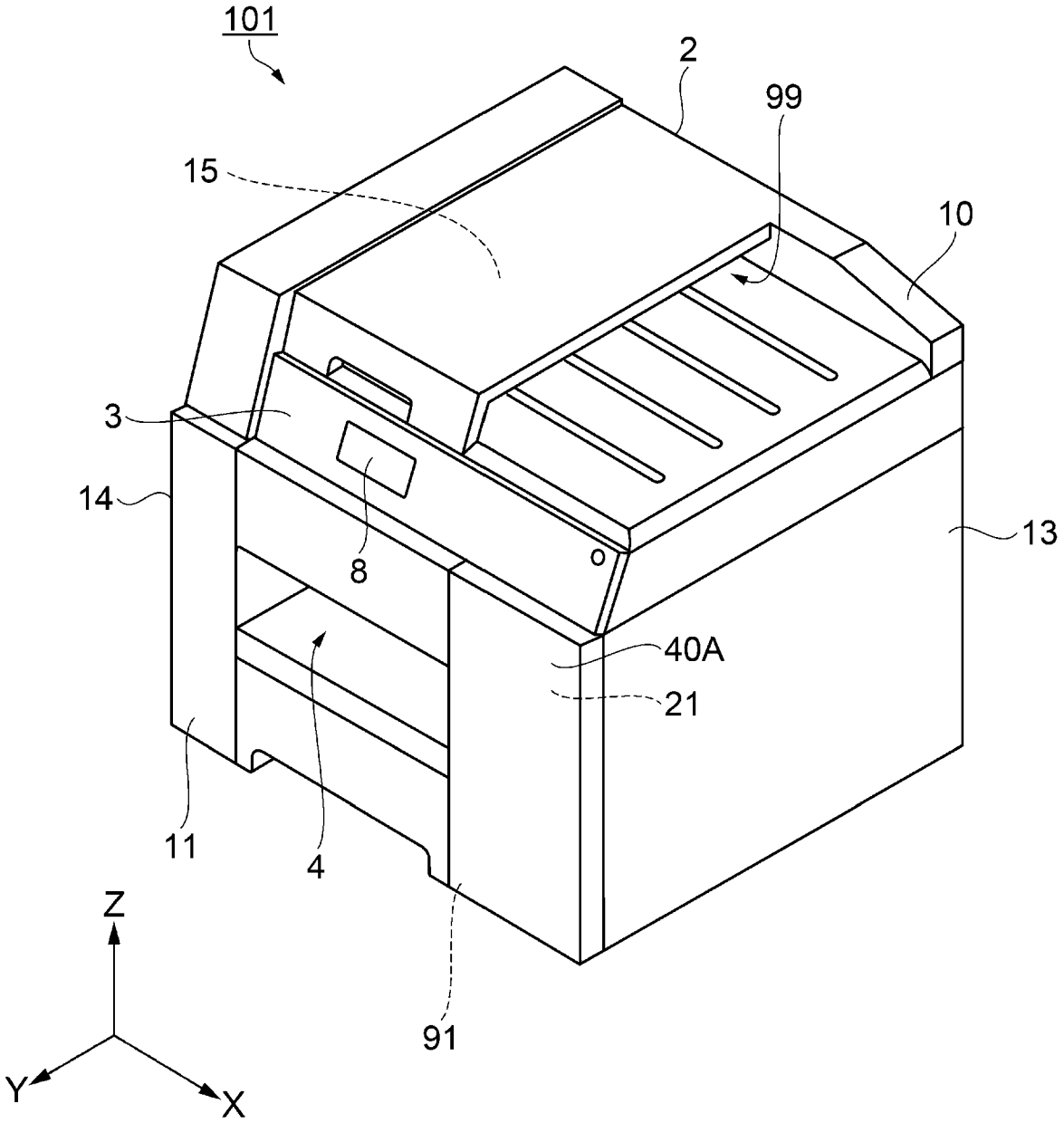
FIG. 1J is an explanatory view illustrating a switching mechanism of the printer according to the first embodiment.

FIG. 1J is an explanatory view illustrating a switching mechanism of the printer. Specifically, FIG. 1J shows the second state in which the visibility is low. As shown in FIG. 1J, the printer 101 is provided with another opening/closing unit 40A covering each of the tank 21 and the waste liquid receiving unit 91. A full face of another opening/closing unit 40A forms a flat face, and does not have the visual recognition units 201 and 301 (see FIG. 1B). Therefore, the visibility is lowered and the state of the tank 21 and the waste liquid receiving unit 91 can not be checked from the outside.

FIG. 1B is the first state which is a visually recognizable state in which the opening/closing unit 40 having the visual recognition units 201 and 301 is provided, and FIG. 1J is the second state in which the other opening/closing unit 40A not having the visual recognition units 201 and 301 and the like, and the visibility is lower than the first state.

The switching mechanism is configured to be fitted by utilizing the elasticity of the opening/closing unit 40 to the rotation axis of an axis (not shown) along the X axis that enables the opening/closing unit 40 to move clockwise and counterclockwise when the YZ plane is viewed from the +X direction side in plan view. That is, the opening/closing unit 40 is configured to be attachable/detachable by a snap fit to the axis along the X axis. In a case where switching the opening/closing unit 40 to another opening/closing unit 40A, it can be easily switched by detaching opening/closing unit 40 from the axis along the X axis and attaching the other opening/closing unit 40A to the axis along the X axis.

The color of the other opening/closing unit 40A may be the same as the color of the external appearance of the casing 2, or may be another color, and various variations can be applied.

In this way, by configuring the switching mechanism capable of switching between the first state and the second state, for example, in a case of using the printer 101, by setting the opening/closing unit 40 to the first state, it is possible to check the state of the tank 21 and the waste liquid receiving unit 91 from the outside. On the other hand, in a case of not using the printer 101, by setting the other opening/closing unit 40A to the second state and by making it impossible to visually recognize the tank 21 and or the waste liquid receiving unit 91 from the outside, it is possible to improve design quality.

Figure 1K:
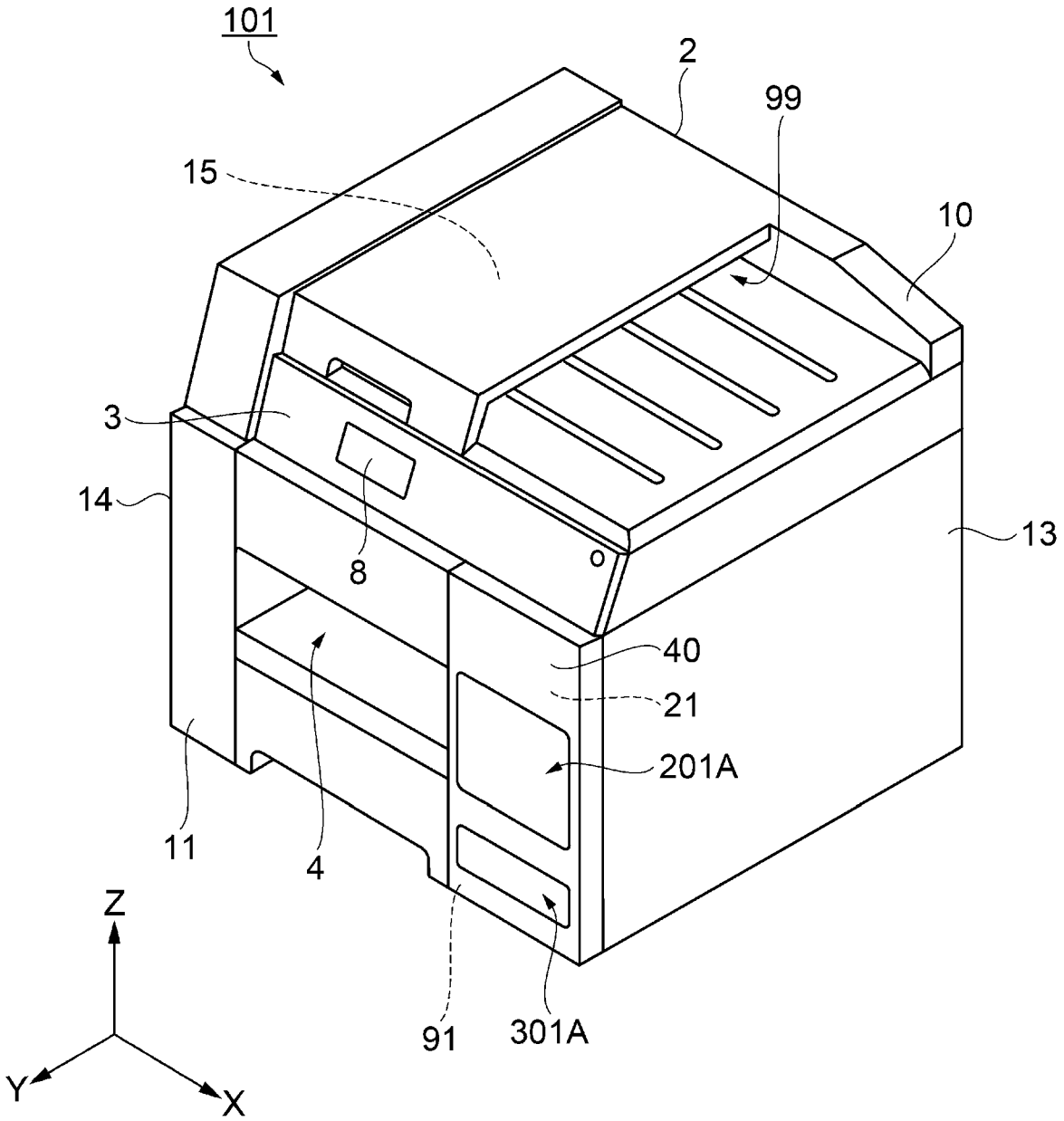
FIG. 1K is an explanatory view illustrating another switching mechanism of the printer according to the first embodiment.

Note that, the switching mechanism is not limited to a configuration in which the opening/closing unit 40 and the other opening/closing unit 40A are switched. FIG. 1K is an explanatory view illustrating another switching mechanism. As shown in FIG. 1K, the printer 101 may be configured so that the visual recognition units 201 and 301 can be attached/detached and switched to another visual recognition units 201A and 301A. The other visual recognition units 201A and 301A have a configuration in which the visibility is lowered. For example, the other visual recognition units 201A and 301A are configured to be formed in a flat face on a full face and do not have a light transmitting member.

In this case, the visual recognition units 201 and 301 and the other visual recognition units 201A and 301A are formed in a nested shape that can be fitted into the opening/closing unit 40, and are attachable to and detachable from the opening/closing unit 40. In a case of switching the visual recognition units 201 and 301 to the other visual recognition units 201A and 301A, it can be easily switched by detaching visual recognition units 201 and 301 from the opening/closing unit 40 and attaching the other visual recognition units 201A and 301A to the opening/closing unit 40. Thus, for example, it is possible to switch to the other visual recognition units 201A, 301A desired by the user, and it is possible to improve design quality.

Note that, the switching mechanism is not limited to a configuration in which visual recognition units 201 and 301 and the other visual recognition units 201A and 301A are switched. For example, the switching mechanism may be configured to switch light transmitting members 401 and 501 to other light transmitting members 401A and 501A. The other light transmitting members 401A and 501A have a configuration in which the visibility is lowered. For example, the other light transmitting members 401A and 501A are films having no light transmitting member. In this case, the light transmitting members 401 and 501 and the other light transmitting members 401A and 501A have adhesiveness and are films that can be attached and detached from the opening/closing unit 40.

In a case where the light transmitting members 401 and 501 are switched to the other light transmitting members 401A and 501A, the light transmitting members 401 and 501 are detached from the opening/closing unit 40, and the other light transmitting members 401A and 501A are attached to the opening/closing unit 40. Thus, for example, it is possible to switch to the other light transmitting members 401A and 501A desired by the user, and it is possible to improve design quality.

Note that, the light transmitting members 401 and 501 may not be configured to be switched to the other light transmitting members 401A and 501A. The other light transmitting members 401A and 501A may be attached or detached on the light transmitting members 401 and 501. Even in this case, the same effect as described above can be obtained.

As described above, according to the present embodiment, the following effects can be obtained.

By opening the opening/closing unit 40, the tank 21 and the waste liquid receiving unit 91 can be exposed, and it is possible to easily replenish the ink to the tank 21 or exchange the waste liquid receiving unit 91 or the like. That is, in the present embodiment, instead of separately providing the opening/closing unit 40 for the tank 21 and the waste liquid receiving unit 91, one opening/closing unit 40 is provided to cover the tank 21 and the waste liquid receiving unit 91, so that the configuration of the printer 101 is simplified. Also, by opening one opening/closing unit 40, it is possible to replenish the ink to the tank 21, exchange the waste liquid receiving unit 91, or the like, thereby enhancing the user's convenience.

In the first embodiment, as shown in FIG. 1A, rectangular shape visual recognition units 201 and 301 in which the tank 21 and the waste liquid receiving unit 91 can be visually recognized are provided, however, this shape is not limited thereto. Various shapes can be applied to the visual recognition unit.

Therefore, another embodiment will be specifically described below. Note that, in each of the embodiments, the same reference numerals are given to the same configurations as those of the first embodiment, and the description thereof will be omitted. Since the basic configuration of the printer, the opening/closing unit, and the light transmitting member in each embodiment are also the same as those in the first embodiment, the description thereof will be omitted. Further, since the switching mechanism is also the same as that of the first embodiment, the description thereof will be omitted. In the following embodiment, a case where the opening/closing unit is in the first state (closed state) will be described.

First, in the first embodiment, the visual recognition units 201 and 301 are rectangular shape, however, the invention is not limited thereto, and various shapes regarding size, form, or the like can be applied to the visual recognition units 201 and 301.

Figure 2:
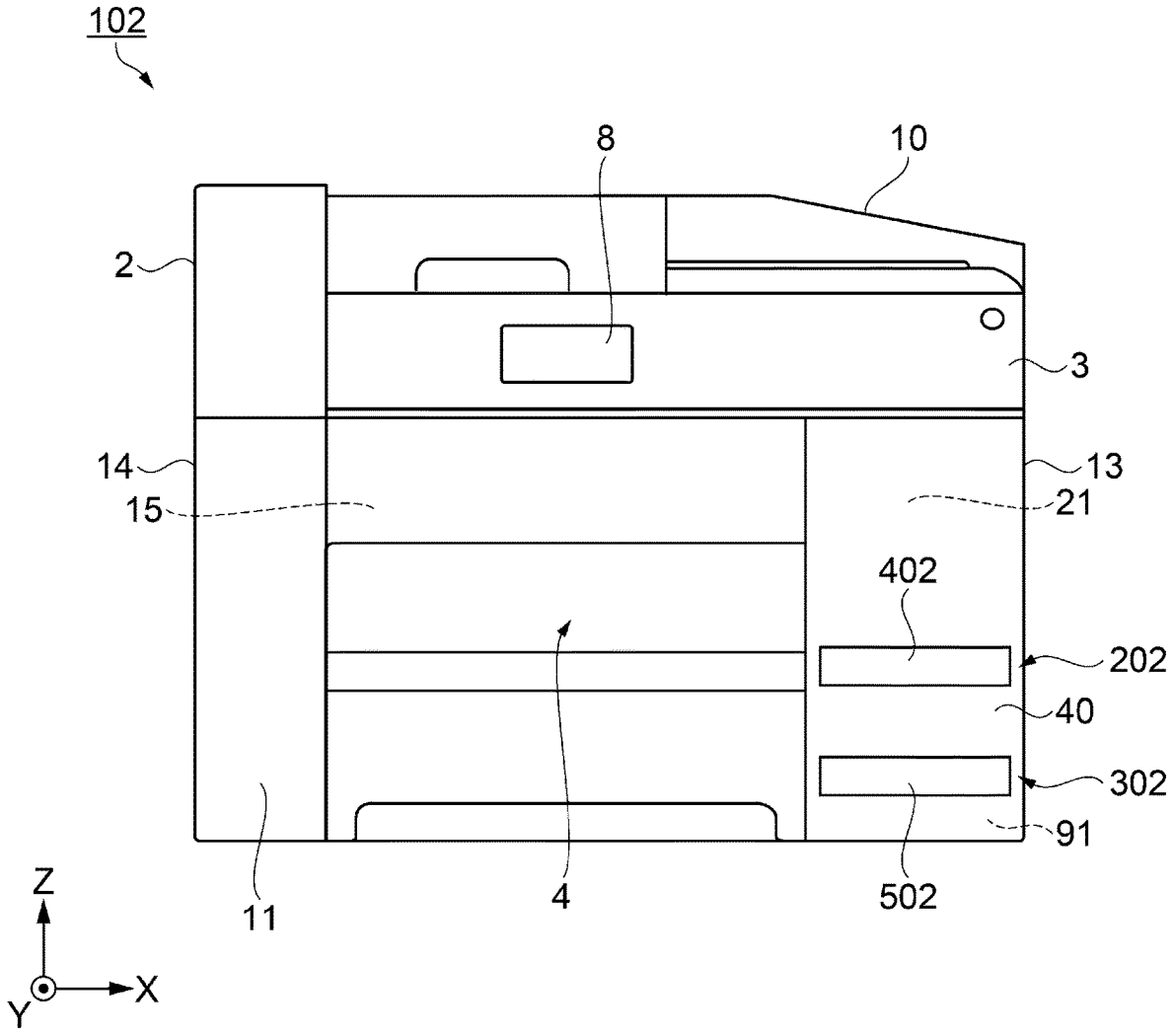
FIG. 2 is a front view showing an external appearance of a printer according to a second embodiment.

FIG. 2 is a front view showing an external appearance of a printer according to a second embodiment.

As shown in FIG. 2, the printer 102 has an opening/closing unit 40, and is provided with visual recognition units 202 and 302 capable of checking a remaining amount of ink in a tank 21 and a state of a waste liquid receiving unit 91. Light transmitting members 402 and 502 are provided in the visual recognition units 202 and 302.

Figure 3:
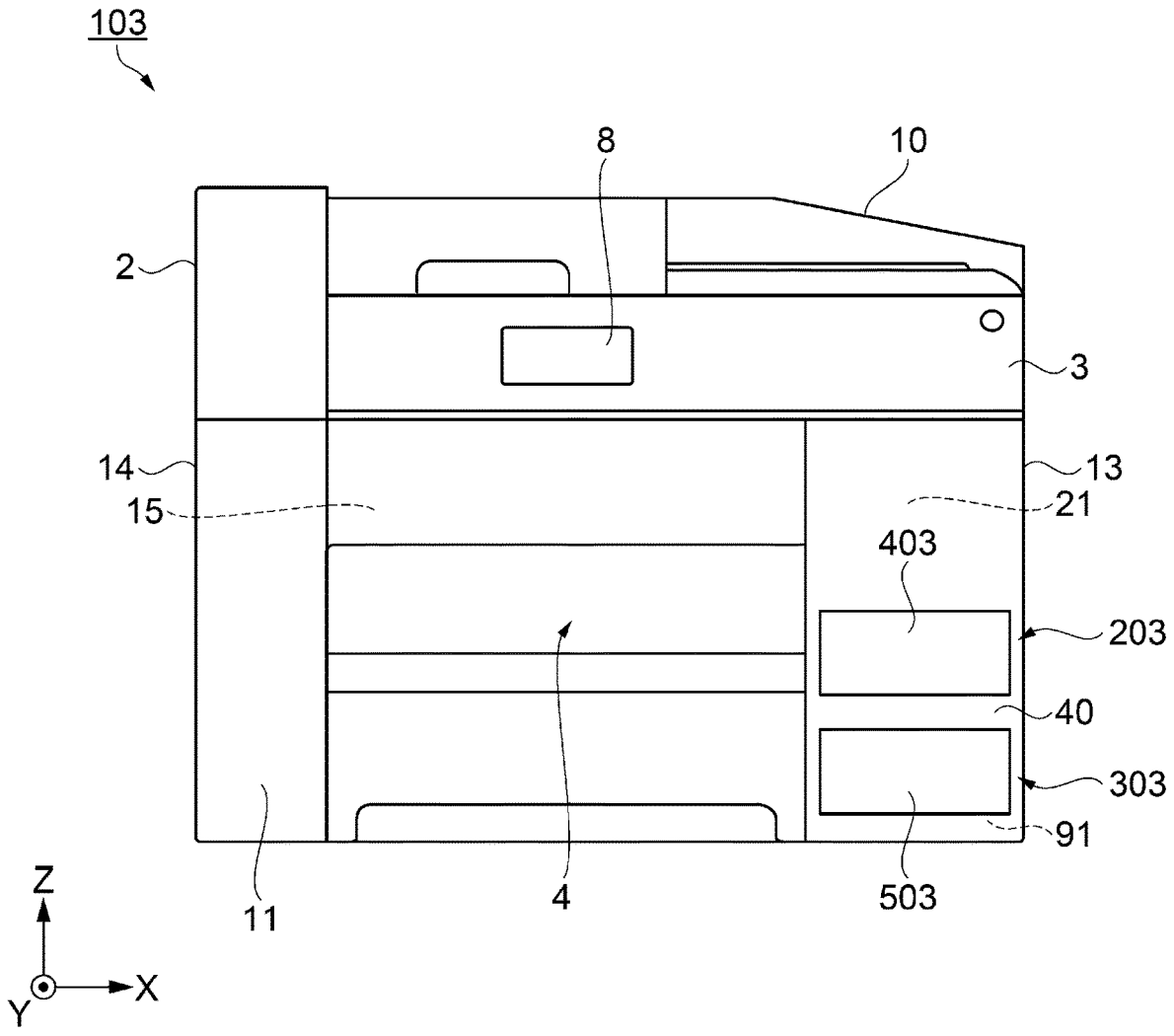
FIG. 3 is a front view showing an external appearance of a printer according to a third embodiment.

FIG. 3 is a front view showing an external appearance of a printer according to a third embodiment.

As shown in FIG. 3, the printer 103 has an opening/closing unit 40, and is provided with visual recognition units 203 and 303 capable of checking a remaining amount of ink in a tank 21 and a state of a waste liquid receiving unit 91. Light transmitting members 403 and 503 are provided in the visual recognition units 203 and 303.

Figure 4:
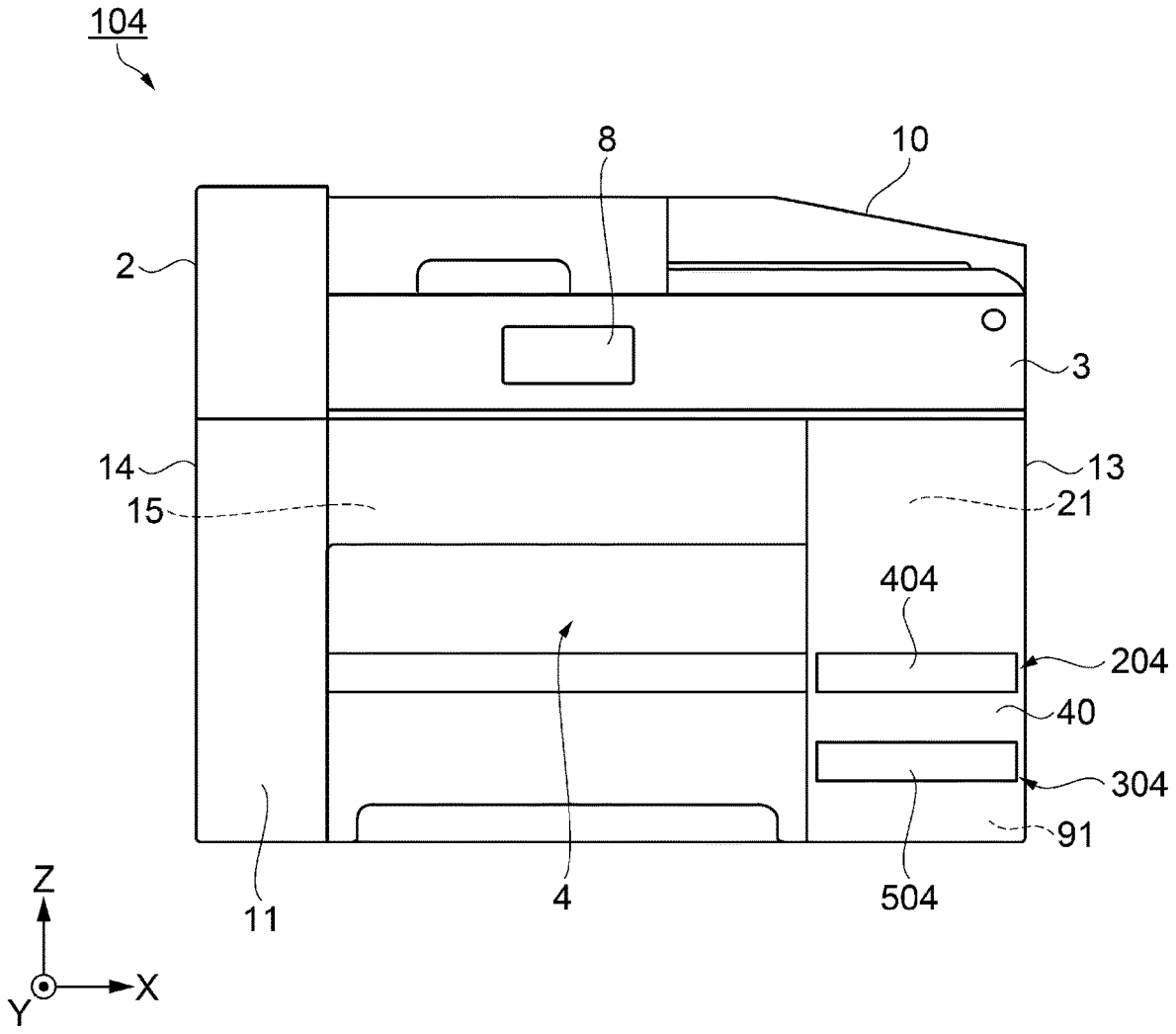
FIG. 4 is a front view showing an external appearance of a printer according to a fourth embodiment.

FIG. 4 is a front view showing an external appearance of a printer according to a fourth embodiment.

As shown in FIG. 4, the printer 104 has an opening/closing unit 40, and is provided with visual recognition units 204 and 304 capable of checking a remaining amount of ink in a tank 21 and a state of a waste liquid receiving unit 91. Light transmitting members 404 and 504 are provided in the visual recognition units 204 and 304.

Figure 5:
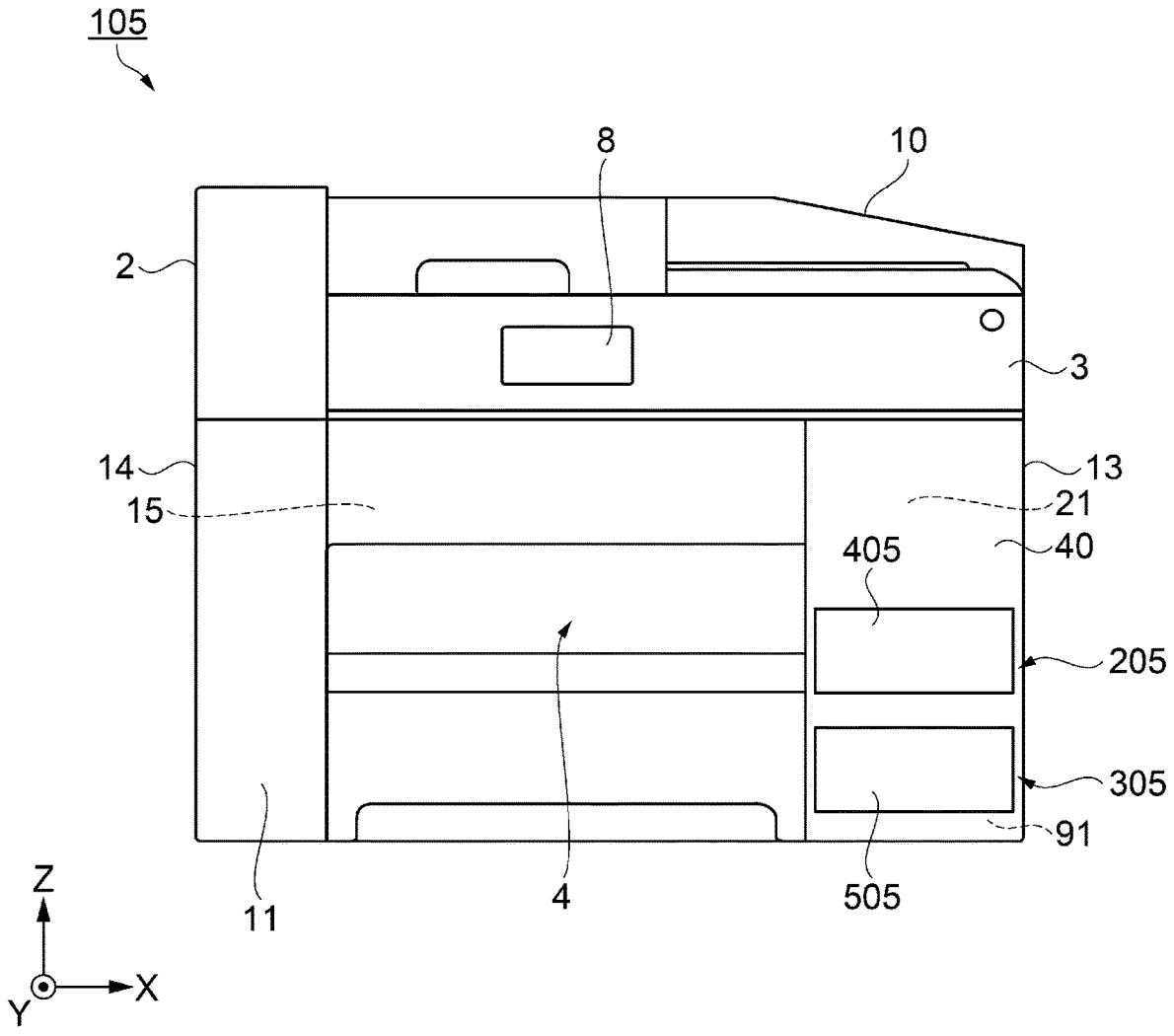
FIG. 5 is a front view showing an external appearance of a printer according to a fifth embodiment.

FIG. 5 is a front view showing an external appearance of a printer according to a fifth embodiment.

As shown in FIG. 5, the printer 105 has an opening/closing unit 40, and is provided with visual recognition units 205 and 305 capable of checking a remaining amount of ink in a tank 21 and a state of a waste liquid receiving unit 91. Light transmitting members 405 and 505 are provided in the visual recognition units 205 and 305.

Figure 6:
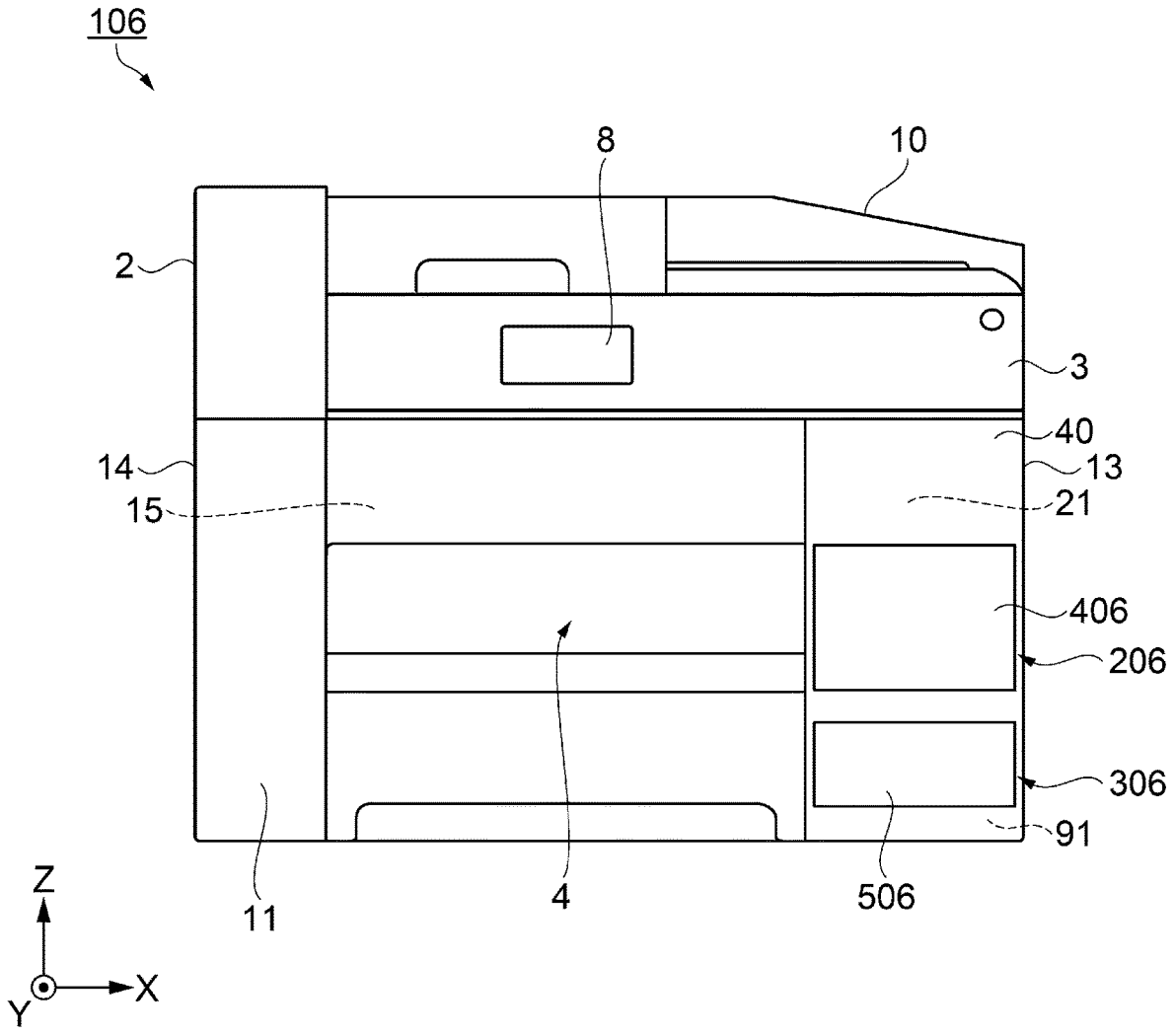
FIG. 6 is a front view showing an external appearance of a printer according to a sixth embodiment.

FIG. 6 is a front view showing an external appearance of a printer according to a sixth embodiment.

As shown in FIG. 6, the printer 106 has an opening/closing unit 40, and is provided with visual recognition units 206 and 306 capable of checking a remaining amount of ink in a tank 21 and a state of a waste liquid receiving unit 91. Light transmitting members 406 and 506 are provided in the visual recognition units 206 and 306. Note that, in the present embodiment, the sizes of the visual recognition unit 206 and the visual recognition unit 306 are different.

Figure 7:
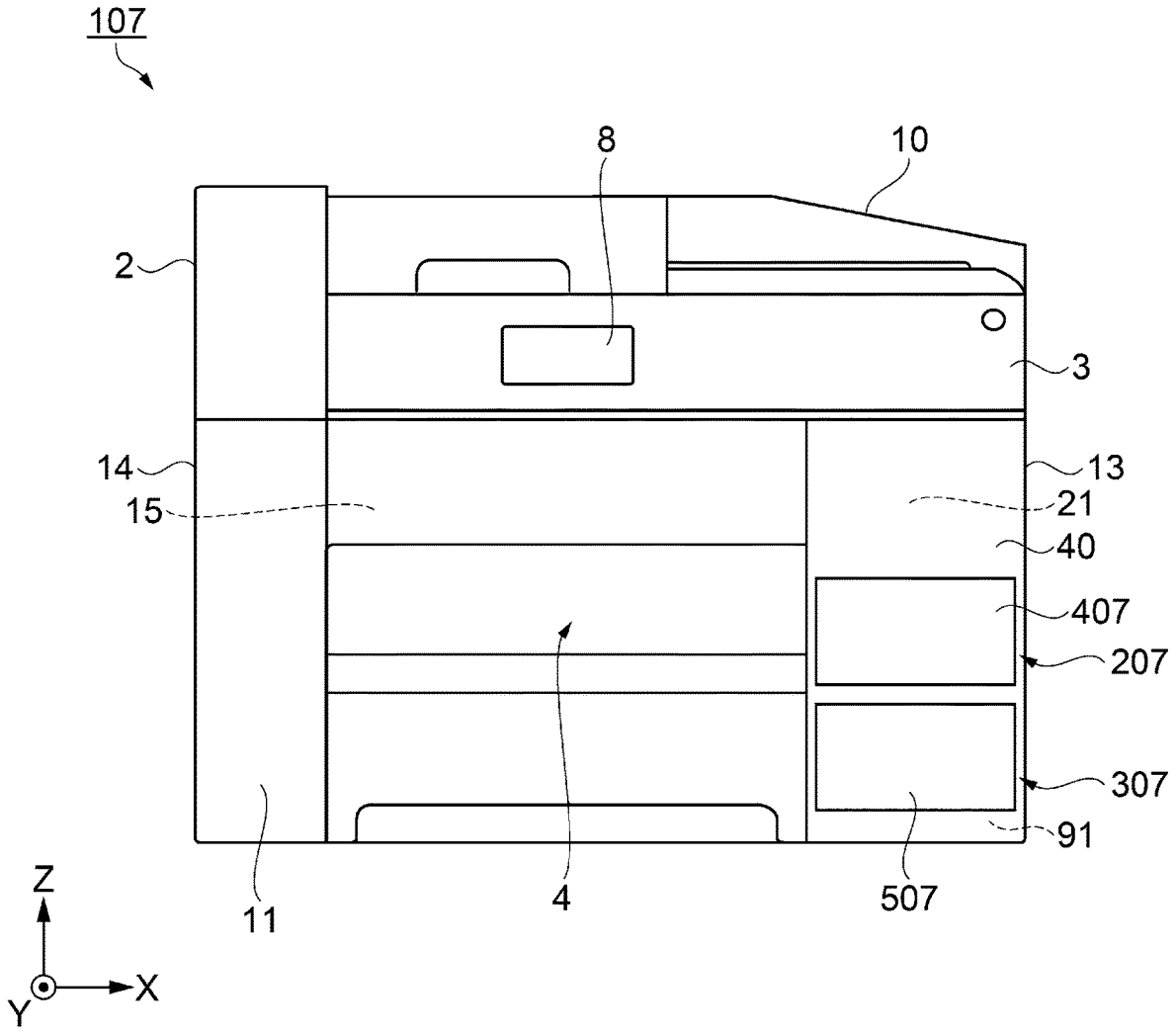
FIG. 7 is a front view showing an external appearance of a printer according to a seventh embodiment.

FIG. 7 is a front view showing an external appearance of a printer according to a seventh embodiment.

As shown in FIG. 7, the printer 107 has an opening/closing unit 40, and is provided with visual recognition units 207 and 307 capable of checking a remaining amount of ink in a tank 21 and a state of a waste liquid receiving unit 91. Light transmitting members 407 and 507 are provided in the visual recognition units 207 and 307.

Figure 8:
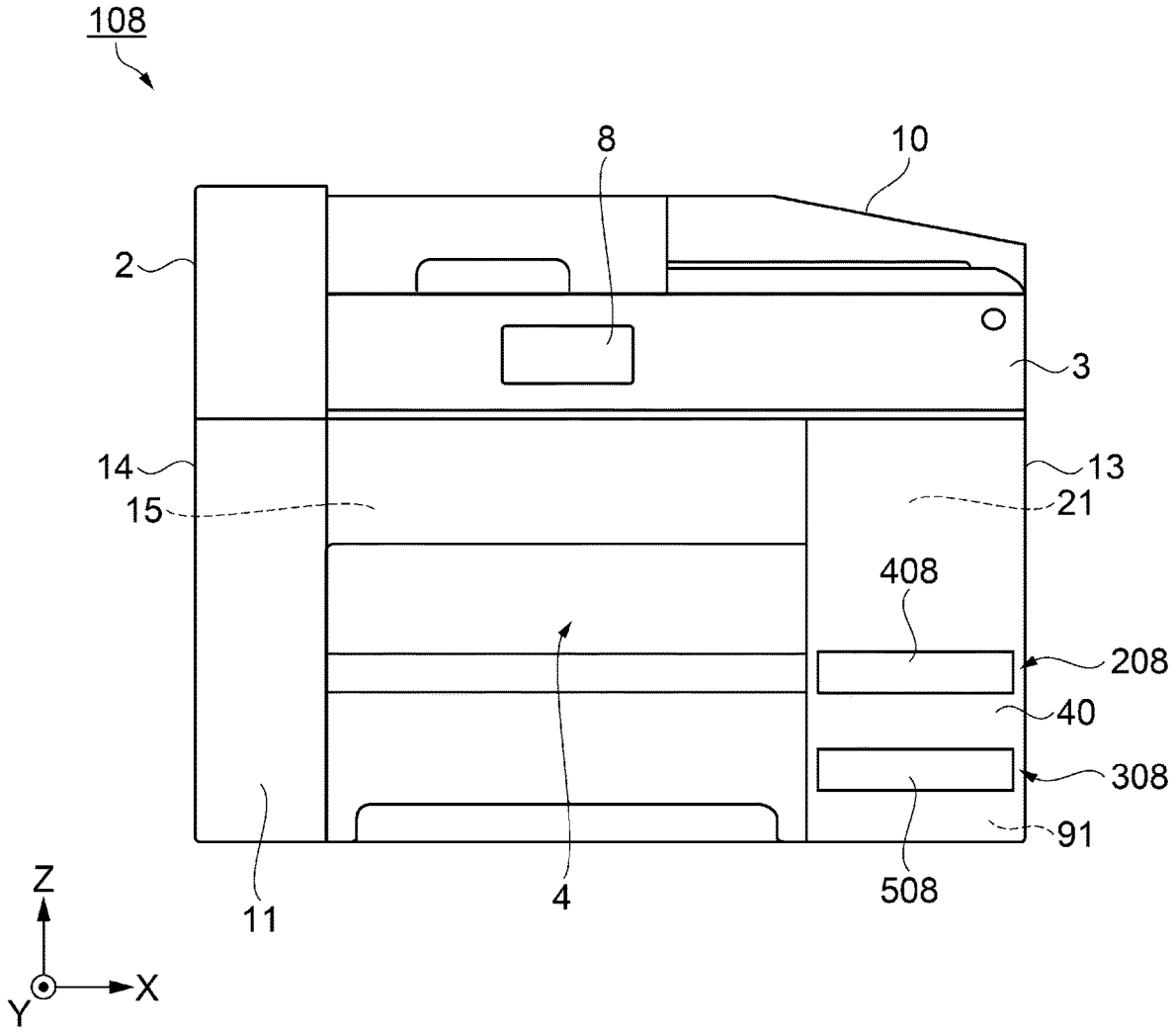
FIG. 8 is a front view showing an external appearance of a printer according to an eighth embodiment.

FIG. 8 is a front view showing an external appearance of a printer according to an eighth embodiment.

As shown in FIG. 8, the printer 108 has an opening/closing unit 40, and is provided with visual recognition units 208 and 308 capable of checking a remaining amount of ink in a tank 21 and a state of a waste liquid receiving unit 91. Light transmitting members 408 and 508 are provided in the visual recognition units 208 and 308.

Figure 9:
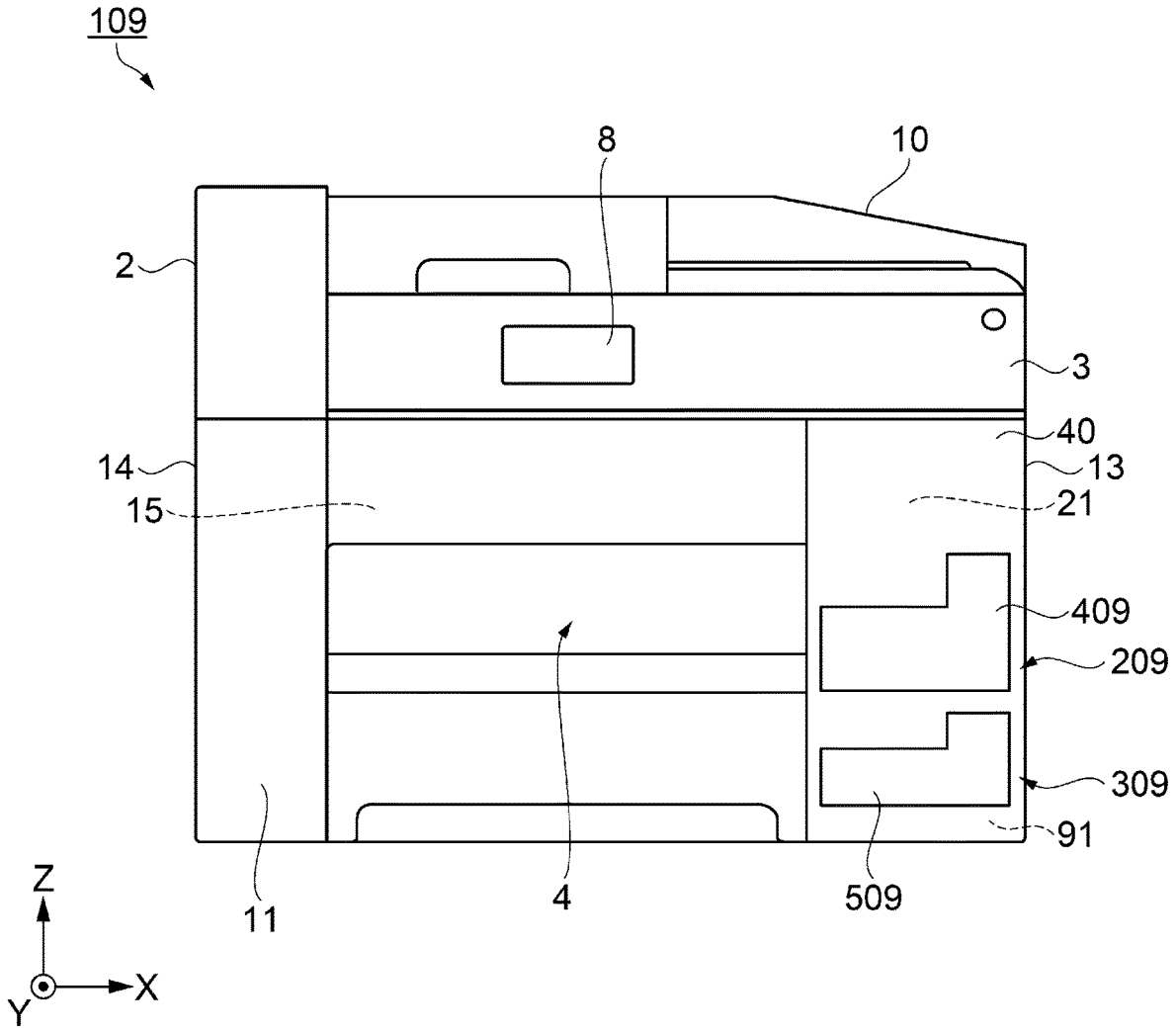
FIG. 9 is a front view showing an external appearance of a printer according to a ninth embodiment.

FIG. 9 is a front view showing an external appearance of a printer according to a ninth embodiment.

As shown in FIG. 9, the printer 109 has an opening/closing unit 40, and is provided with visual recognition units 209 and 309 capable of checking a remaining amount of ink in a tank 21 and a state of a waste liquid receiving unit 91. Light transmitting members 409 and 509 are provided in the visual recognition units 209 and 309.

Figure 10:
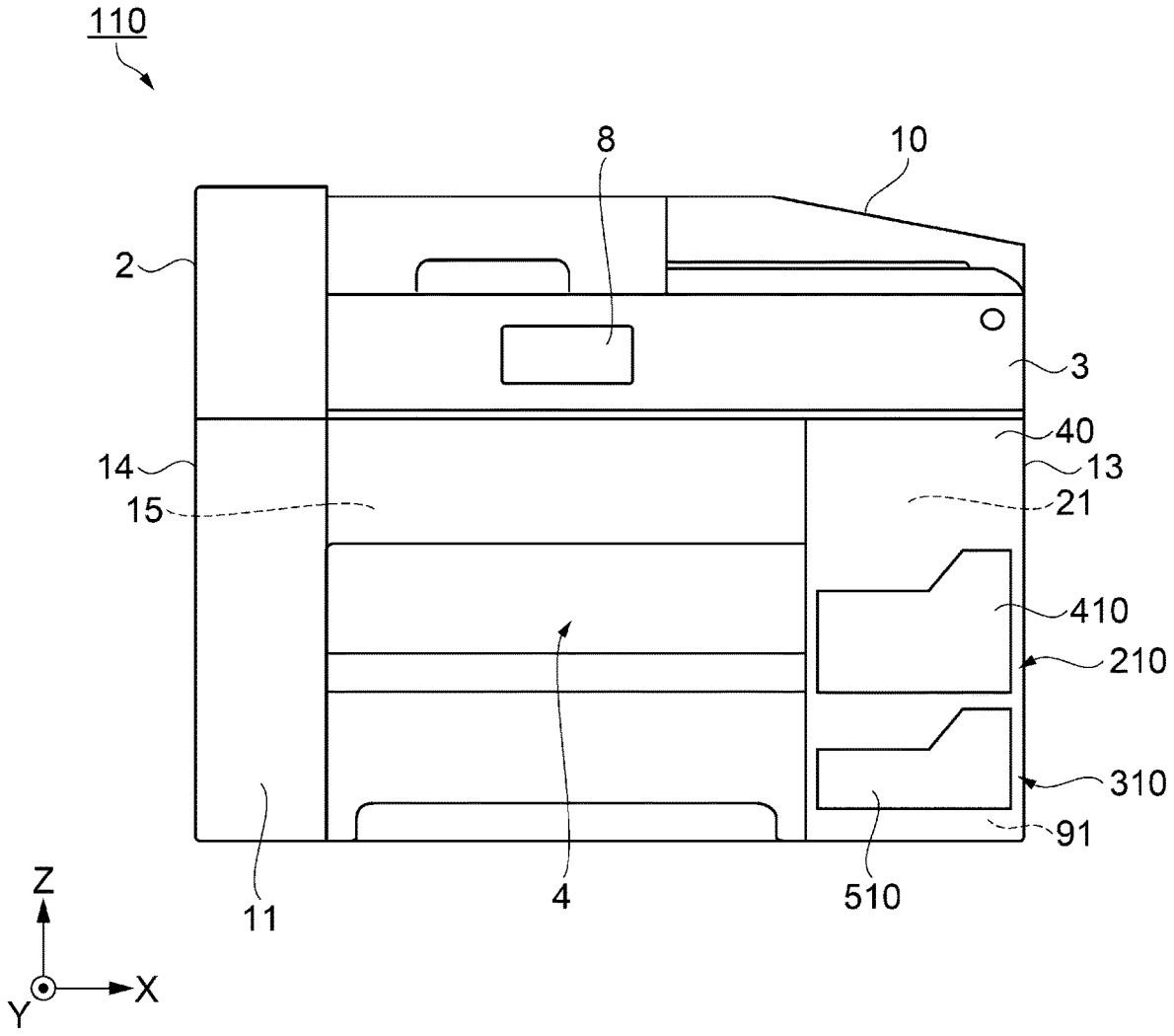
FIG. 10 is a front view showing an external appearance of a printer according to a tenth embodiment.

FIG. 10 is a front view showing an external appearance of a printer according to a tenth embodiment.

As shown in FIG. 10, the printer 110 has an opening/closing unit 40, and is provided with visual recognition units 210 and 310 capable of checking a remaining amount of ink in a tank 21 and a state of a waste liquid receiving unit 91. Light transmitting members 410 and 510 are provided in the visual recognition units 210 and 310.

Figure 11:
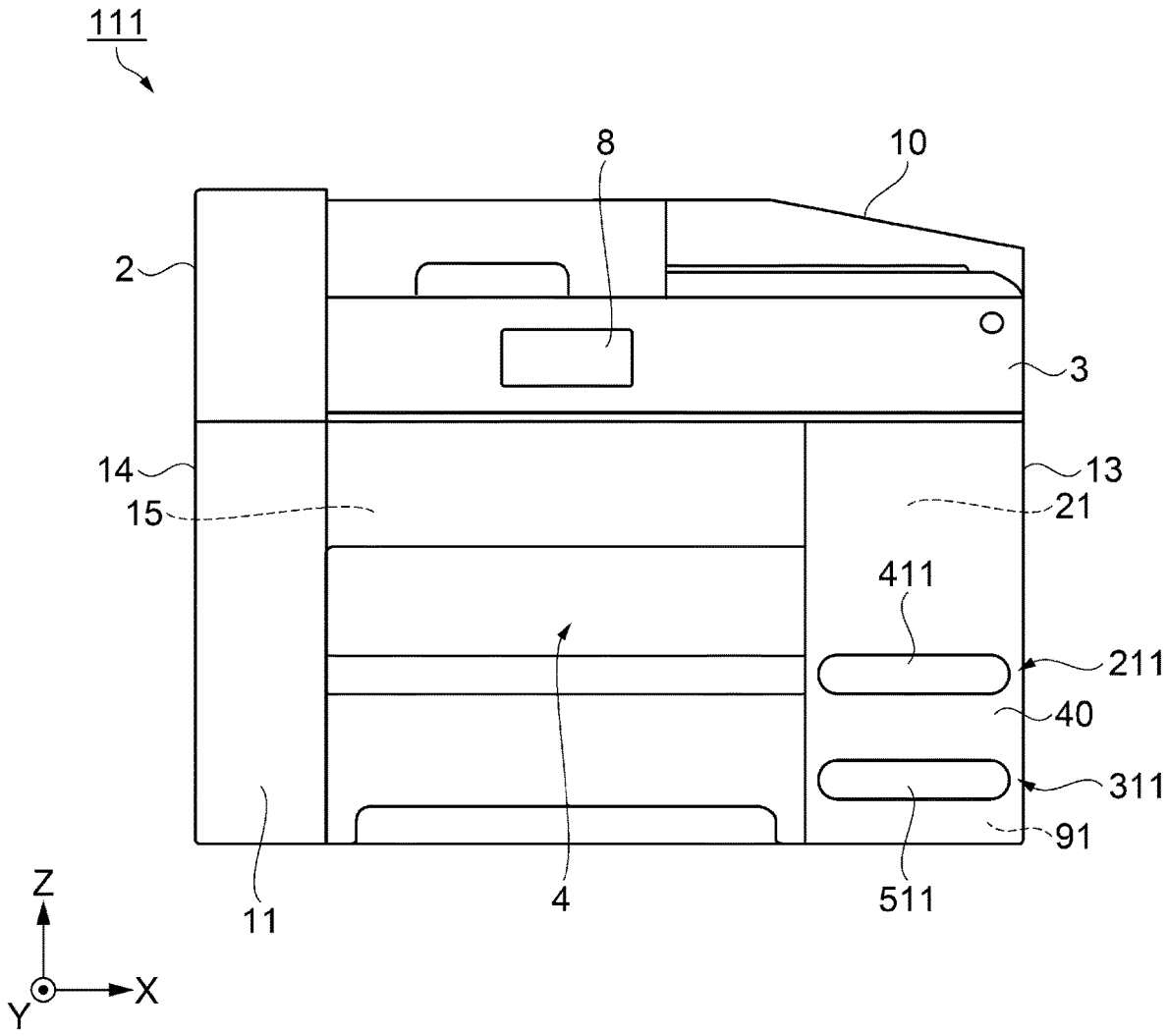
FIG. 11 is a front view showing an external appearance of a printer according to an eleventh embodiment.

FIG. 11 is a front view showing an external appearance of a printer according to an eleventh embodiment.

As shown in FIG. 11, the printer 111 has an opening/closing unit 40, and is provided with visual recognition units 211 and 311 capable of checking a remaining amount of ink in a tank 21 and a state of a waste liquid receiving unit 91. Light transmitting members 411 and 511 are provided in the visual recognition units 211 and 311. As shown in FIG. 11, some parts of the visual recognition units 211 and 311 have a curved portion.

Figure 12:
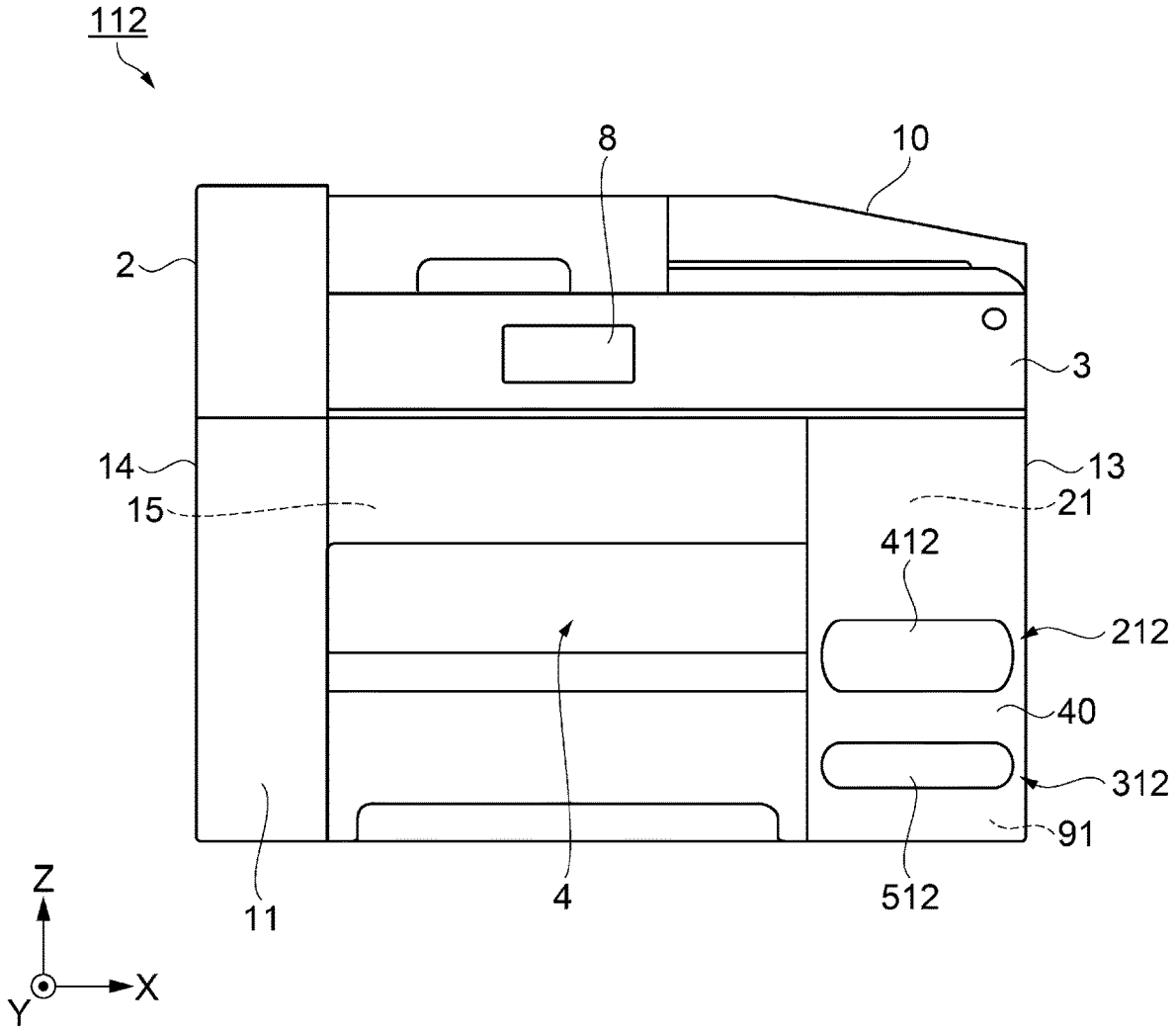
FIG. 12 is a front view showing an external appearance of a printer according to a twelfth embodiment.

FIG. 12 is a front view showing an external appearance of a printer according to a twelfth embodiment.

As shown in FIG. 12, the printer 112 has an opening/closing unit 40, and is provided with visual recognition units 212 and 312 capable of checking a remaining amount of ink in a tank 21 and a state of a waste liquid receiving unit 91. Light transmitting members 412 and 512 are provided in the visual recognition units 212 and 312. As shown in FIG. 12, some parts of the visual recognition units 212 and 312 have a curved portion.

Figure 13:
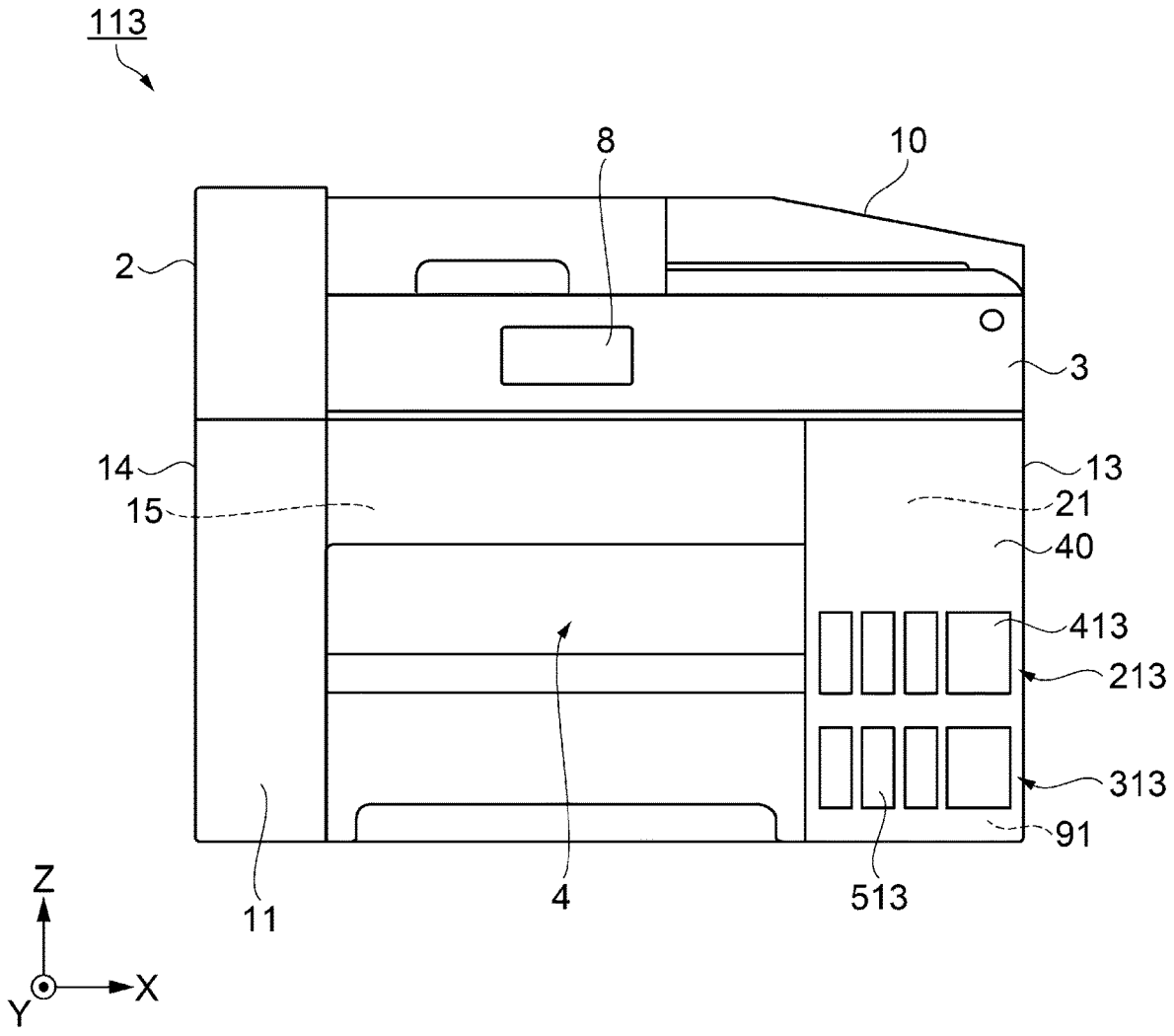
FIG. 13 is a front view showing an external appearance of a printer according to a thirteenth embodiment.

FIG. 13 is a front view showing an external appearance of a printer according to a thirteenth embodiment.

As shown in FIG. 13, the printer 113 has an opening/closing unit 40, and is provided with visual recognition units 213 and 313 capable of checking a remaining amount of ink in a tank 21 and a state of a waste liquid receiving unit 91. Light transmitting members 413 and 513 are provided in the visual recognition units 213 and 313. As shown in FIG. 13, each of the visual recognition units 213 and 313 has a plurality of opening ports (four in the present embodiment). Each opening port is formed in a rectangular shape. The plurality of opening ports of each of the visual recognition units 213 and 313 is arranged along an X axis. The number of the opening ports may be the same as the number of the tanks 21 mounted in the printer 113 and may be the number of kinds of colors of the ink accommodated in the tank 21. In addition, the sizes of some parts of the opening ports in each of the visual recognition units 213 and 313 are different from the sizes of other opening ports.

Figure 14:
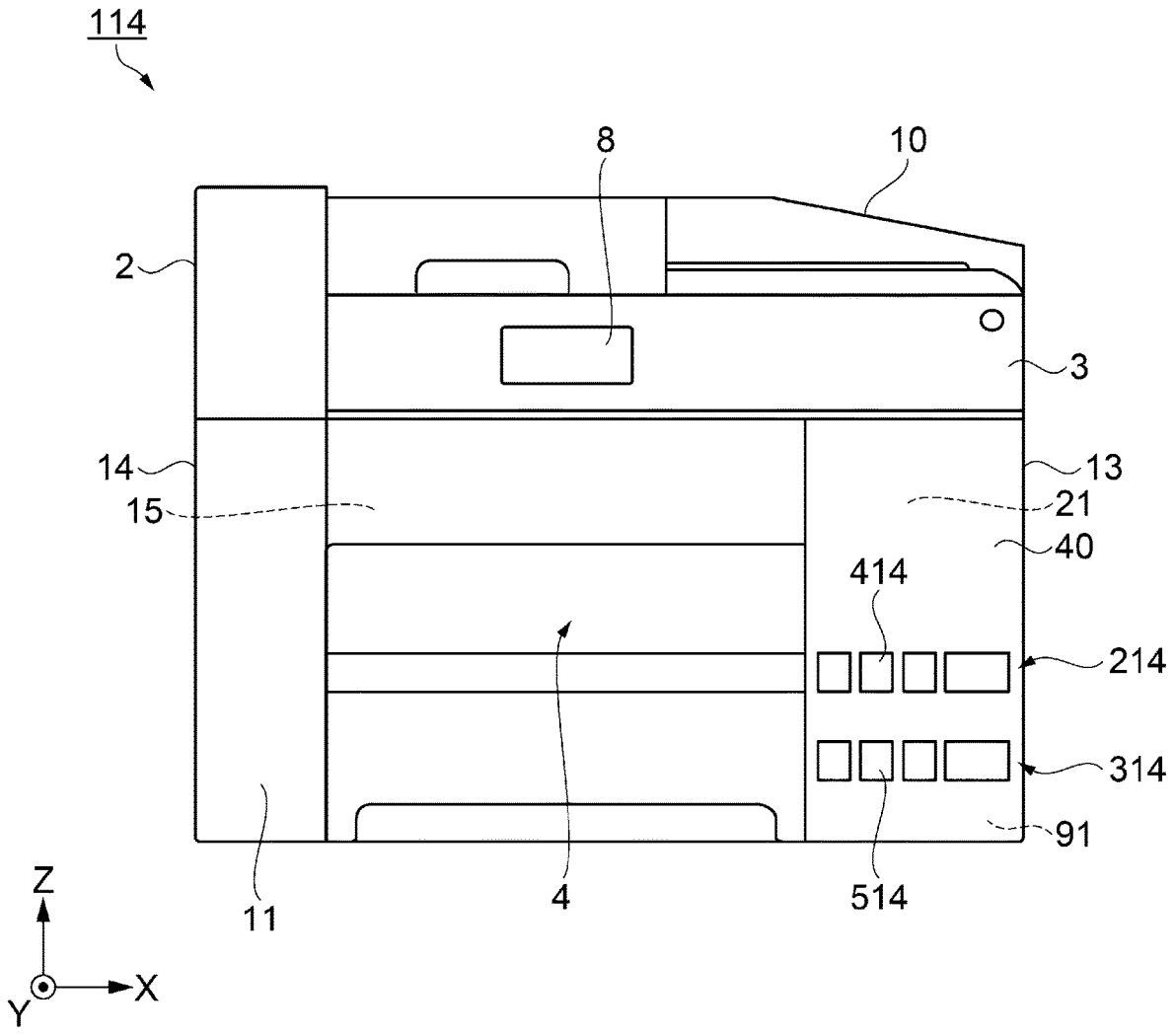
FIG. 14 is a front view showing an external appearance of a printer according to a fourteenth embodiment.

FIG. 14 is a front view showing an external appearance of a printer according to a fourteenth embodiment.

As shown in FIG. 14, the printer 114 has an opening/closing unit 40, and is provided with visual recognition units 214 and 314 capable of checking a remaining amount of ink in a tank 21 and a state of a waste liquid receiving unit 91. Light transmitting members 414 and 514 are provided in the visual recognition units 214 and 314. As shown in FIG. 14, each of the visual recognition units 214 and 314 has a plurality of opening ports (four in the present embodiment). Each opening port is formed in a rectangular shape. The plurality of opening ports of each of the visual recognition units 214 and 314 is arranged along an X axis. The number of the opening ports may be the same as the number of the tanks 21 mounted in the printer 114 and may be the number of kinds of colors of the ink accommodated in the tank 21. In addition, the sizes of some of the opening ports in each of the visual recognition units 214 and 314 are different from the sizes of other opening ports.

Figure 15:
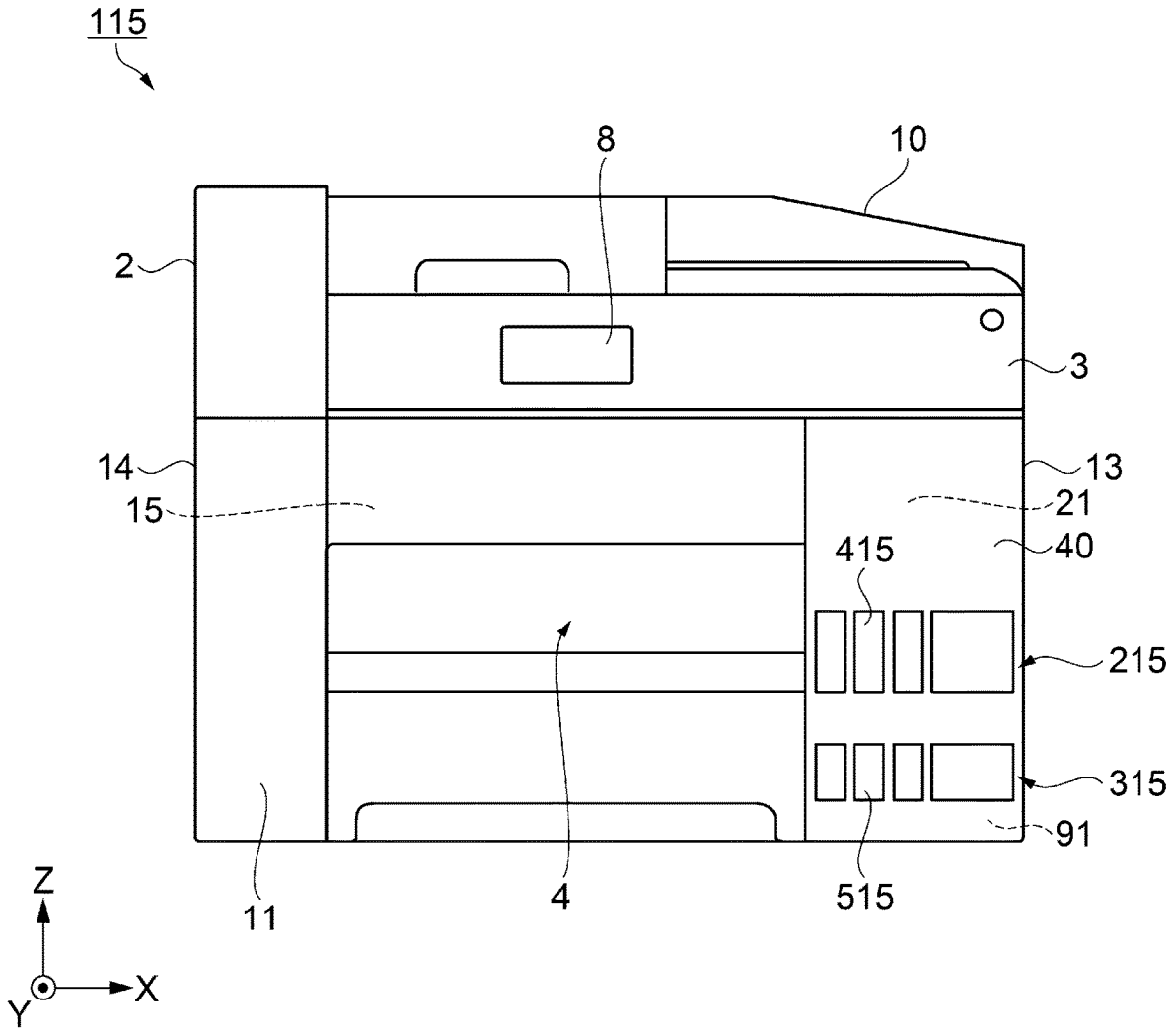
FIG. 15 is a front view showing an external appearance of a printer according to a fifteenth embodiment.

FIG. 15 is a front view showing an external appearance of a printer according to a fifteenth embodiment.

As shown in FIG. 15, the printer 115 has an opening/closing unit 40, and is provided with visual recognition units 215 and 315 capable of checking a remaining amount of ink in a tank 21 and a state of a waste liquid receiving unit 91. Light transmitting members 415 and 515 are provided in the visual recognition units 215 and 315. As shown in FIG. 15, each of the visual recognition units 215 and 315 has a plurality of opening ports (four in the present embodiment). Each opening port is formed in a rectangular shape. The plurality of opening ports of each of the visual recognition units 215 and 315 is arranged along an X axis. The number of the opening ports may be the same as the number of the tanks 21 mounted in the printer 115 and may be the number of kinds of colors of the ink accommodated in the tank 21. In addition, the sizes of some of the opening ports in each of the visual recognition units 215 and 315 are different from the sizes of other opening ports.

Figure 16:
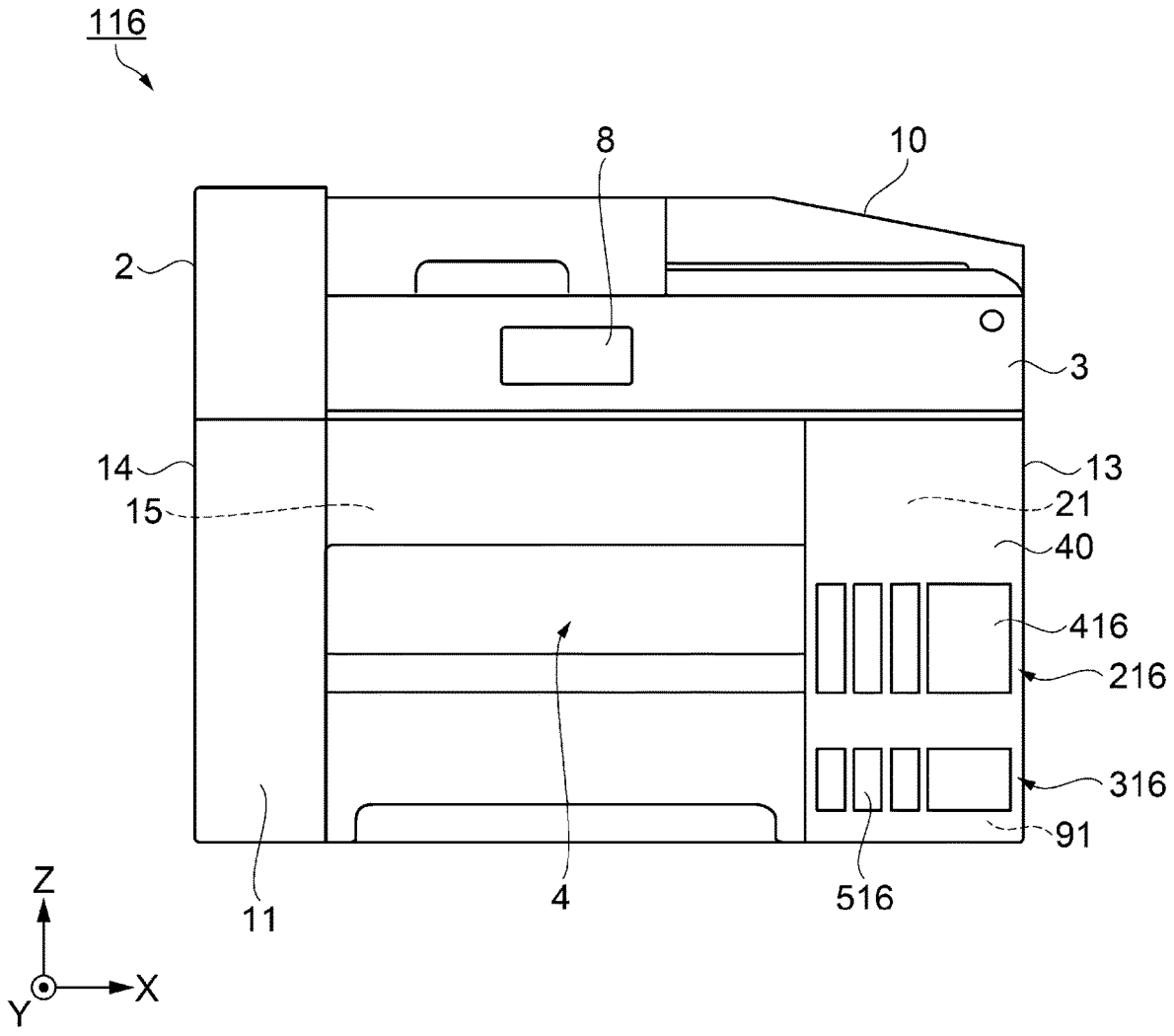
FIG. 16 is a front view showing an external appearance of a printer according to a sixteenth embodiment.

FIG. 16 is a front view showing an external appearance of a printer according to a sixteenth embodiment.

As shown in FIG. 16, the printer 116 has an opening/closing unit 40, and is provided with visual recognition units 216 and 316 capable of checking a remaining amount of ink in a tank 21 and a state of a waste liquid receiving unit 91. Light transmitting members 416 and 516 are provided in the visual recognition units 216 and 316. As shown in FIG. 16, each of the visual recognition units 216 and 316 has a plurality of opening ports (four in the present embodiment). Each opening port is formed in a rectangular shape. The plurality of opening ports of each of the visual recognition units 216 and 316 is arranged along an X axis. The number of the opening ports may be the same as the number of the tanks 21 mounted in the printer 116 and may be the number of kinds of colors of the ink accommodated in the tank 21. In addition, the sizes of some of the opening ports in each of the visual recognition units 216 and 316 are different from the sizes of other opening ports.

Figure 17:
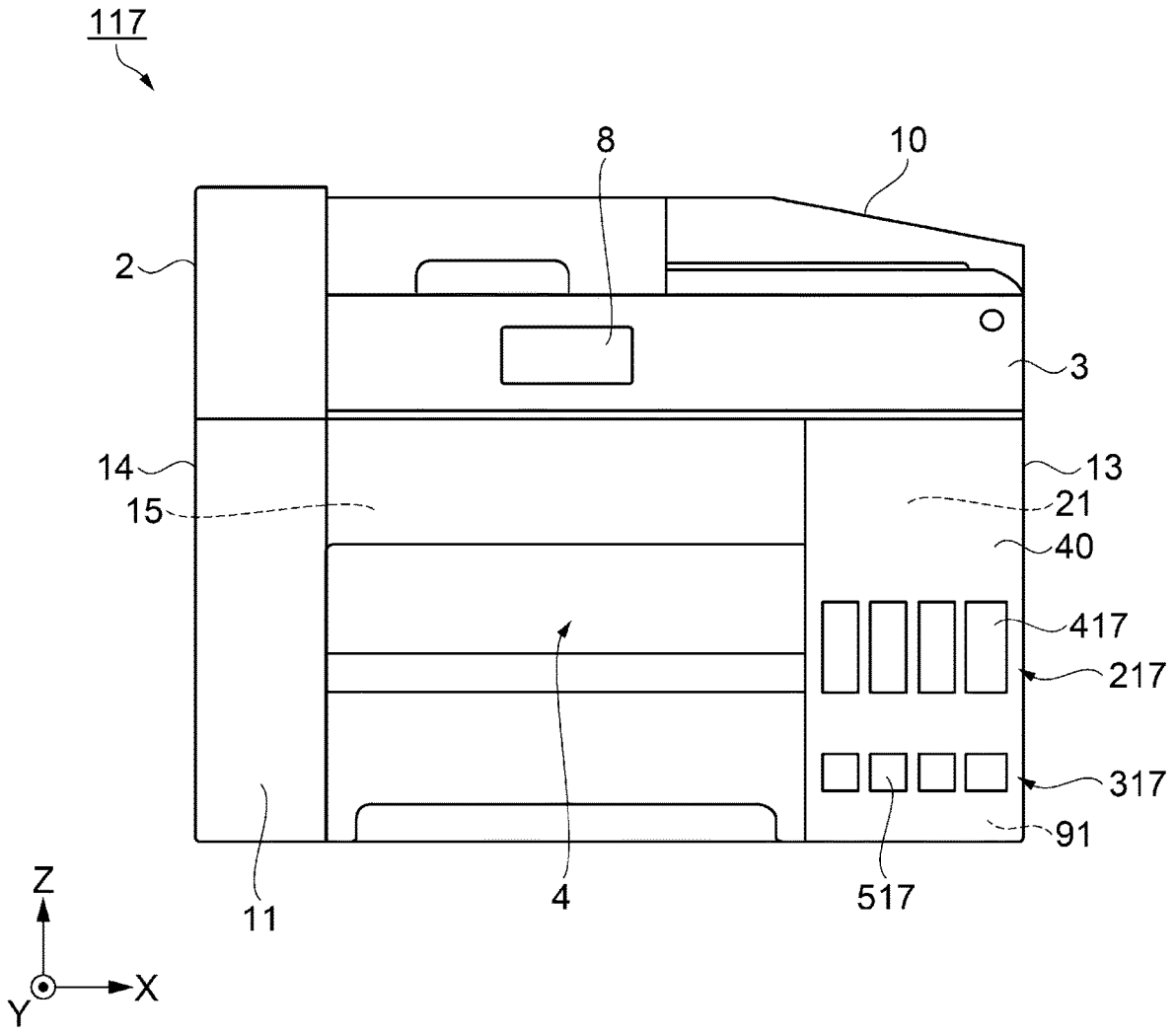
FIG. 17 is a front view showing an external appearance of a printer according to a seventeenth embodiment.

FIG. 17 is a front view showing an external appearance of a printer according to a seventeenth embodiment.

As shown in FIG. 17, the printer 117 has an opening/closing unit 40, and is provided with visual recognition units 217 and 317 capable of checking a remaining amount of ink in a tank 21 and a state of a waste liquid receiving unit 91. Light transmitting members 417 and 517 are provided in the visual recognition units 217 and 317. As shown in FIG. 17, each of the visual recognition units 217 and 317 has a plurality of opening ports (four in the present embodiment). Each opening port is formed in a rectangular shape. The plurality of opening ports of each of the visual recognition units 217 and 317 is arranged along an X axis. In addition, the opening ports in the visual recognition unit 217 are all the same size. The opening ports in the visual recognition unit 317 are all the same size. Note that, the size of the opening port is different between the visual recognition unit 217 and the visual recognition unit 317.

Figure 18:
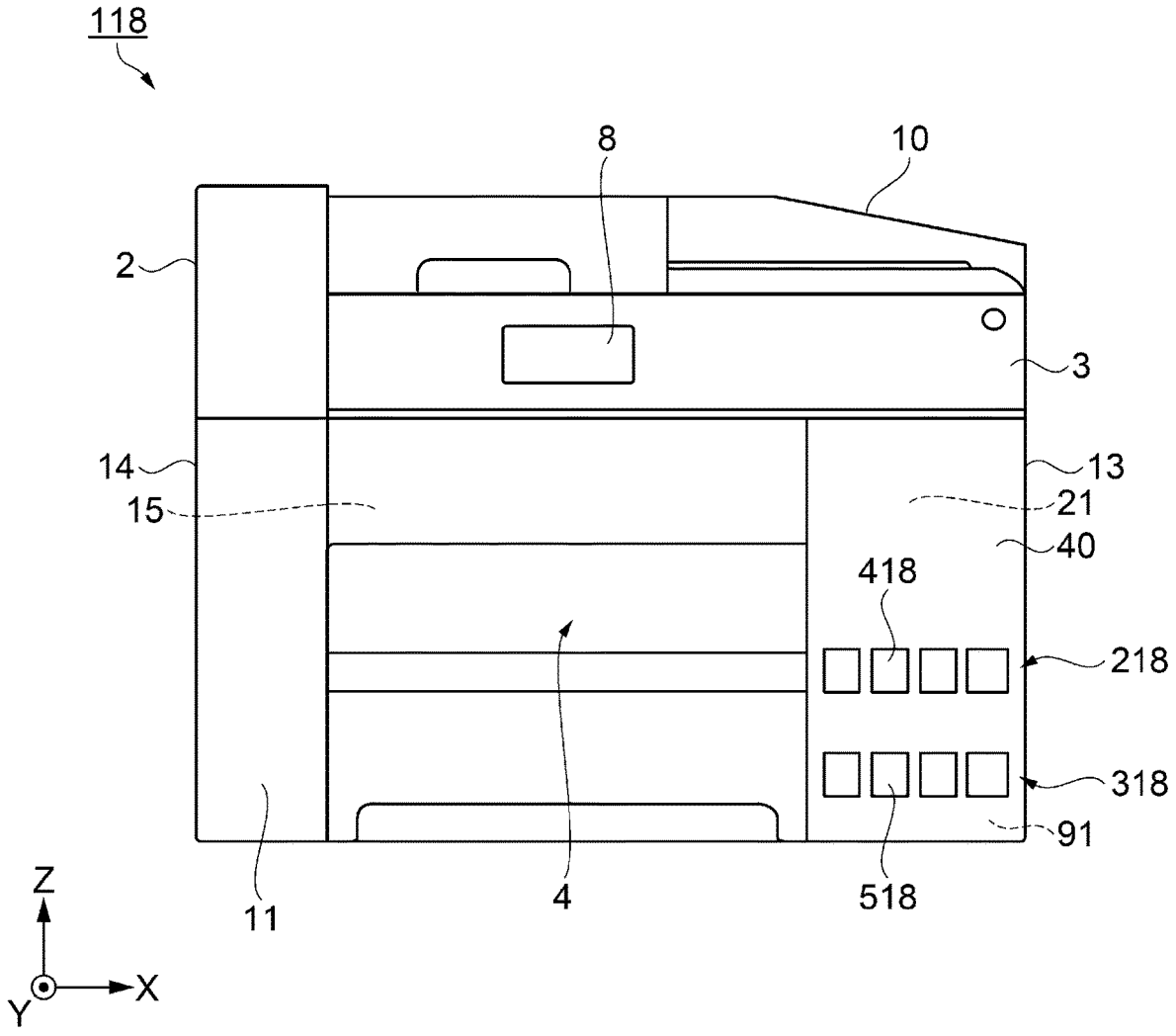
FIG. 18 is a front view showing an external appearance of a printer according to an eighteenth embodiment.

FIG. 18 is a front view showing an external appearance of a printer according to an eighteenth embodiment.

As shown in FIG. 18, the printer 118 has an opening/closing unit 40, and is provided with visual recognition units 218 and 318 capable of checking a remaining amount of ink in a tank 21 and a state of a waste liquid receiving unit 91. Light transmitting members 418 and 518 are provided in the visual recognition units 218 and 318. As shown in FIG. 18, each of the visual recognition units 218 and 318 has a plurality of opening ports (four in the present embodiment). Each opening port is formed in a rectangular shape. The plurality of opening ports of each of the visual recognition units 218 and 318 is arranged along an X axis. In addition, the opening ports of the visual recognition units 218 and 318 are all the same size.

Figure 19:
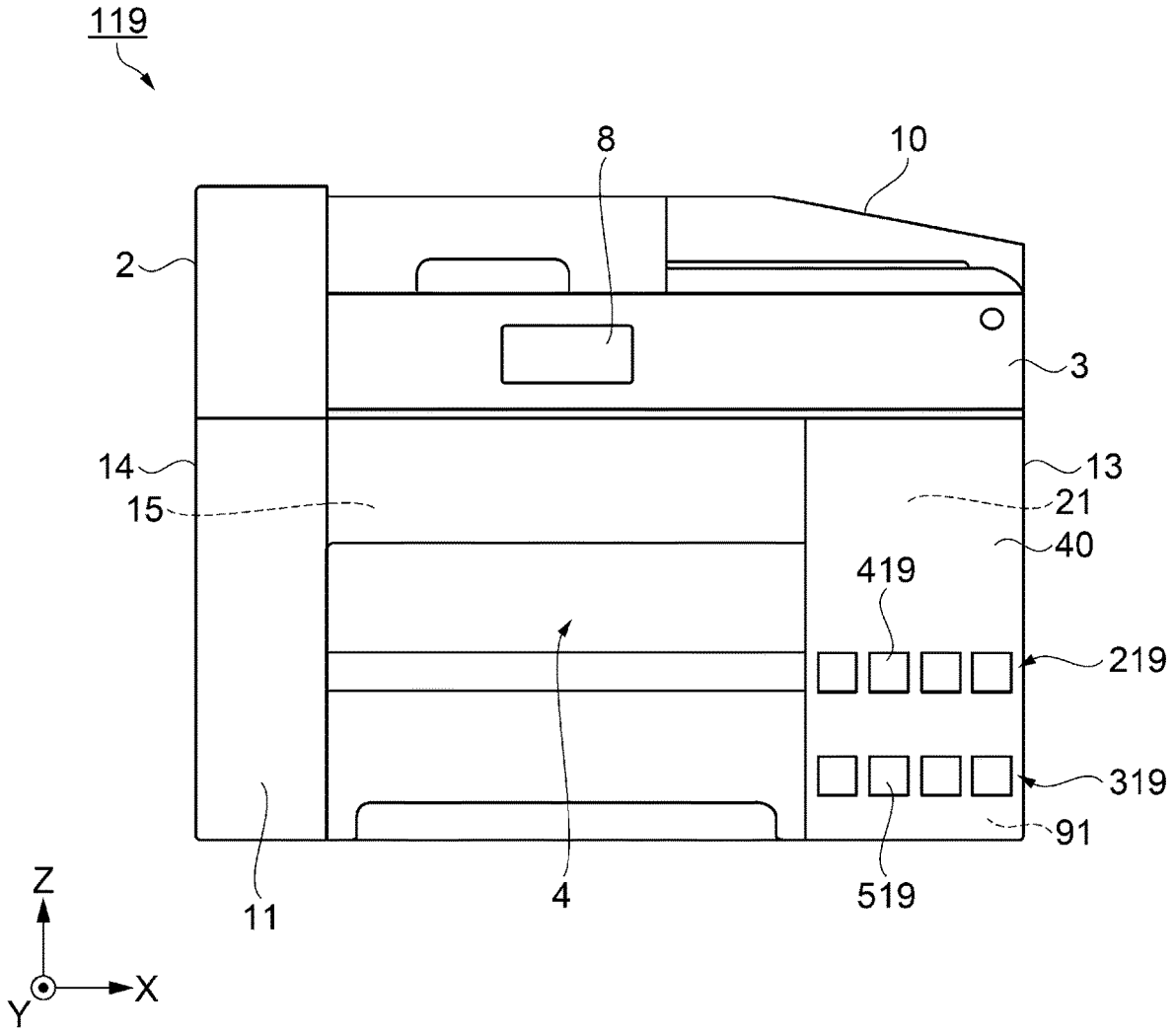
FIG. 19 is a front view showing an external appearance of a printer according to a nineteenth embodiment.

FIG. 19 is a front view showing an external appearance of a printer according to a nineteenth embodiment.

As shown in FIG. 19, the printer 119 has an opening/closing unit 40, and is provided with visual recognition units 219 and 319 capable of checking a remaining amount of ink in a tank 21 and a state of a waste liquid receiving unit 91. Light transmitting members 419 and 519 are provided in the visual recognition units 219 and 319. As shown in FIG. 19, each of the visual recognition units 219 and 319 has a plurality of opening ports (four in the present embodiment). Each opening port is formed in a rectangular shape. The plurality of opening ports of each of the visual recognition units 219 and 319 is arranged along an X axis. In addition, the opening ports of the visual recognition units 219 and 319 are all the same size.

Figure 20:
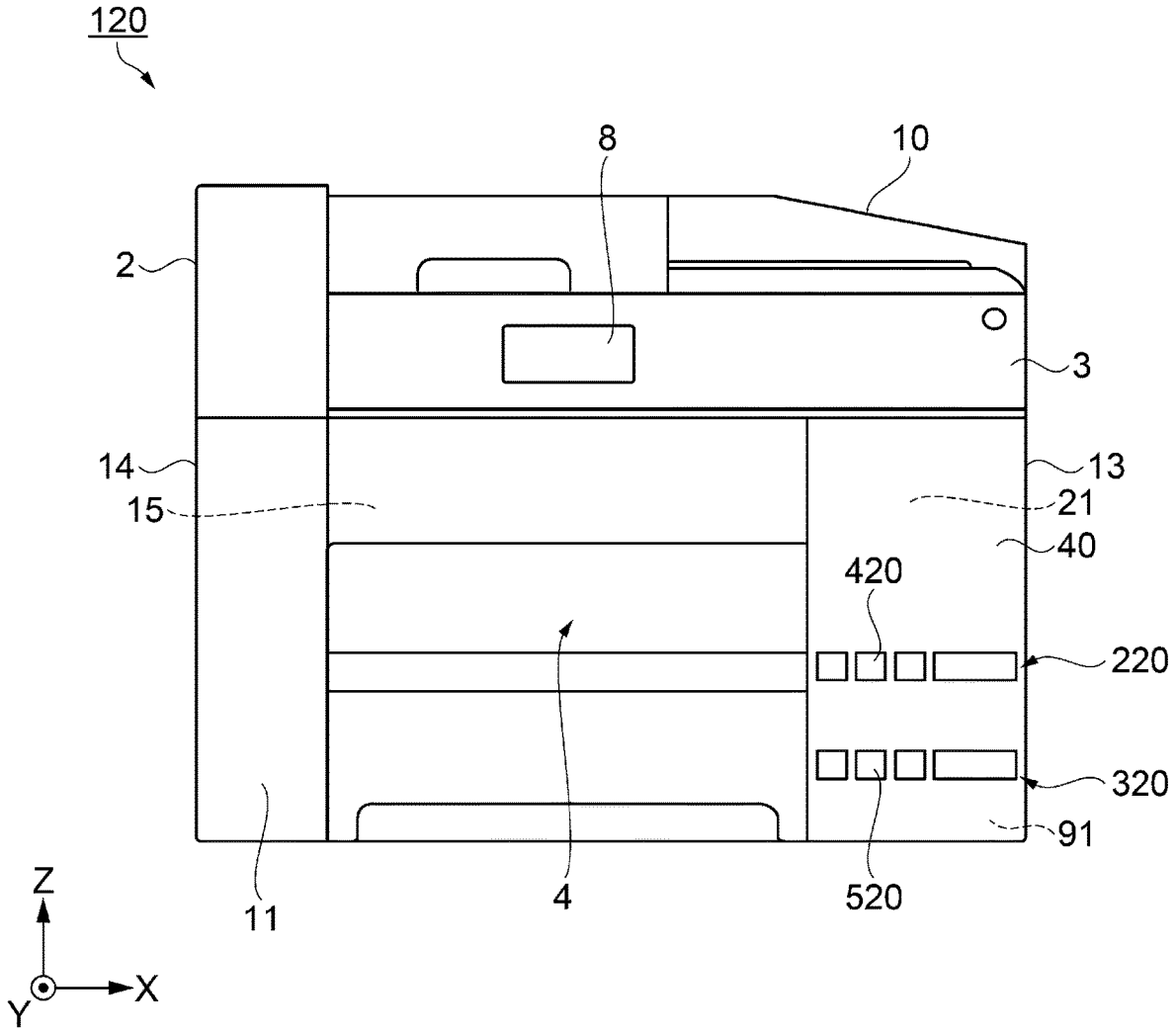
FIG. 20 is a front view showing an external appearance of a printer according to a twentieth embodiment.

FIG. 20 is a front view showing an external appearance of a printer according to a twentieth embodiment.

As shown in FIG. 20, the printer 120 has an opening/closing unit 40, and is provided with visual recognition units 220 and 320 capable of checking a remaining amount of ink in a tank 21 and a state of a waste liquid receiving unit 91. Light transmitting members 420 and 520 are provided in the visual recognition units 220 and 320. As shown in FIG. 20, each of the visual recognition units 220 and 320 has a plurality of opening ports (four in the present embodiment). Each opening port is formed in a rectangular shape. The plurality of opening ports of each of the visual recognition units 220 and 320 is arranged along an X axis. In addition, the sizes of some of the opening ports in each of the visual recognition units 220 and 320 are different from the sizes of other opening ports.

Figure 21:
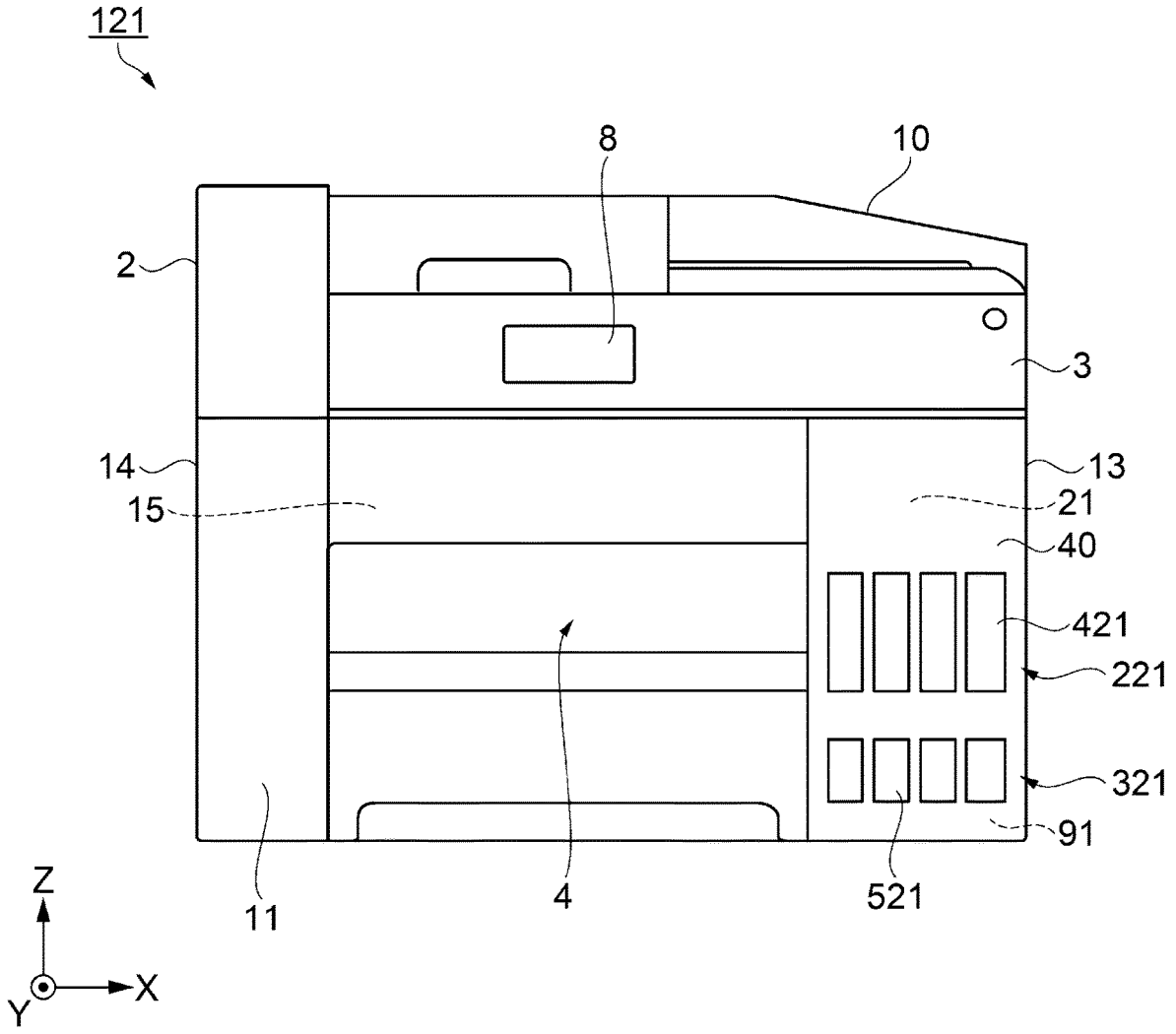
FIG. 21 is a front view showing an external appearance of a printer according to a twenty first embodiment.

FIG. 21 is a front view showing an external appearance of a printer according to a twenty first embodiment.

As shown in FIG. 21, the printer 121 has an opening/closing unit 40, and is provided with visual recognition units 221 and 321 capable of checking a remaining amount of ink in a tank 21 and a state of a waste liquid receiving unit 91. Light transmitting members 421 and 521 are provided in the visual recognition units 221 and 321. As shown in FIG. 21, each of the visual recognition units 221 and 321 has a plurality of opening ports (four in the present embodiment). Each opening port is formed in a rectangular shape. The plurality of opening ports of each of the visual recognition units 221 and 321 is arranged along an X axis. In addition, the opening ports in the visual recognition unit 221 are all the same size. The opening ports in the visual recognition unit 321 are all the same size. Note that, the size of the opening port is different between the visual recognition unit 221 and the visual recognition unit 321.

Figure 22:
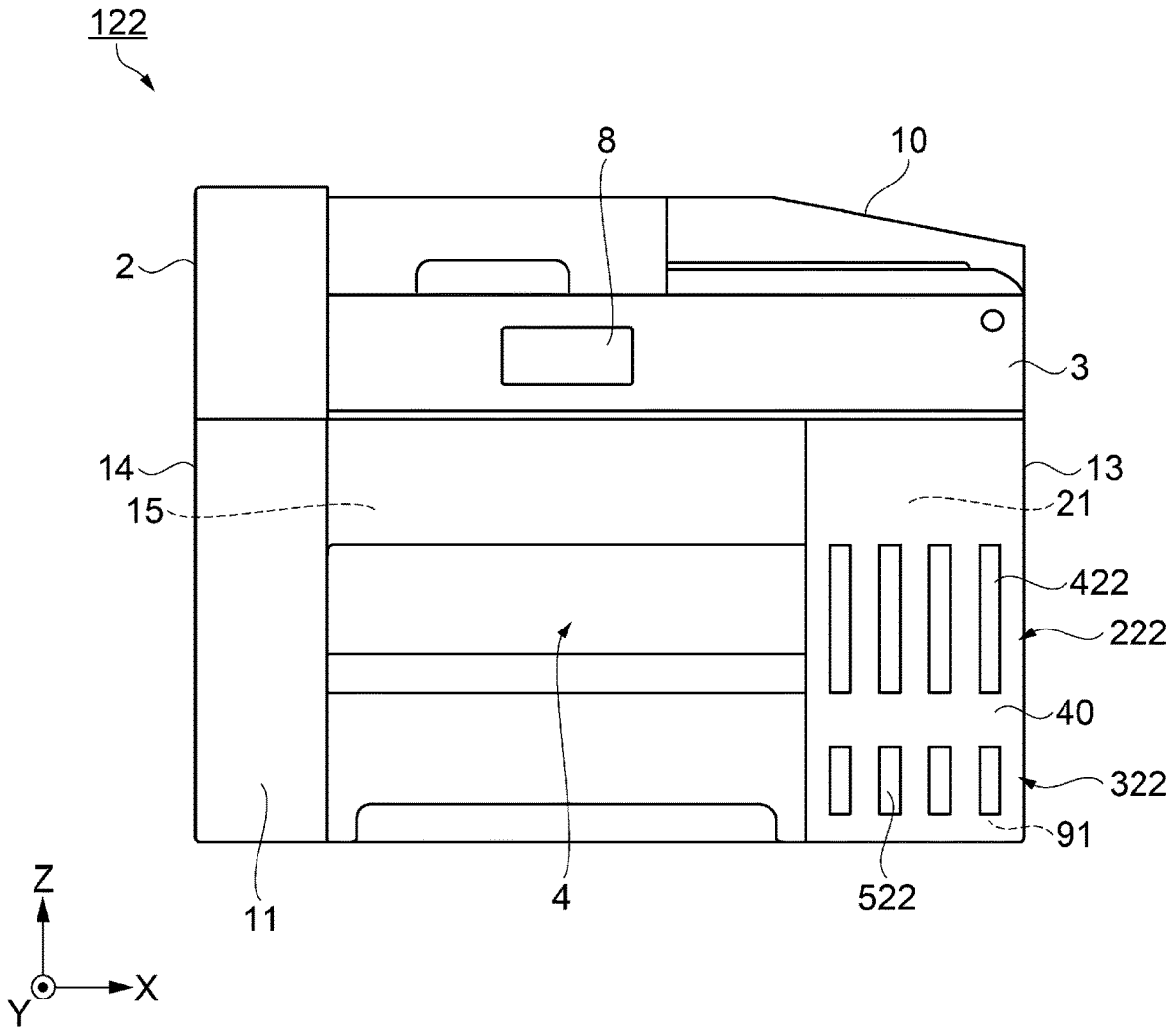
FIG. 22 is a front view showing an external appearance of a printer according to a twenty second embodiment.

FIG. 22 is a front view showing an external appearance of a printer according to a twenty second embodiment.

As shown in FIG. 22, the printer 122 has an opening/closing unit 40, and is provided with visual recognition units 222 and 322 capable of checking a remaining amount of ink in a tank 21 and a state of a waste liquid receiving unit 91. Light transmitting members 422 and 522 are provided in the visual recognition units 222 and 322. As shown in FIG. 22, each of the visual recognition units 222 and 322 has a plurality of opening ports (four in the present embodiment). Each opening port is formed in a rectangular shape. The plurality of opening ports of each of the visual recognition units 222 and 322 is arranged along an X axis. In addition, the opening ports in the visual recognition unit 222 are all the same size. The opening ports in the visual recognition unit 322 are all the same size. Note that, the size of the opening port is different between the visual recognition unit 222 and the visual recognition unit 322.

Figure 23:
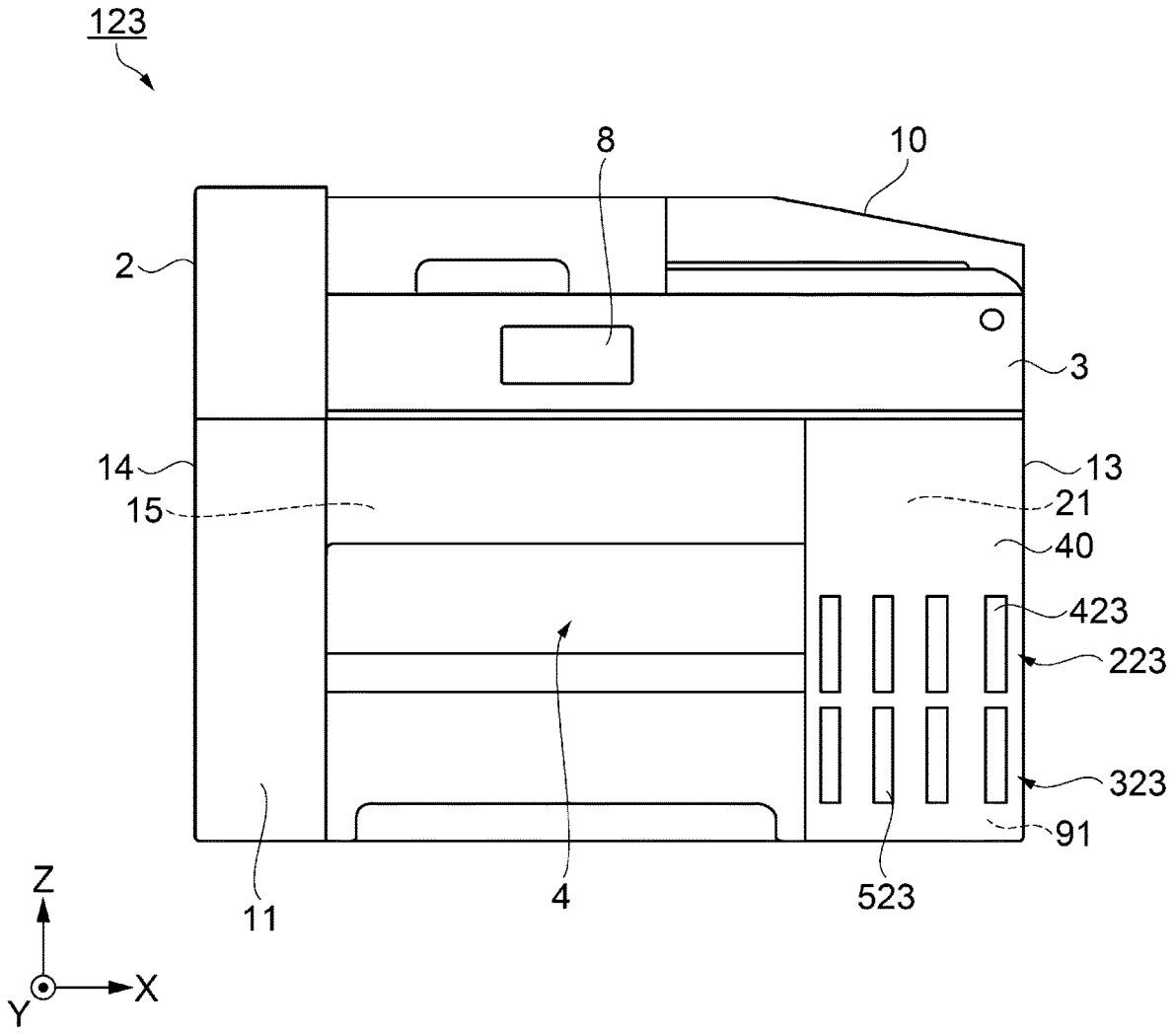
FIG. 23 is a front view showing an external appearance of a printer according to a twenty third embodiment.

FIG. 23 is a front view showing an external appearance of a printer according to a twenty third embodiment.

As shown in FIG. 23, the printer 123 has an opening/closing unit 40, and is provided with visual recognition units 223 and 323 capable of checking a remaining amount of ink in a tank 21 and a state of a waste liquid receiving unit 91. Light transmitting members 423 and 523 are provided in the visual recognition units 223 and 323. As shown in FIG. 23, each of the visual recognition units 223 and 323 has a plurality of opening ports (four in the present embodiment). Each opening port is formed in a rectangular shape. The plurality of opening ports of each of the visual recognition units 223 and 323 is arranged along an X axis. In addition, the opening ports in the visual recognition unit 223 and 323 are all the same size.

Figure 24:
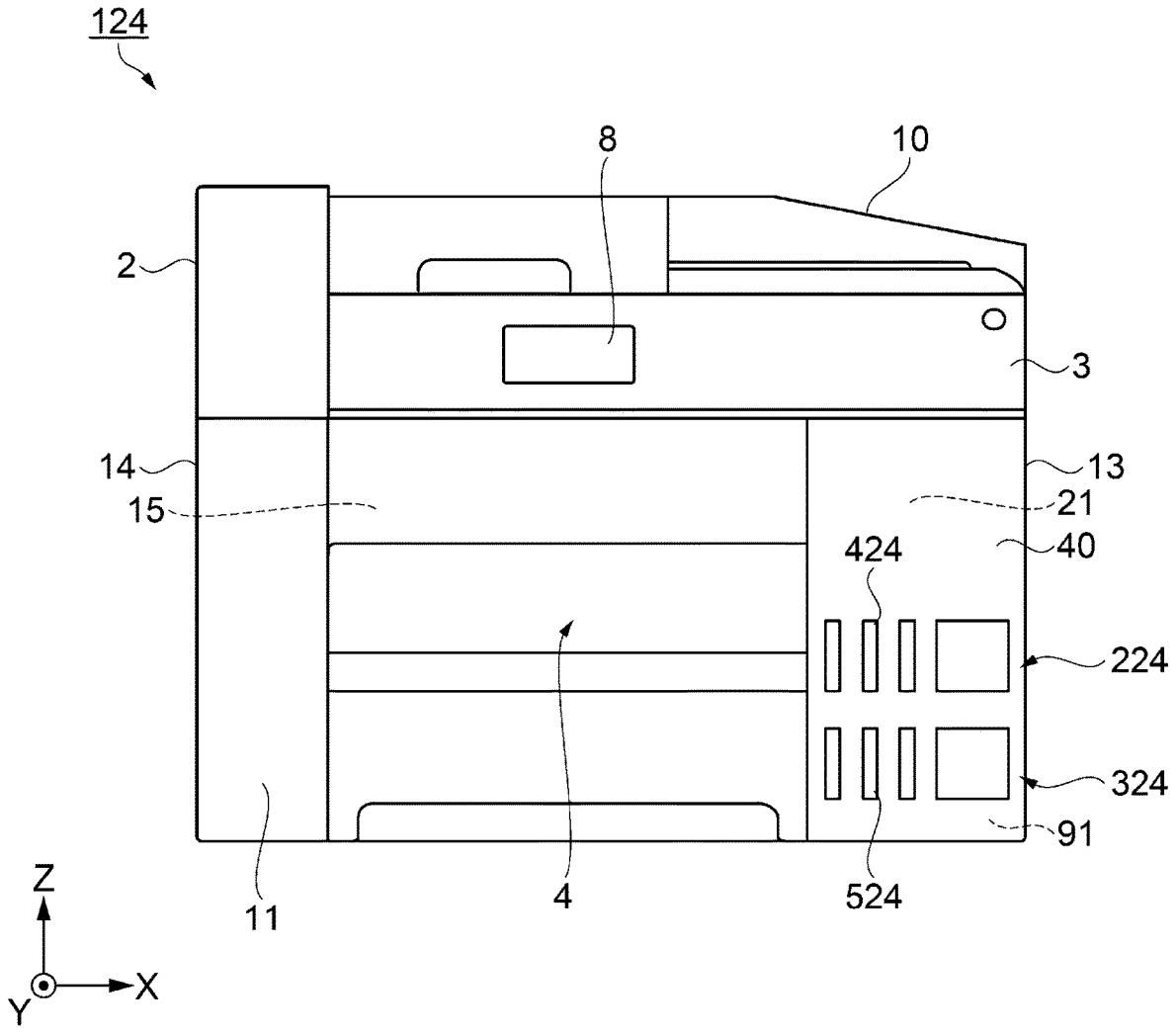
FIG. 24 is a front view showing an external appearance of a printer according to a twenty fourth embodiment.

FIG. 24 is a front view showing an external appearance of a printer according to a twenty fourth embodiment.

As shown in FIG. 24, the printer 124 has an opening/closing unit 40, and is provided with visual recognition units 224 and 324 capable of checking a remaining amount of ink in a tank 21 and a state of a waste liquid receiving unit 91. Light transmitting members 424 and 524 are provided in the visual recognition units 224 and 324. As shown in FIG. 24, each of the visual recognition units 224 and 324 has a plurality of opening ports (four in the present embodiment). Each opening port is formed in a rectangular shape. The plurality of opening ports of each of the visual recognition units 224 and 324 is arranged along an X axis. In addition, the sizes of some of the opening ports in each of the visual recognition units 224 and 324 are different from the sizes of other opening ports.

Figure 25:
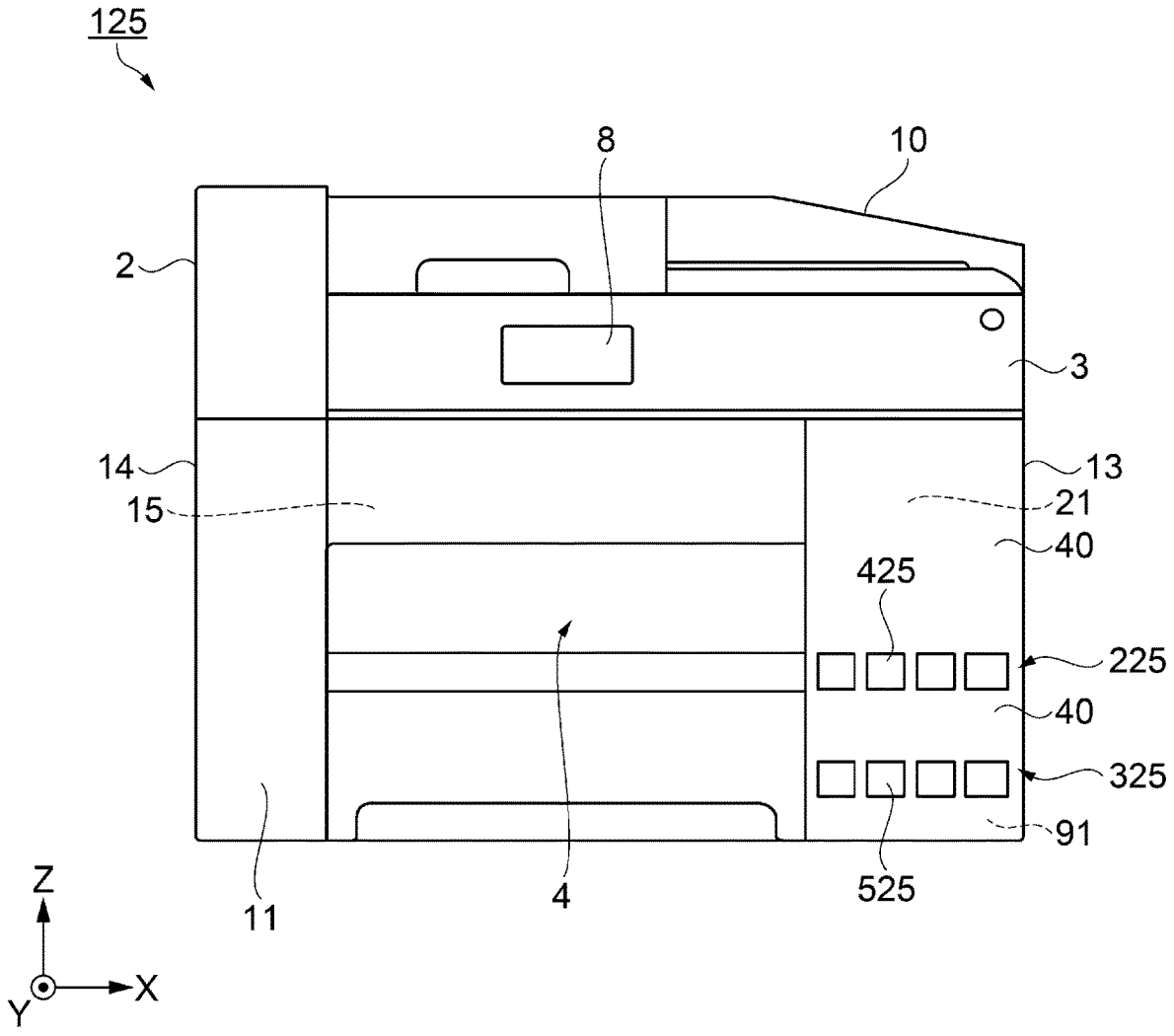
FIG. 25 is a front view showing an external appearance of a printer according to a twenty fifth embodiment.

FIG. 25 is a front view showing an external appearance of a printer according to a twenty fifth embodiment.

As shown in FIG. 25, the printer 125 has an opening/closing unit 40, and is provided with visual recognition units 225 and 325 capable of checking a remaining amount of ink in a tank 21 and a state of a waste liquid receiving unit 91. Light transmitting members 425 and 525 are provided in the visual recognition units 225 and 325. As shown in FIG. 25, each of the visual recognition units 225 and 325 has a plurality of opening ports (four in the present embodiment). Each opening port is formed in a rectangular shape. The plurality of opening ports of each of the visual recognition units 225 and 325 is arranged along an X axis. In addition, the opening ports of the visual recognition units 225 and 325 are all the same size.

Figure 26:
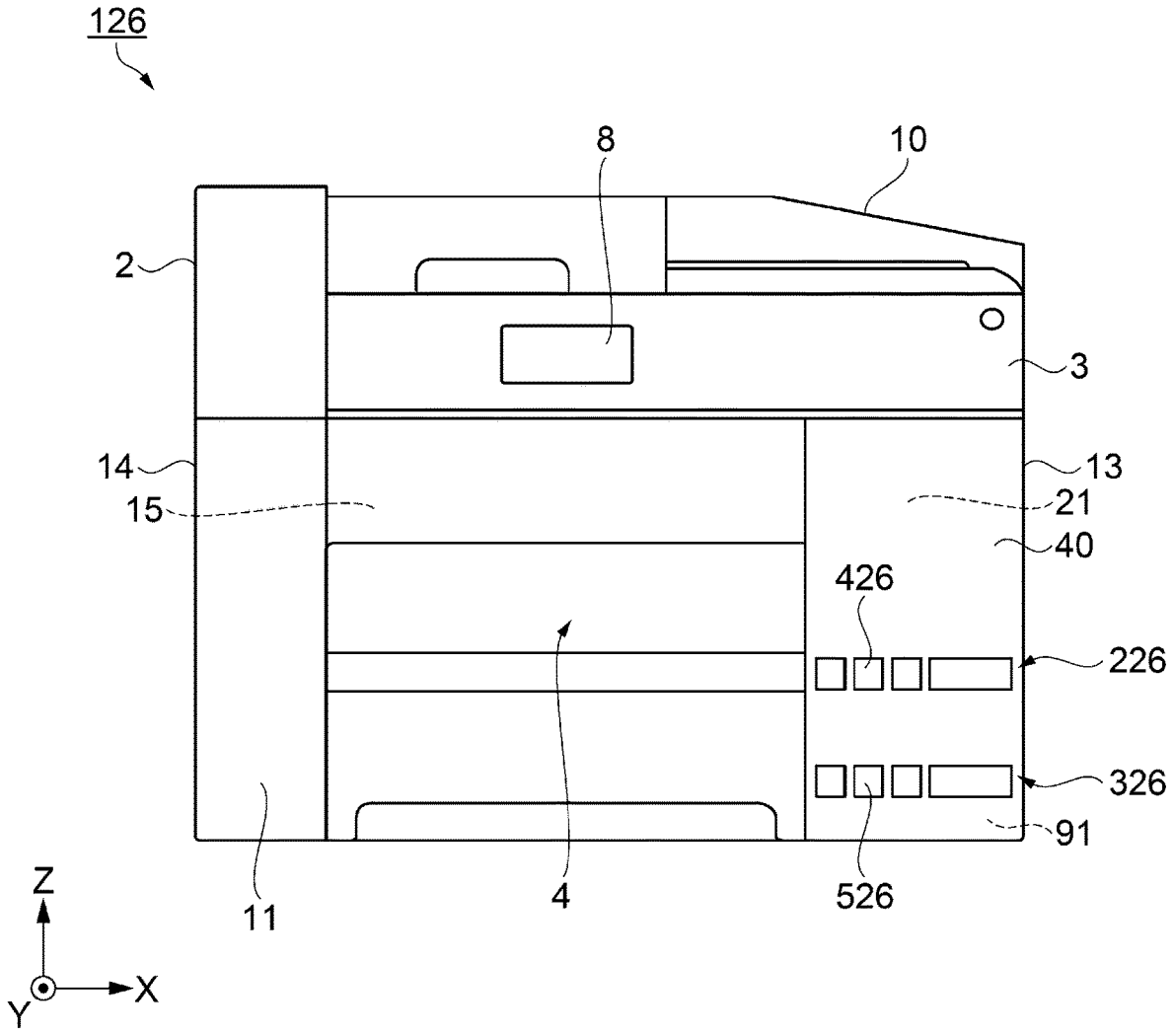
FIG. 26 is a front view showing an external appearance of a printer according to a twenty sixth embodiment.

FIG. 26 is a front view showing an external appearance of a printer according to a twenty sixth embodiment.

As shown in FIG. 26, the printer 126 has an opening/closing unit 40, and is provided with visual recognition units 226 and 326 capable of checking a remaining amount of ink in a tank 21 and a state of a waste liquid receiving unit 91. Light transmitting members 426 and 526 are provided in the visual recognition units 226 and 326. As shown in FIG. 26, each of the visual recognition units 226 and 326 has a plurality of opening ports (four in the present embodiment). Each opening port is formed in a rectangular shape. The plurality of opening ports of each of the visual recognition units 226 and 326 is arranged along an X axis. In addition, the sizes of some of the opening ports in each of the visual recognition units 226 and 326 are different from the sizes of other opening ports.

Figure 27:
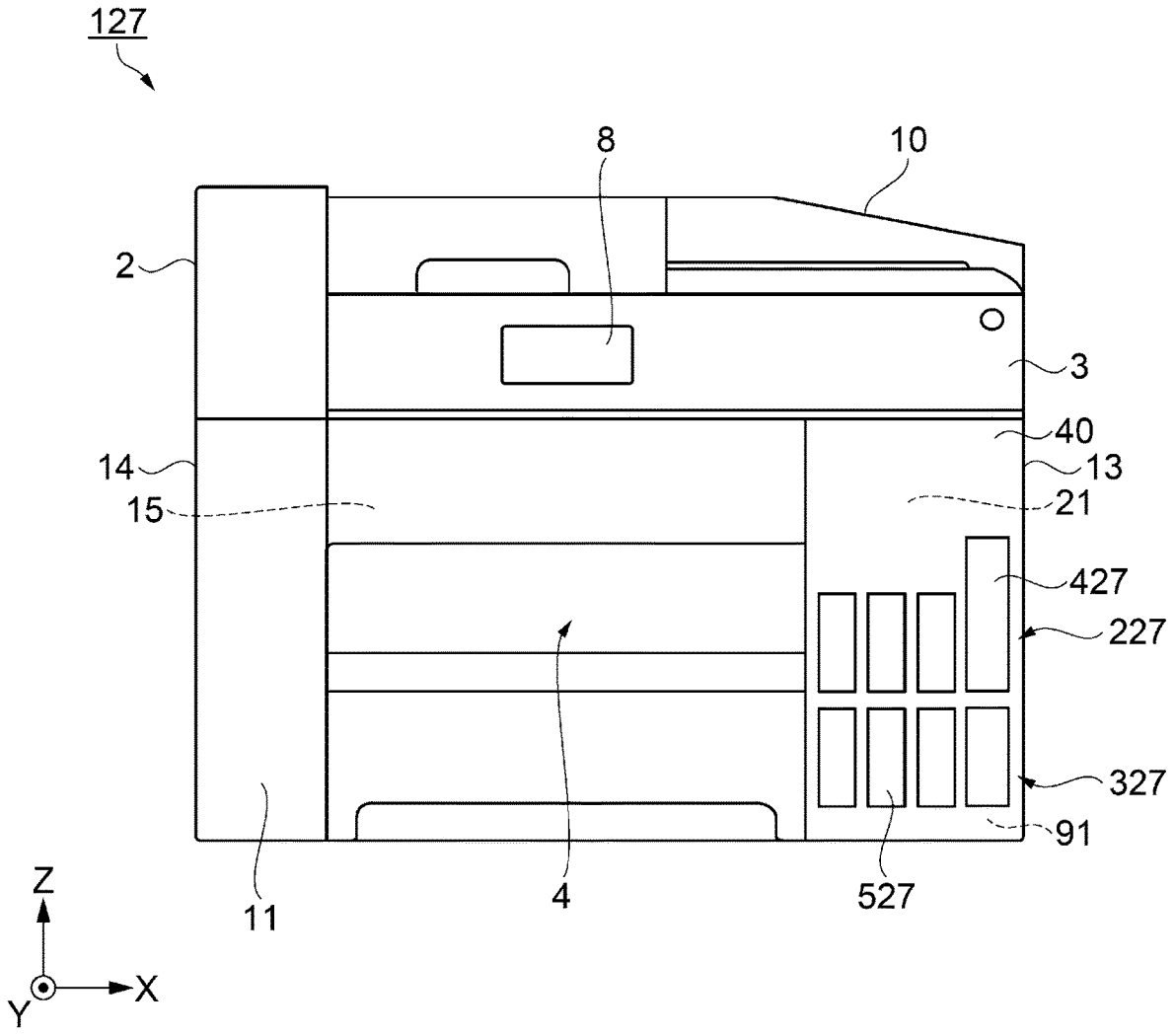
FIG. 27 is a front view showing an external appearance of a printer according to a twenty seventh embodiment.

FIG. 27 is a front view showing an external appearance of a printer according to a twenty seventh embodiment.

As shown in FIG. 27, the printer 127 has an opening/closing unit 40, and is provided with visual recognition units 227 and 327 capable of checking a remaining amount of ink in a tank 21 and a state of a waste liquid receiving unit 91. Light transmitting members 427 and 527 are provided in the visual recognition units 227 and 327. As shown in FIG. 27, each of the visual recognition units 227 and 327 has a plurality of opening ports (four in the present embodiment). Each opening port is formed in a rectangular shape. The plurality of opening ports of each of the visual recognition units 227 and 327 is arranged along an X axis. In addition, the sizes of some of the opening ports in the visual recognition unit 227 are different from the sizes of other opening ports. In addition, the opening ports in the visual recognition unit 327 are all the same size.

Figure 28:
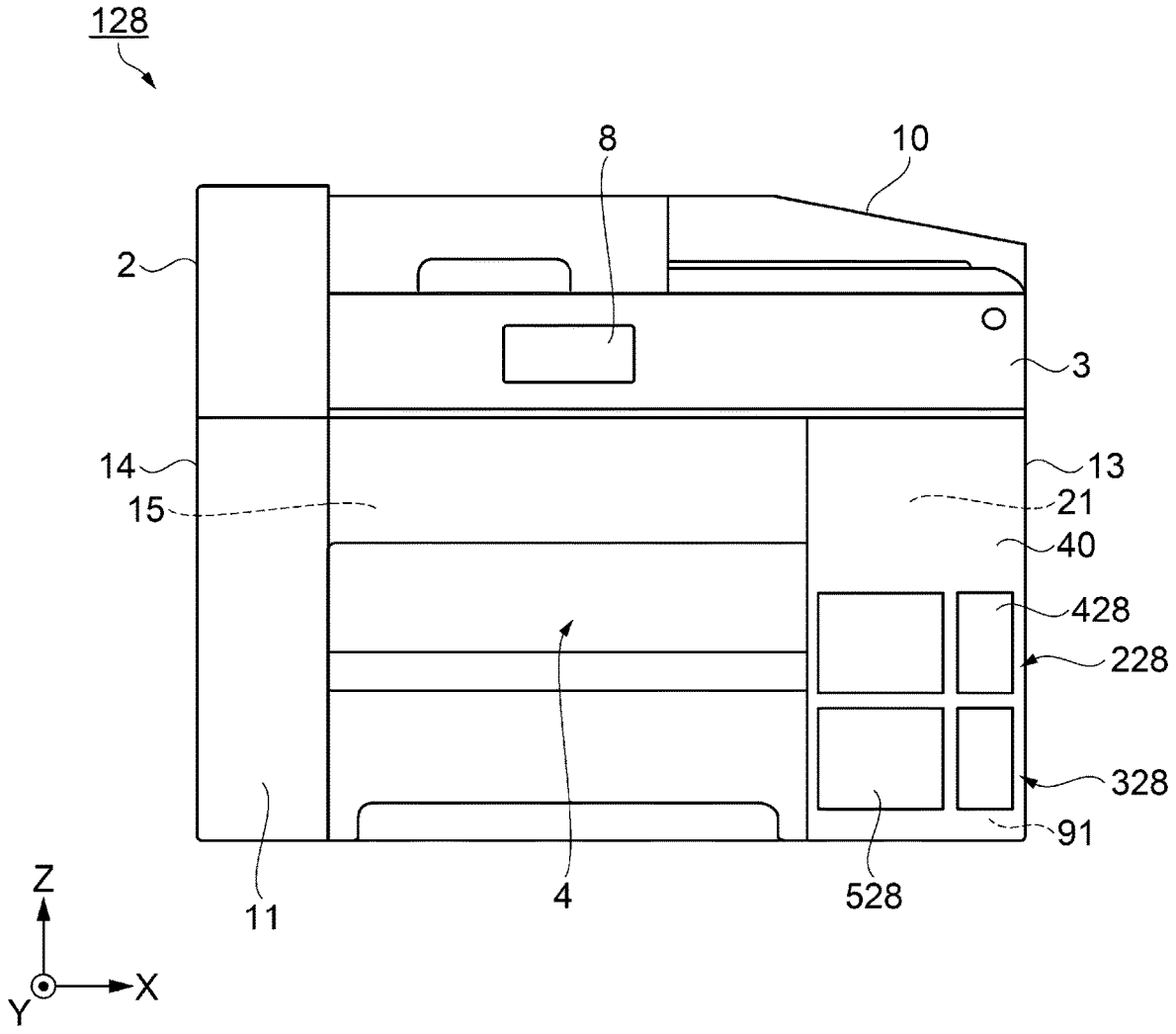
FIG. 28 is a front view showing an external appearance of a printer according to a twenty eighth embodiment.

FIG. 28 is a front view showing an external appearance of a printer according to a twenty eighth embodiment.

As shown in FIG. 28, the printer 128 has an opening/closing unit 40, and is provided with visual recognition units 228 and 328 capable of checking a remaining amount of ink in a tank 21 and a state of a waste liquid receiving unit 91. Light transmitting members 428 and 528 are provided in the visual recognition units 228 and 328. Each of the visual recognition units 228 and 328 has a plurality of opening ports (two in the present embodiment). Each opening port is formed in a rectangular shape. The plurality of opening ports of each of the visual recognition units 228 and 328 is arranged along an X axis. Further, the sizes of the opening ports in each of the visual recognition units 228 and 328 are different from each other.

Figure 29:
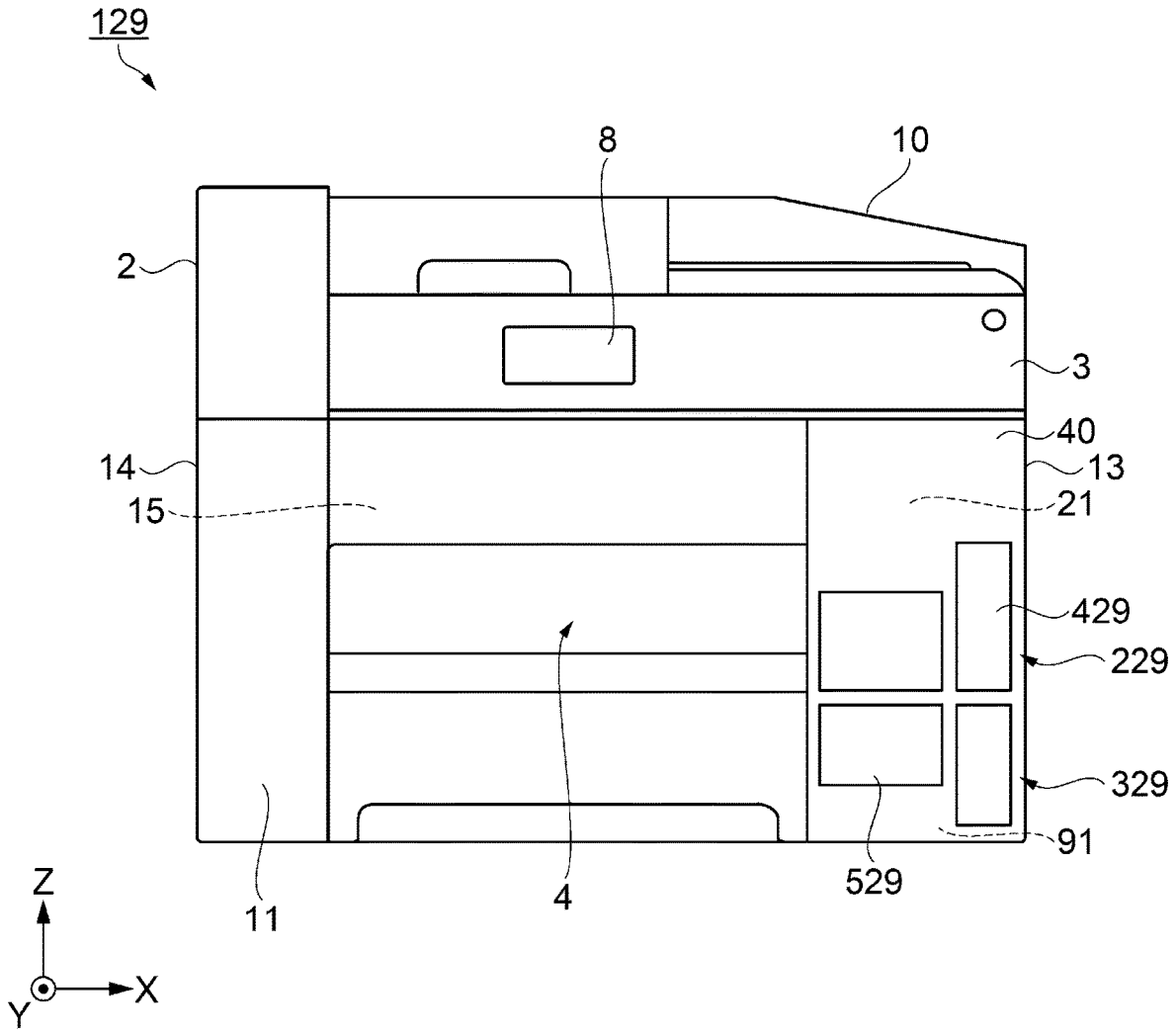
FIG. 29 is a front view showing an external appearance of a printer according to a twenty ninth embodiment.

FIG. 29 is a front view showing an external appearance of a printer according to a twenty ninth embodiment.

As shown in FIG. 29, the printer 129 has an opening/closing unit 40, and is provided with visual recognition units 229 and 329 capable of checking a remaining amount of ink in a tank 21 and a state of a waste liquid receiving unit 91. Light transmitting members 429 and 529 are provided in the visual recognition units 229 and 329. Each of the visual recognition units 229 and 329 has a plurality of opening ports (two in the present embodiment). Each opening port is formed in a rectangular shape. The plurality of opening ports of each of the visual recognition units 229 and 329 is arranged along an X axis. Further, the sizes of the opening ports in each of the visual recognition units 229 and 329 are different from each other.

Figure 30:
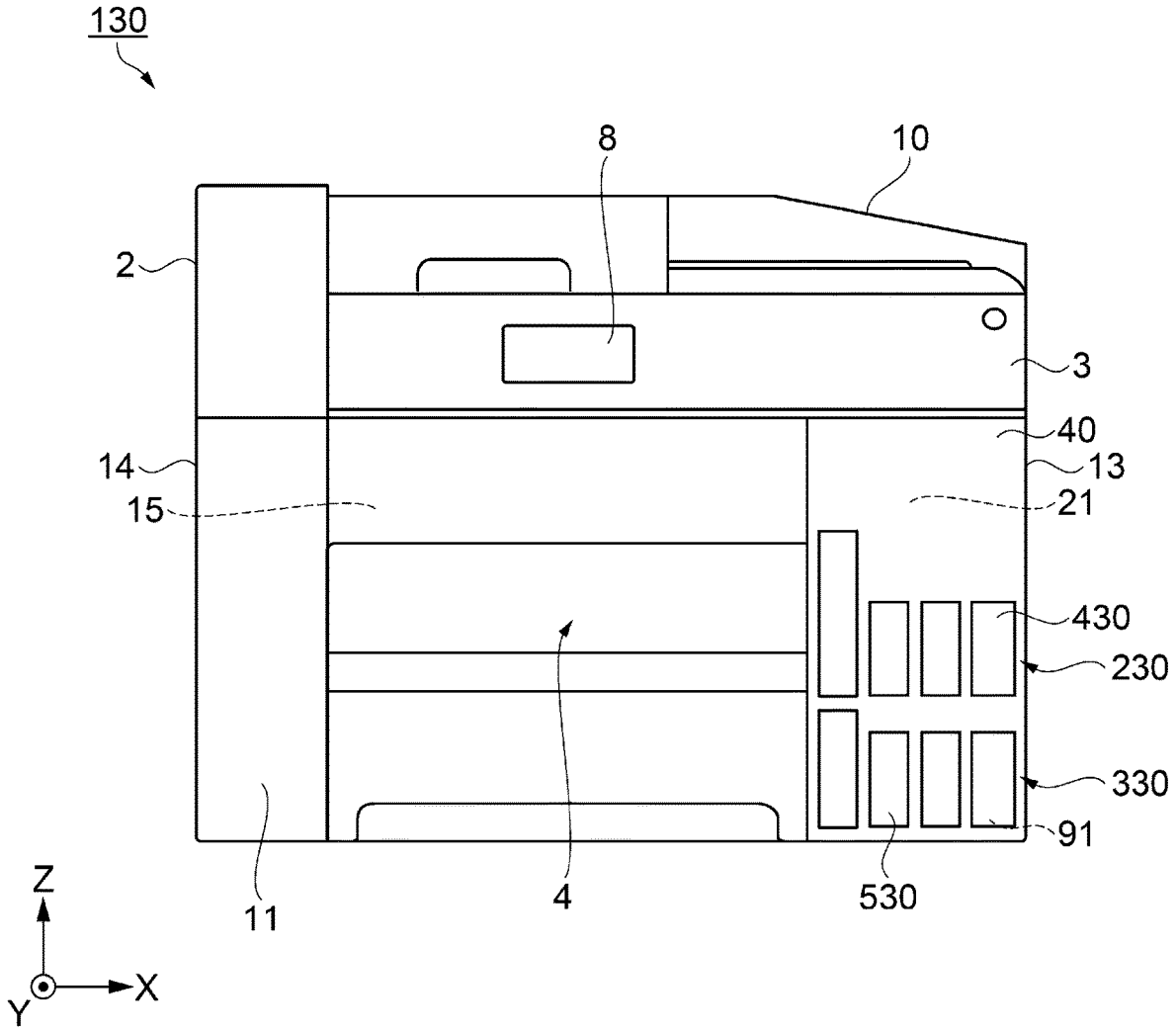
FIG. 30 is a front view showing an external appearance of a printer according to a thirtieth embodiment.

FIG. 30 is a front view showing an external appearance of a printer according to a thirtieth embodiment.

As shown in FIG. 30, the printer 130 has an opening/closing unit 40, and is provided with visual recognition units 230 and 330 capable of checking a remaining amount of ink in a tank 21 and a state of a waste liquid receiving unit 91. Light transmitting members 430 and 530 are provided in the visual recognition units 230 and 330. As shown in FIG. 30, each of the visual recognition units 230 and 330 has a plurality of opening ports (four in the present embodiment). Each opening port is formed in a rectangular shape. The plurality of opening ports of each of the visual recognition units 230 and 330 is arranged along an X axis. In addition, the sizes of some of the opening ports in each of the visual recognition units 230 and 330 are different from the sizes of other opening ports.

Figure 31:
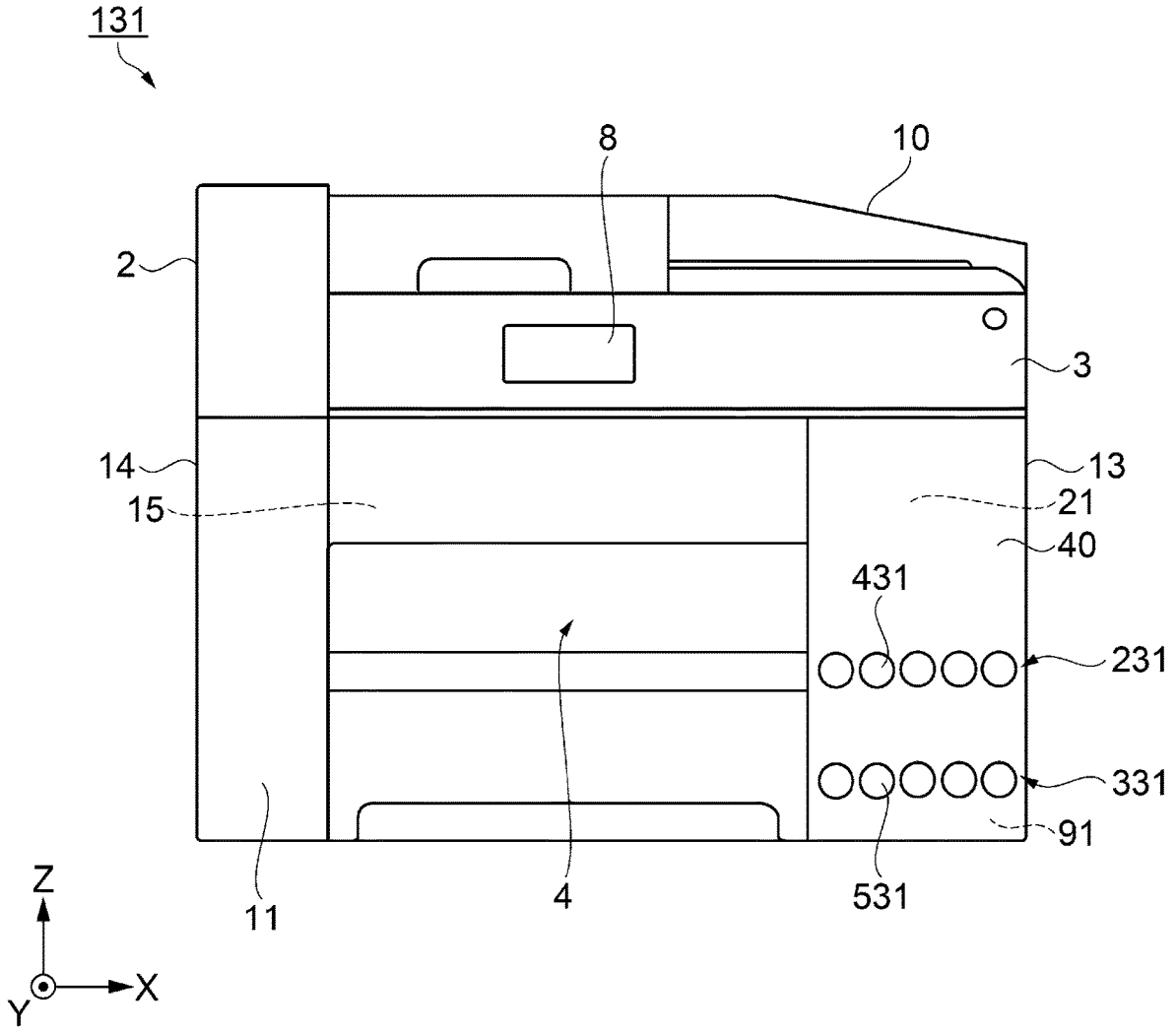
FIG. 31 is a front view showing an external appearance of a printer according to a thirty first embodiment.

FIG. 31 is a front view showing an external appearance of a printer according to a thirty first embodiment.

As shown in FIG. 31, the printer 131 has an opening/closing unit 40, and is provided with visual recognition units 231 and 331 capable of checking a remaining amount of ink in a tank 21 and a state of a waste liquid receiving unit 91. Light transmitting members 431 and 531 are provided in the visual recognition units 231 and 331. As shown in FIG. 31, each of the visual recognition units 231 and 331 has a plurality of opening ports (five in the present embodiment). Each opening port is formed in a circular shape. The plurality of opening ports of each of the visual recognition units 231 and 331 is arranged along an X axis. In addition, the opening ports in the visual recognition units 231 and 331 are all the same size.

Figure 32:
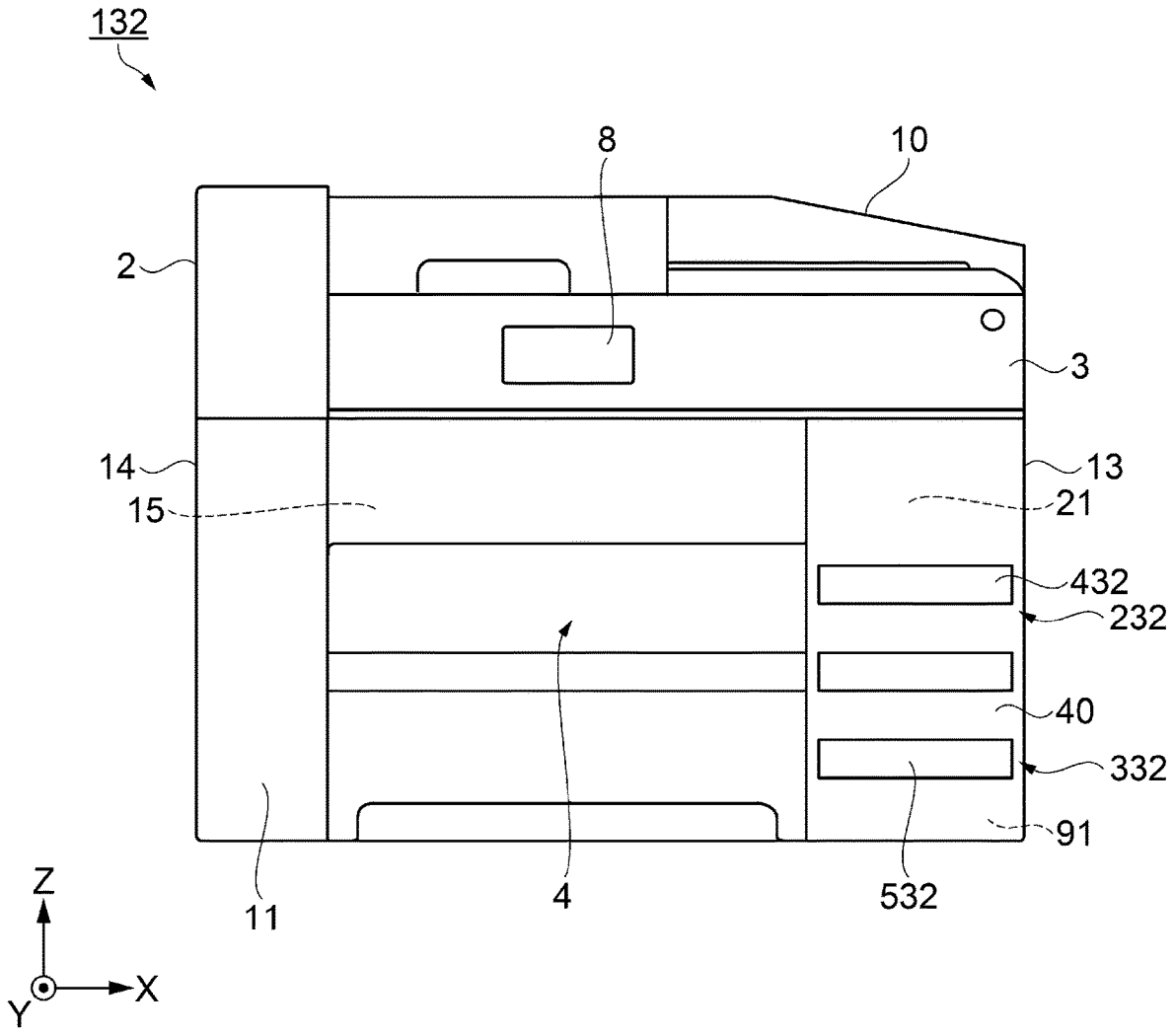
FIG. 32 is a front view showing an external appearance of a printer according to a thirty second embodiment.

FIG. 32 is a front view showing an external appearance of a printer according to a thirty second embodiment.

As shown in FIG. 32, the printer 132 has an opening/closing unit 40, and is provided with visual recognition units 232 and 332 capable of checking a remaining amount of ink in a tank 21 and a state of a waste liquid receiving unit 91. Light transmitting members 432 and 532 are provided in the visual recognition units 232 and 332. As shown in FIG. 32, the visual recognition units 232 and 332 have opening ports. Each opening port is formed in a rectangular shape. The plurality of opening ports of the visual recognition units 232 and 332 is arranged along a Z axis. In addition, the opening ports in the visual recognition units 232 and 332 are all the same size.

Figure 33:
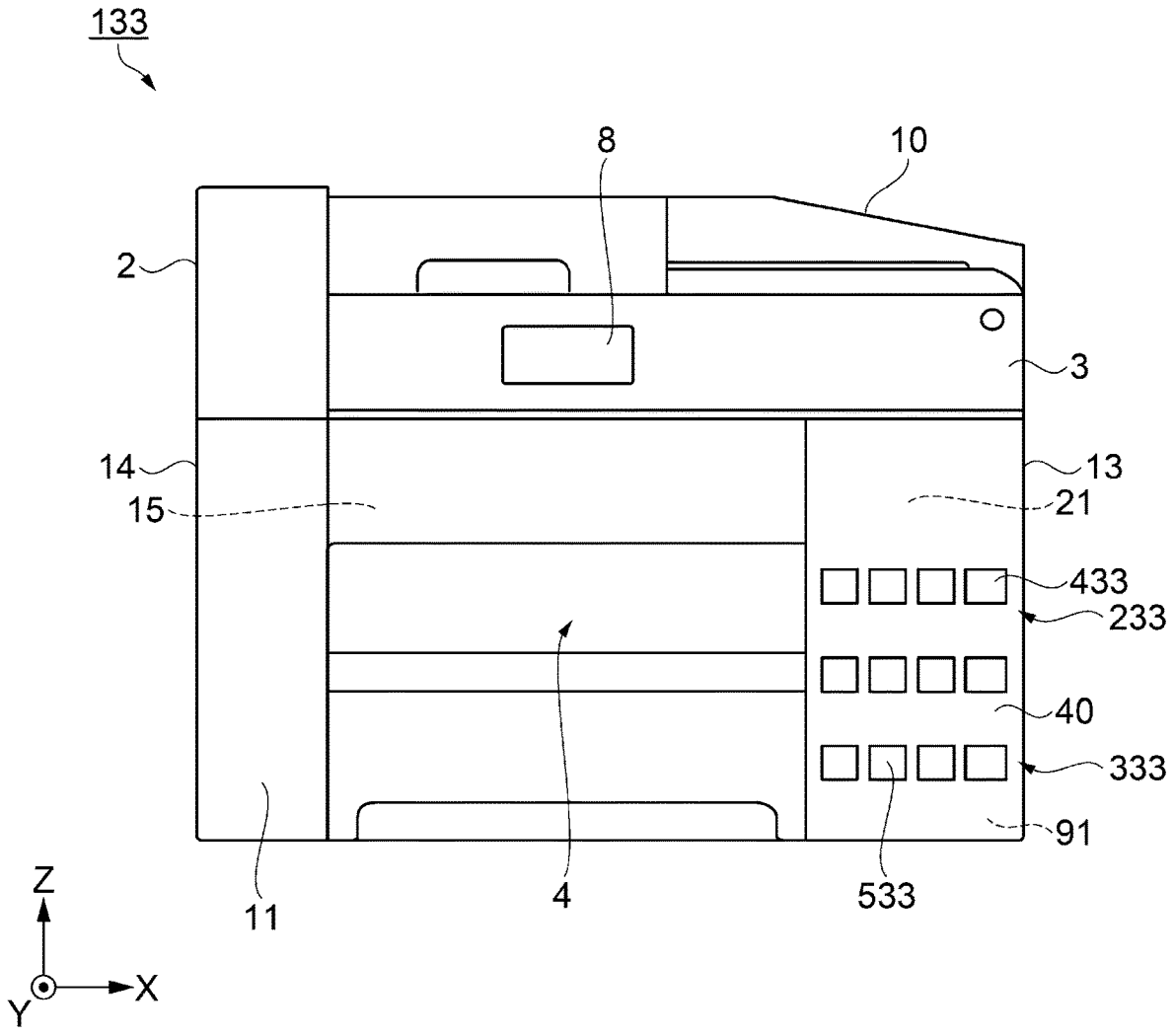
FIG. 33 is a front view showing an external appearance of a printer according to a thirty third embodiment.

FIG. 33 is a front view showing an external appearance of a printer according to a thirty third embodiment.

As shown in FIG. 33, the printer 133 has an opening/closing unit 40, and is provided with visual recognition units 233 and 333 capable of checking a remaining amount of ink in a tank 21 and a state of a waste liquid receiving unit 91. Light transmitting members 433 and 533 are provided in the visual recognition units 233 and 333. As shown in FIG. 33, each of the visual recognition units 233 and 333 has opening ports. Each opening port is formed in a rectangular shape.

In addition, the opening ports are all the same size. The plurality of opening ports of the visual recognition units 233 and 333 is arranged along an X axis and a Z axis.

Figure 34:
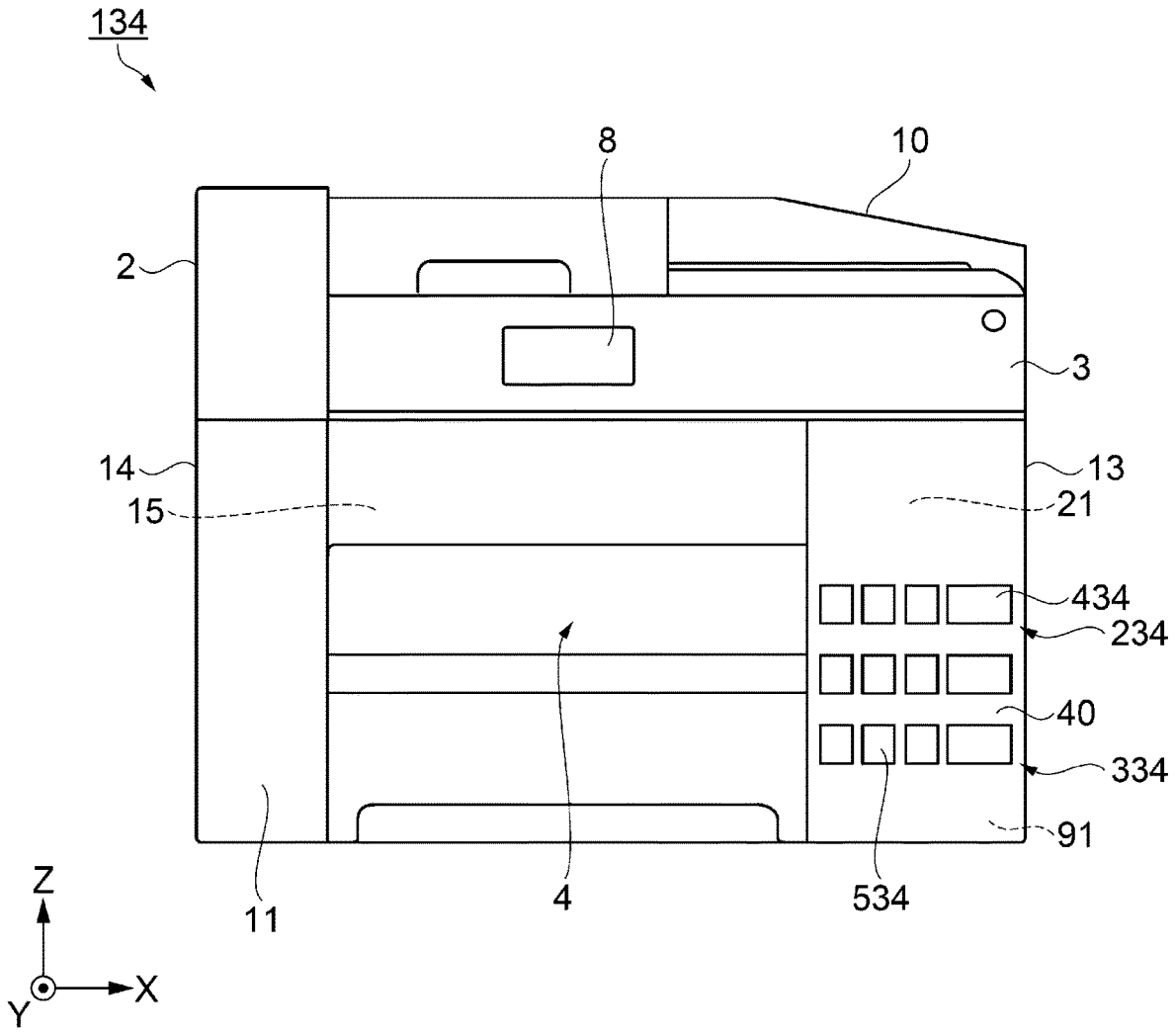
FIG. 34 is a front view showing an external appearance of a printer according to a thirty fourth embodiment.

FIG. 34 is a front view showing an external appearance of a printer according to a thirty fourth embodiment.

As shown in FIG. 34, the printer 134 has an opening/closing unit 40, and is provided with visual recognition units 234 and 334 capable of checking a remaining amount of ink in a tank 21 and a state of a waste liquid receiving unit 91. Light transmitting members 434 and 534 are provided in the visual recognition units 234 and 334. As shown in FIG. 34, each of the visual recognition units 234 and 334 has opening ports. Each opening port is formed in a rectangular shape.

The plurality of opening ports of each of the visual recognition units 234 and 334 is arranged along an X axis and a Z axis. In addition, the sizes of some of the opening ports in each of the visual recognition units 234 and 334 are different from the sizes of other opening ports.

Figure 35:
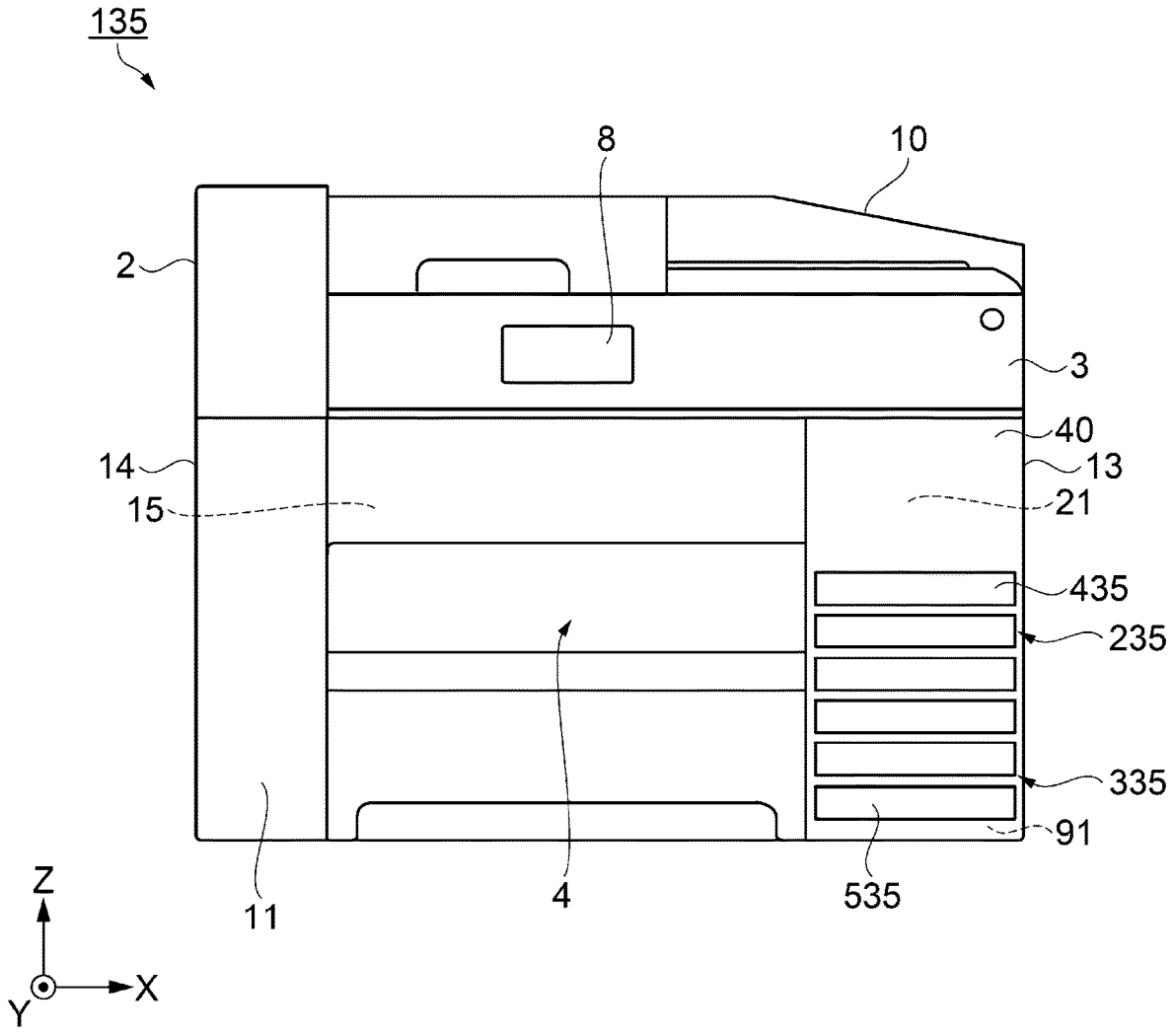
FIG. 35 is a front view showing an external appearance of a printer according to a thirty fifth embodiment.

FIG. 35 is a front view showing an external appearance of a printer according to a thirty fifth embodiment.

As shown in FIG. 35, the printer 135 has an opening/closing unit 40, and is provided with visual recognition units 235 and 335 capable of checking a remaining amount of ink in a tank 21 and a state of a waste liquid receiving unit 91. Light transmitting members 435 and 535 are provided in the visual recognition units 235 and 335. As shown in FIG. 35, the visual recognition units 235 and 335 have opening ports. Each opening port is formed in a rectangular shape. The plurality of opening ports of the visual recognition units 235 and 335 is arranged along a Z axis. In addition, the opening ports in the visual recognition units 235 and 335 are all the same size. Note that, in the present embodiment, since the plurality of opening ports of the visual recognition units 235 and 335 is arranged from the lower part to the upper part of the Z axis, it cannot be strictly discriminated between the visual recognition unit 235 and the visual recognition unit 335. Briefly, the visual recognition unit 235 is provided the upper part of the Z axis, and the visual recognition unit 335 is provided the lower part of the Z axis.

Figure 36:
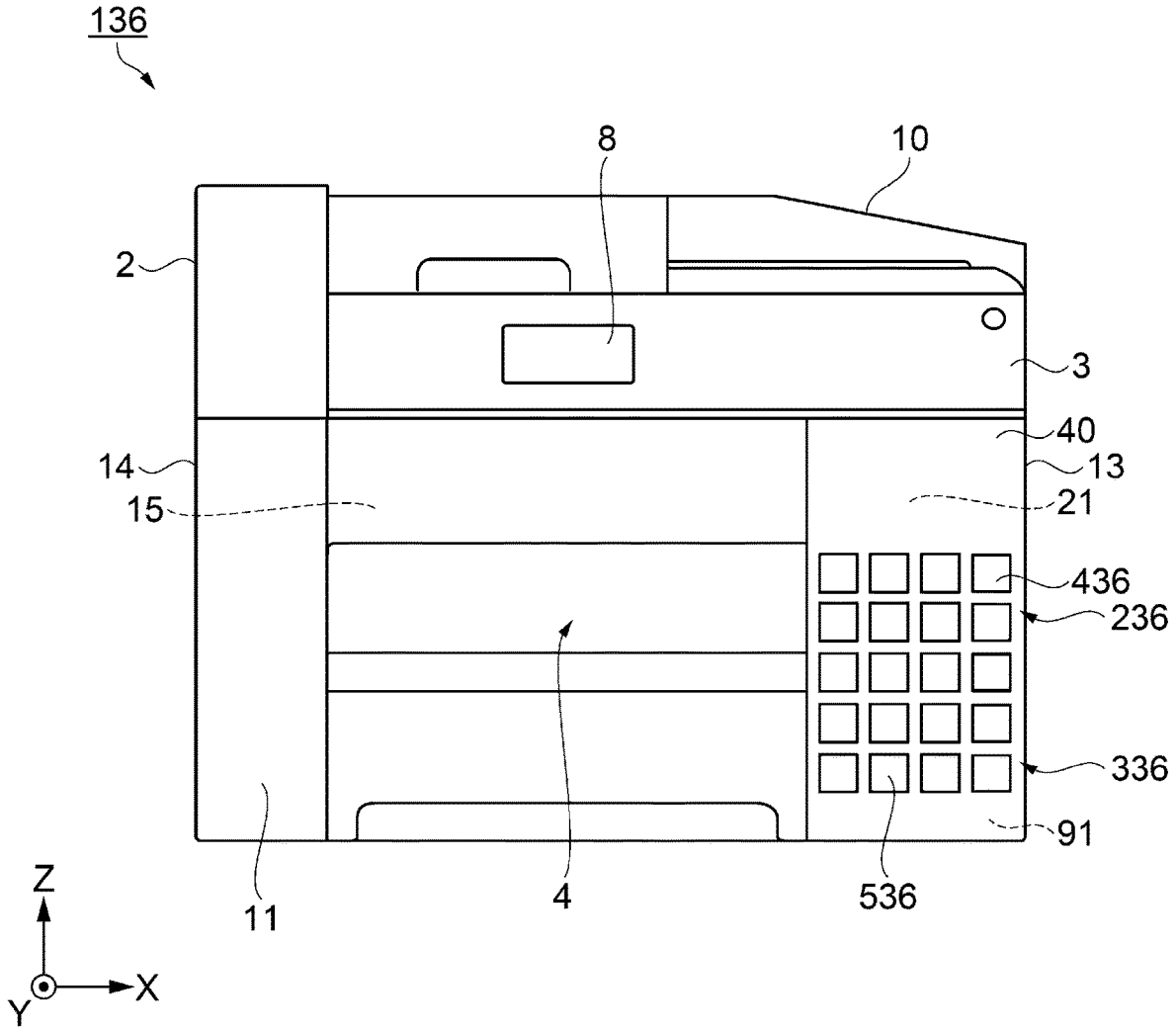
FIG. 36 is a front view showing an external appearance of a printer according to a thirty sixth embodiment.

FIG. 36 is a front view showing an external appearance of a printer according to a thirty sixth embodiment.

As shown in FIG. 36, the printer 136 has an opening/closing unit 40, and is provided with visual recognition units 236 and 336 capable of checking a remaining amount of ink in a tank 21 and a state of a waste liquid receiving unit 91. Light transmitting members 436 and 536 are provided in the visual recognition units 236 and 336. As shown in FIG. 36, each of the visual recognition units 236 and 336 has opening ports. Each opening port is formed in a rectangular shape. The plurality of opening ports of each of the visual recognition units 236 and 336 is arranged along an X axis and a Z axis. In addition, the opening ports in each of the visual recognition units 236 and 336 are all the same size. Note that, in the present embodiment, since the plurality of opening ports of each of the visual recognition units 236 and 336 is arranged from the lower part to the upper part of the Z axis, it cannot be strictly discriminated between the visual recognition unit 236 and the visual recognition unit 336. Briefly, the visual recognition unit 236 is provided the upper part of the Z axis, and the visual recognition unit 336 is provided the lower part of the Z axis.

Figure 37:
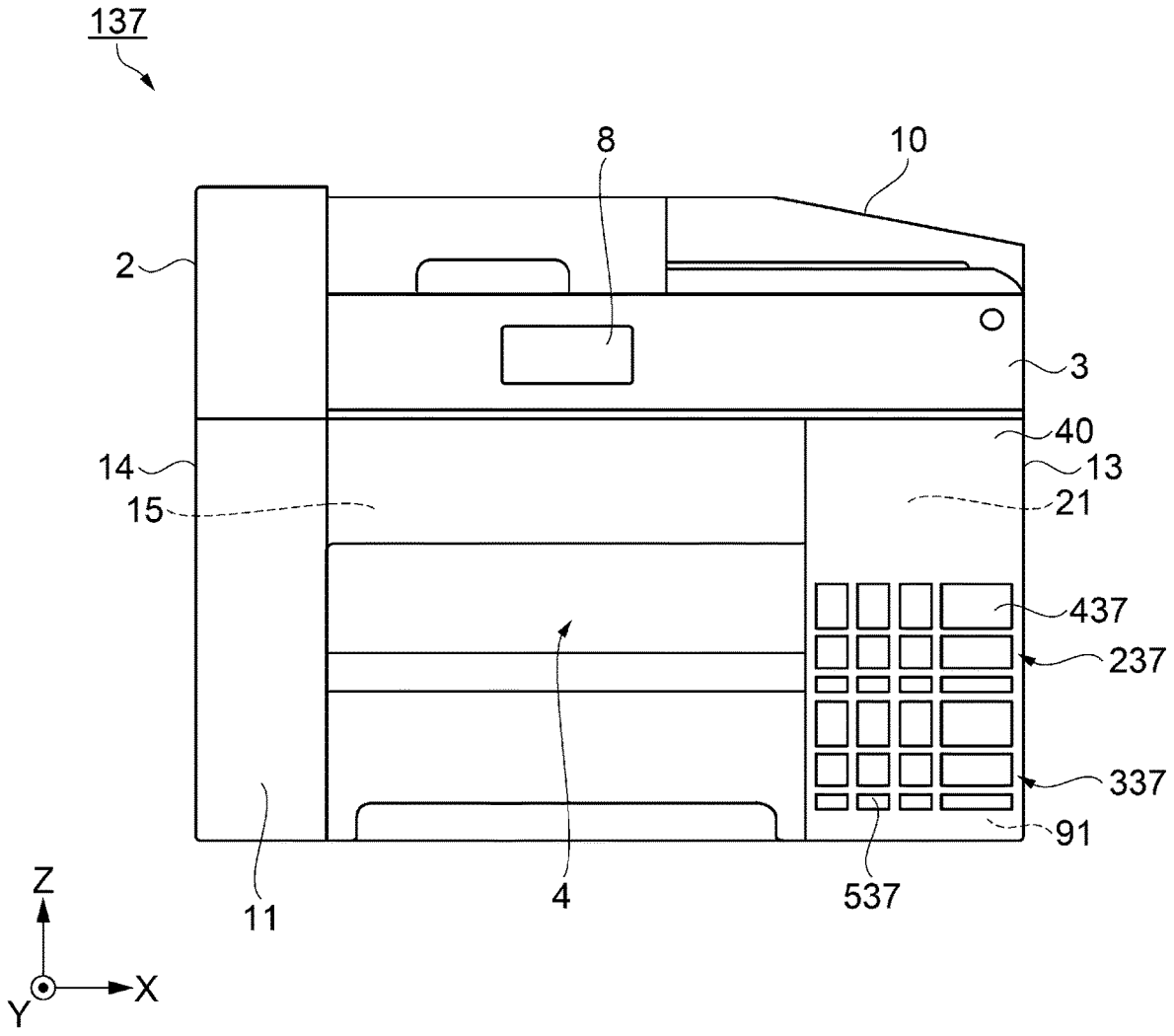
FIG. 37 is a front view showing an external appearance of a printer according to a thirty seventh embodiment.

FIG. 37 is a front view showing an external appearance of a printer according to a thirty seventh embodiment.

As shown in FIG. 37, the printer 137 has an opening/closing unit 40, and is provided with visual recognition units 237 and 337 capable of checking a remaining amount of ink in a tank 21 and a state of a waste liquid receiving unit 91. Light transmitting members 437 and 537 are provided in the visual recognition units 237 and 337. As shown in FIG. 37, each of the visual recognition units 237 and 337 has opening ports. Each opening port is formed in a rectangular shape. The plurality of opening ports of each of the visual recognition units 237 and 337 is arranged along an X axis and a Z axis. In addition, the sizes of some of the opening ports in each of the visual recognition units 234 and 334 are different from the sizes of other opening ports. Note that, in the present embodiment, since the plurality of opening ports of each of the visual recognition units 237 and 337 is arranged from the lower part to the upper part of the Z axis, it cannot be strictly discriminated between the visual recognition unit 237 and the visual recognition unit 337. Briefly, the visual recognition unit 237 is provided the upper part of the Z axis, and the visual recognition unit 337 is provided the lower part of the Z axis.

Figure 38:
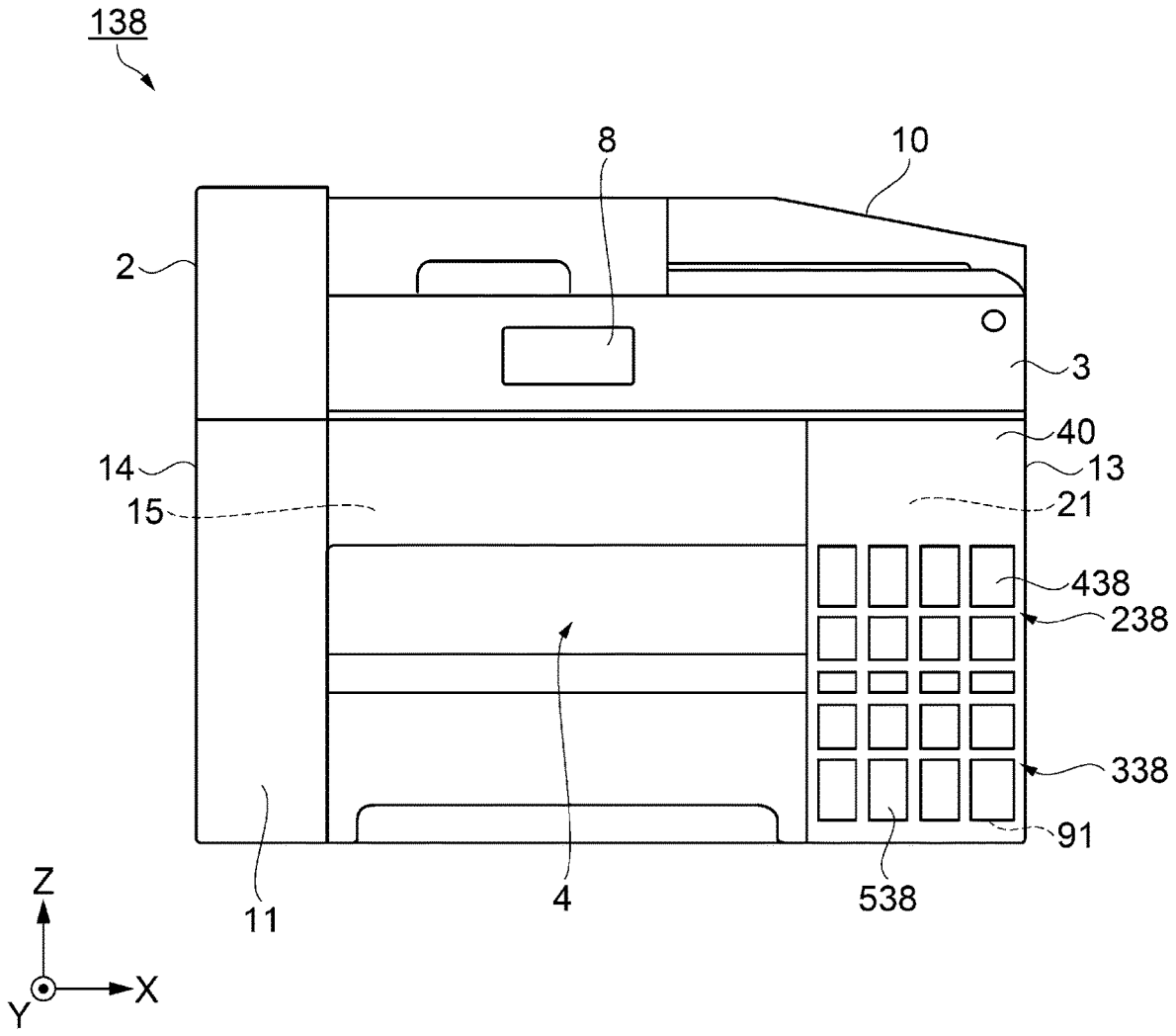
FIG. 38 is a front view showing an external appearance of a printer according to a thirty eighth embodiment.

FIG. 38 is a front view showing an external appearance of a printer according to a thirty eighth embodiment.

As shown in FIG. 38, the printer 138 has an opening/closing unit 40, and is provided with visual recognition units 238 and 338 capable of checking a remaining amount of ink in a tank 21 and a state of a waste liquid receiving unit 91. Light transmitting members 438 and 538 are provided in the visual recognition units 238 and 338. As shown in FIG. 38, each of the visual recognition units 238 and 338 has opening ports. Each opening port is formed in a rectangular shape. The plurality of opening ports of each of the visual recognition units 238 and 338 is arranged along an X axis and a Z axis. In addition, the sizes of some of the opening ports in each of the visual recognition units 238 and 338 are different from the sizes of other opening ports. Note that, in the present embodiment, since the plurality of opening ports of each of the visual recognition units 238 and 338 is arranged from the lower part to the upper part of the Z axis, it cannot be strictly discriminated between the visual recognition unit 238 and the visual recognition unit 338. Briefly, the visual recognition unit 238 is provided the upper part of the Z axis, and the visual recognition unit 338 is provided the lower part of the Z axis.

Figure 39:
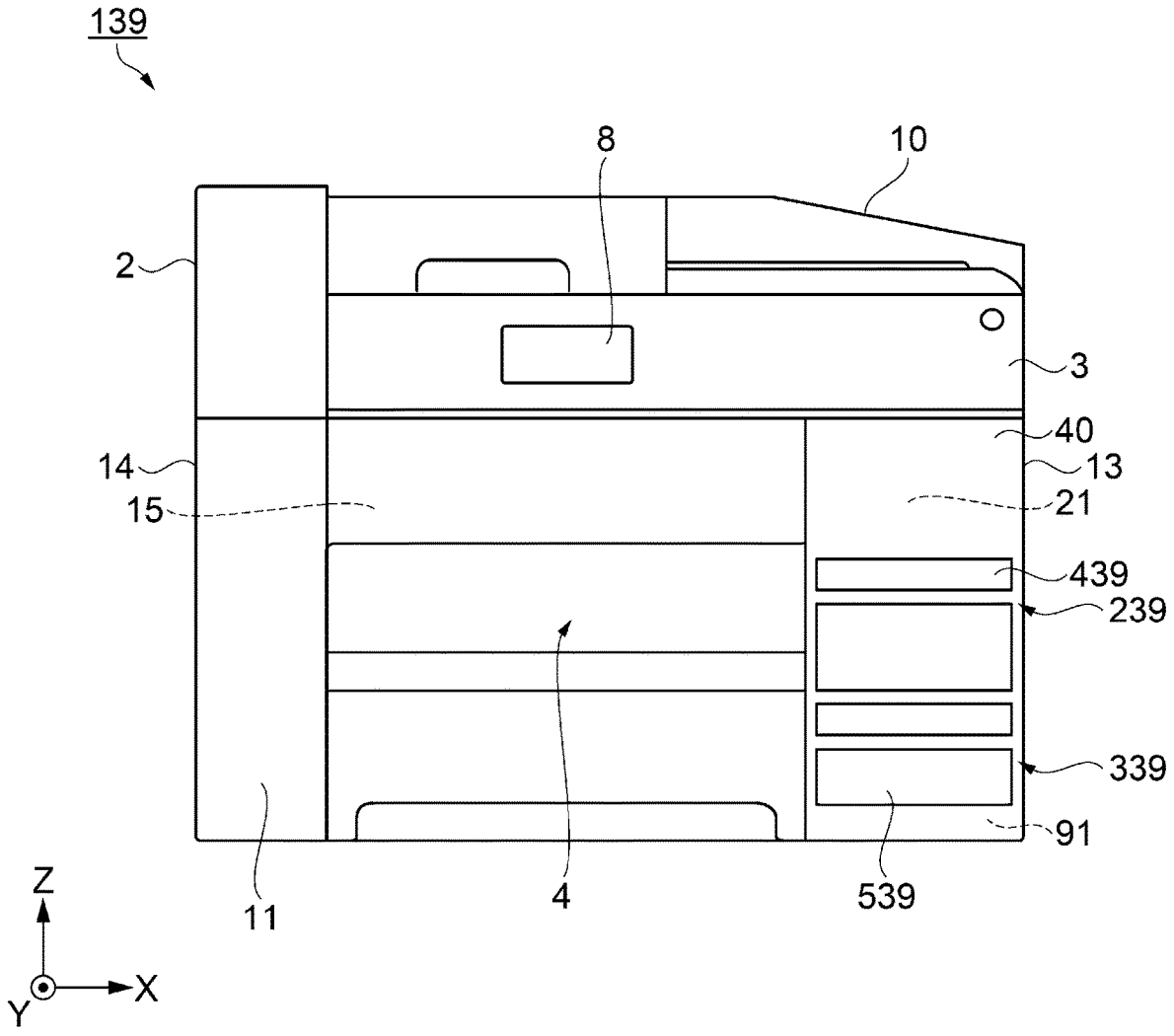
FIG. 39 is a front view showing an external appearance of a printer according to a thirty ninth embodiment.

FIG. 39 is a front view showing an external appearance of a printer according to a thirty ninth embodiment.

As shown in FIG. 39, the printer 139 has an opening/closing unit 40, and is provided with visual recognition units 239 and 339 capable of checking a remaining amount of ink in a tank 21 and a state of a waste liquid receiving unit 91. Light transmitting members 439 and 539 are provided in the visual recognition units 239 and 339. As shown in FIG. 39, the visual recognition units 239 and 339 have opening ports. Each opening port is formed in a rectangular shape. The plurality of opening ports of the visual recognition units 239 and 339 is arranged along a Z axis. In addition, the opening ports of each of the visual recognition units 239 and 339 are different sizes. Note that, in the present embodiment, since the plurality of opening ports of the visual recognition units 239 and 339 is arranged from the lower part to the upper part of the Z axis, it cannot be strictly discriminated between the visual recognition unit 239 and the visual recognition unit 339. Briefly, the visual recognition unit 239 is provided the upper part of the Z axis, and the visual recognition unit 339 is provided the lower part of the Z axis.

Figure 40A:
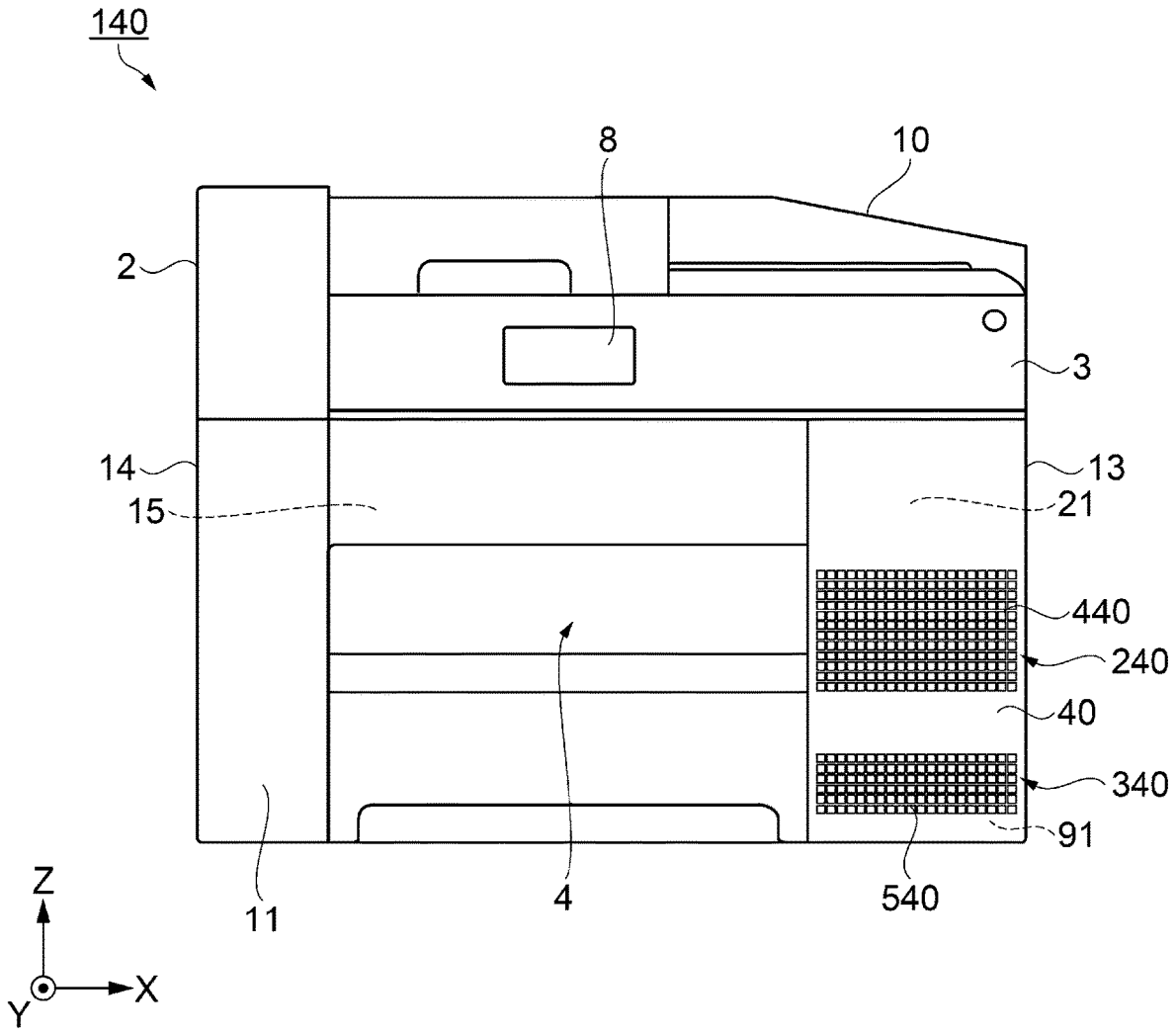
FIG. 40A is a front view showing an external appearance of a printer according to a fortieth embodiment.
Figure 40B:
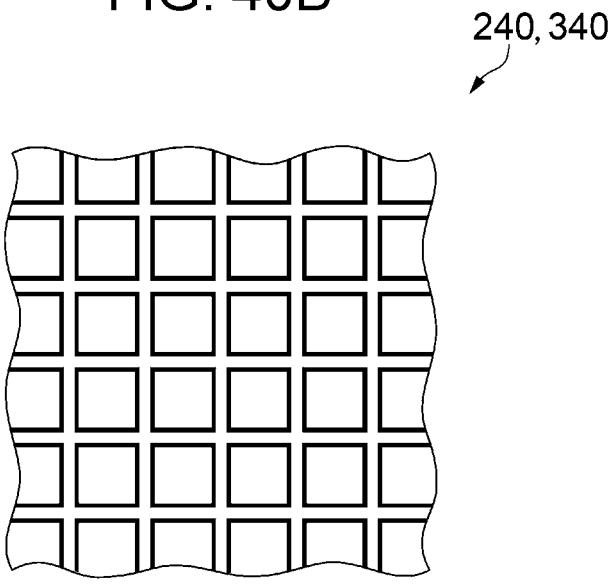
FIG. 40B is an enlarged view showing a part of the external appearance of the printer according to the fortieth embodiment.
Figure 40C:
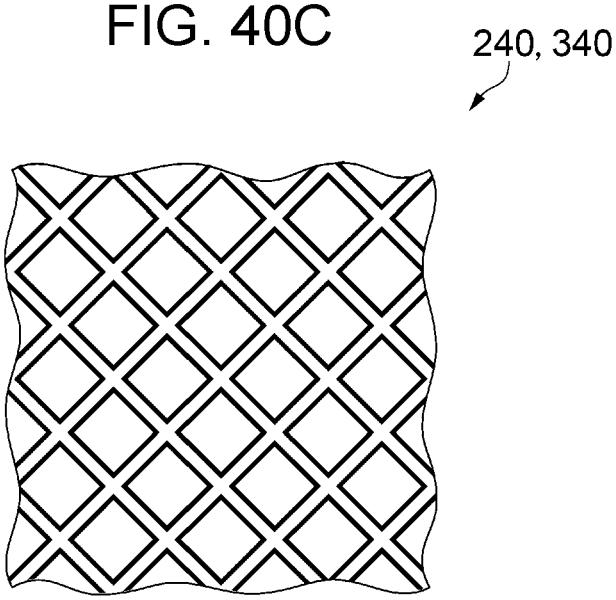
FIG. 40C is an enlarged view showing a part of the external appearance of the printer according to the fortieth embodiment.

FIG. 40A is a front view showing an external appearance of a printer according to a fortieth embodiment. FIGS. 40B and 40C are enlarged views showing a part of the external appearance of the printer according to the fortieth embodiment.

As shown in FIG. 40A, the printer 140 has an opening/closing unit 40, and is provided with visual recognition units 240 and 340 capable of checking a remaining amount of ink in a tank 21 and a state of a waste liquid receiving unit 91. Light transmitting members 440 and 540 are provided in the visual recognition units 240 and 340.

As shown in FIGS. 40B and 40C, each of the visual recognition units 240 and 340 has opening ports. The sizes of each of the opening ports are relatively small and each opening port is formed in a rectangular shape. The plurality of opening ports is arranged along an X axis direction and a Z axis direction. The shape of the opening ports in each of the visual recognition units 240 and 340 may be a diamond shape or the like.

Figure 41A:
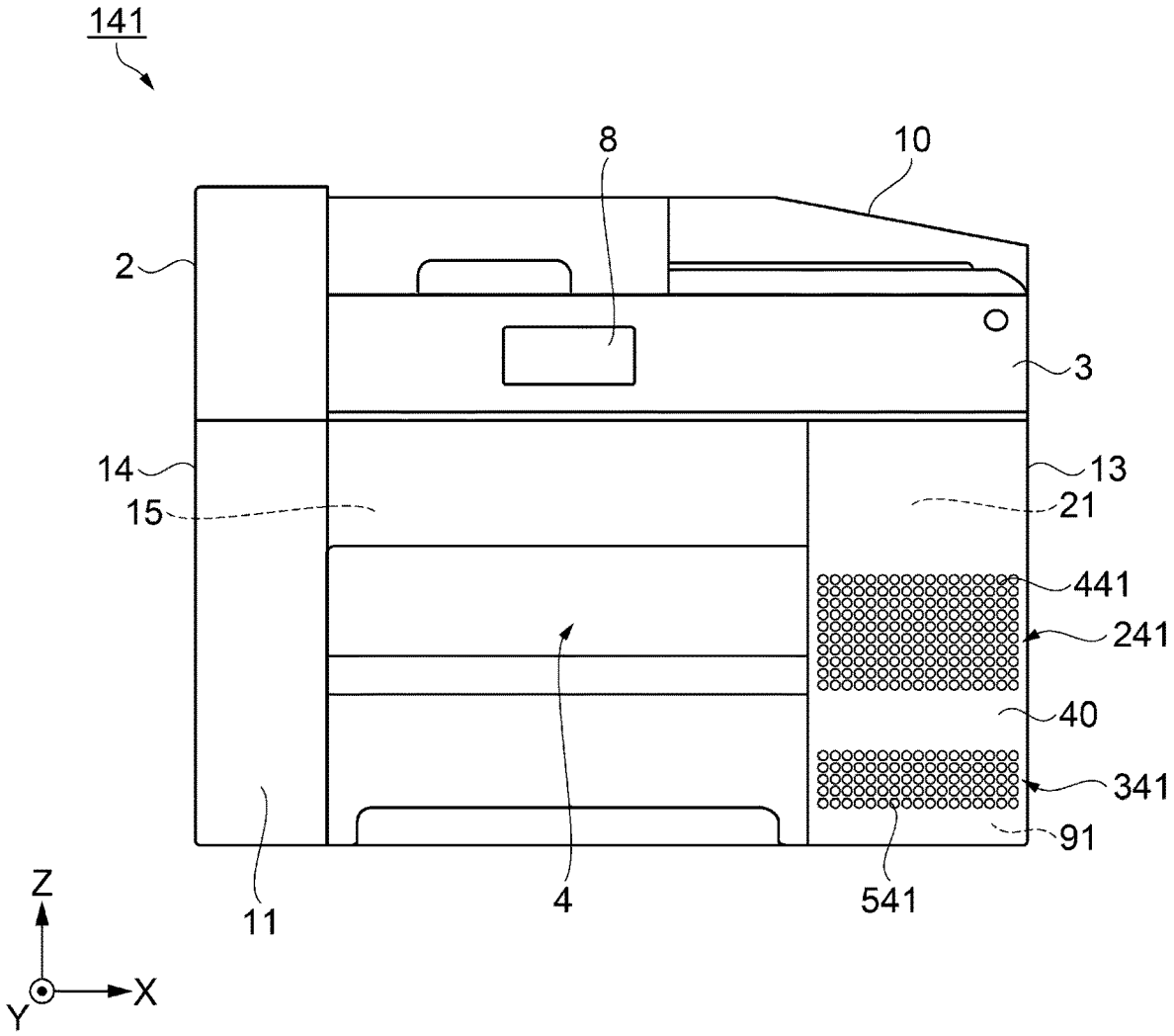
FIG. 41A is a front view showing an external appearance of a printer according to a forty first embodiment.
Figure 41B:
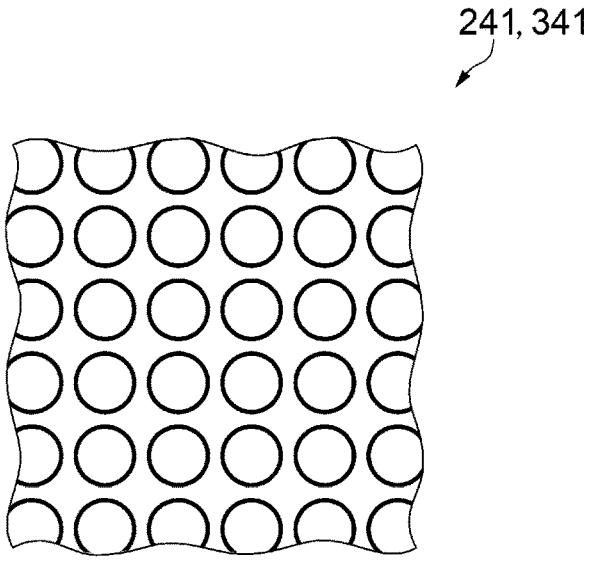
FIG. 41B is an enlarged view showing a part of the external appearance of the printer according to the forty first embodiment.

FIG. 41A is a front view showing an external appearance of the printer according to the forty first embodiment. FIG. 41B is an enlarged view showing a partial external appearance of the printer according to the forty first embodiment.

As shown in FIG. 41A, the printer 141 has an opening/closing unit 40, and is provided with visual recognition units 241 and 341 capable of checking a remaining amount of ink in a tank 21 and a state of a waste liquid receiving unit 91. Light transmitting members 441 and 541 are provided in the visual recognition units 241 and 341.

As shown in FIG. 41B, each of the visual recognition units 241 and 341 has opening ports. The sizes of each of the opening ports are relatively small and each opening port is formed in a circular shape. The plurality of opening ports is arranged along an X axis direction and a Z axis direction. The shape of the opening ports in each of the visual recognition units 241 and 341 may be an elliptic shape or the like.

In the above-described embodiment, the visual recognition unit is provided on the front 11 side (opening/closing unit 40), however, the invention is not limited thereto. For example, the visual recognition unit may be provided on the side wall 13 side.

Figure 42:
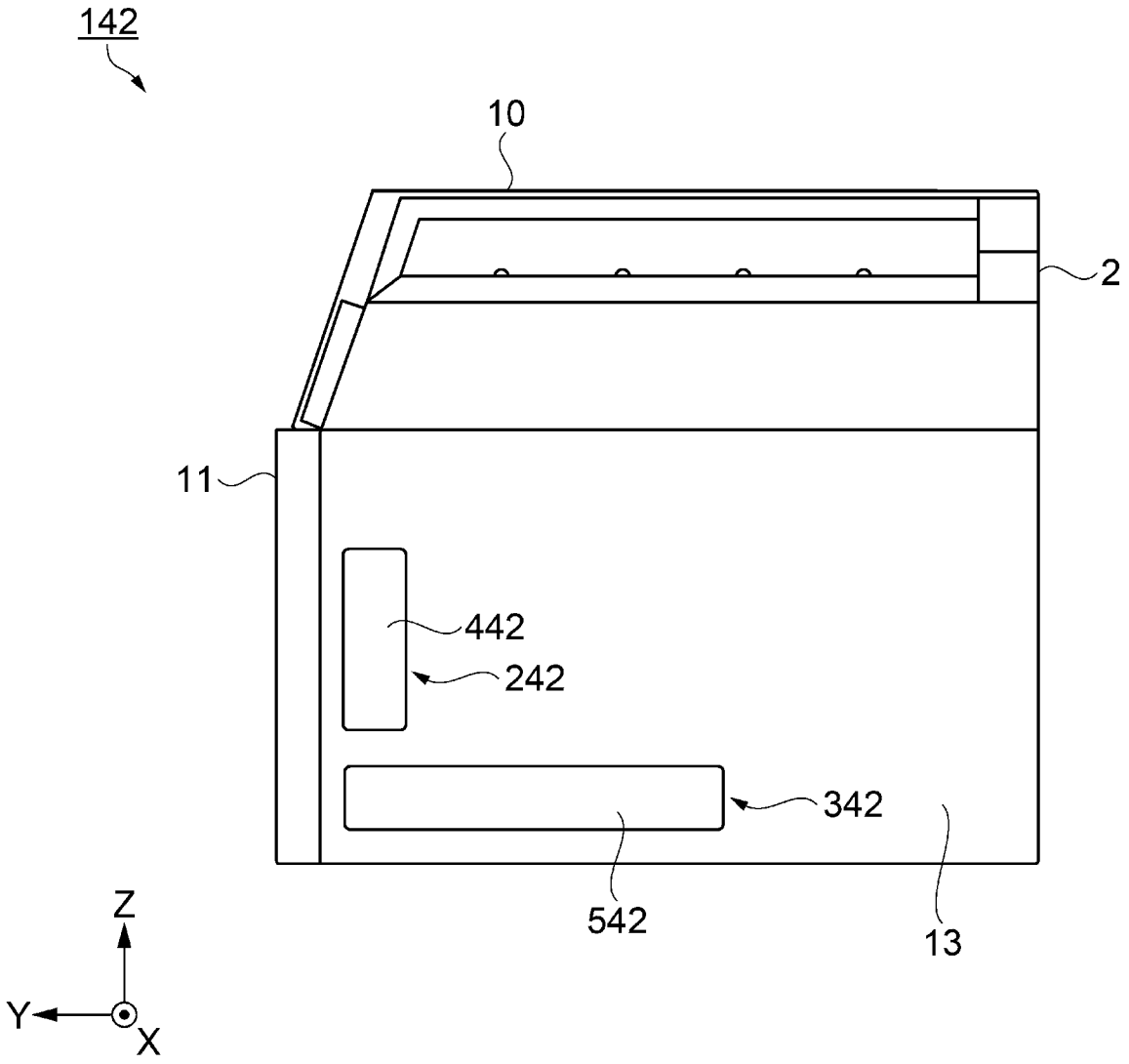
FIG. 42 is a side view showing an external appearance of a printer according to a forty second embodiment.

FIG. 42 is a side view showing an external appearance of a printer according to a forty second embodiment.

As shown in FIG. 42, on a side wall 13 of the printer 142, visual recognition units 242 and 342 capable of checking a remaining amount of ink in a tank 21 and a state of a waste liquid receiving unit 91 are provided. Light transmitting members 442 and 542 are provided in each of the visual recognition units 242 and 342. As shown in FIG. 42, the opening ports of each of the visual recognition units 242 and 342 are formed in rectangular shape. In addition, the size of the opening port of the visual recognition unit 242 is different from the size of the opening port of the visual recognition unit 342.

Figure 43:
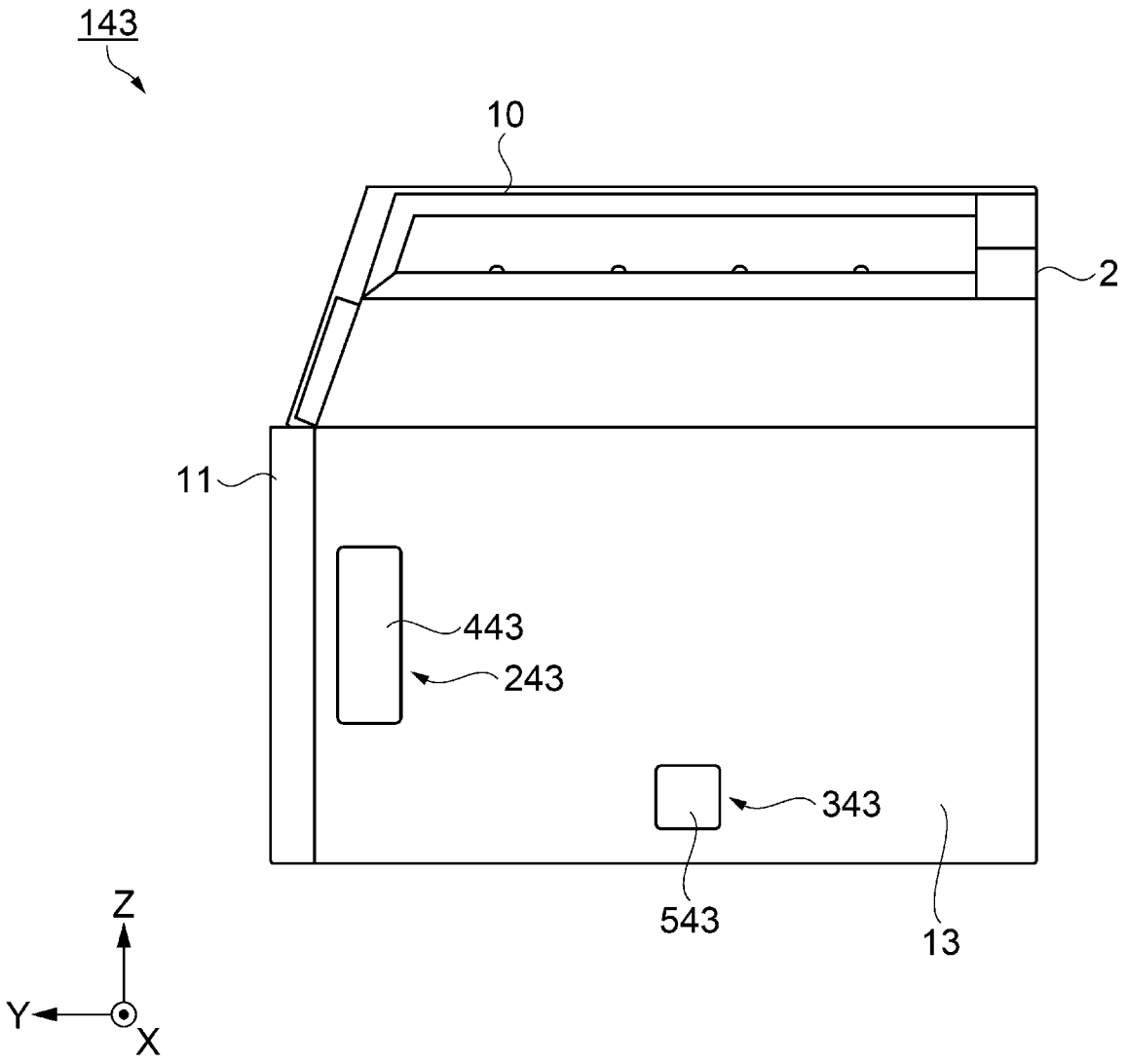
FIG. 43 is a side view showing an external appearance of a printer according to a forty third embodiment.

FIG. 43 is a side view showing an external appearance of a printer according to a forty third embodiment.

As shown in FIG. 43, on a side wall 13 of the printer 143, visual recognition units 243 and 343 capable of checking a remaining amount of ink in a tank 21 and a state of a waste liquid receiving unit 91 are provided. Light transmitting members 443 and 543 are provided in each of the visual recognition units 243 and 343. As shown in FIG. 43, the opening ports of each of the visual recognition units 243 and 343 are formed in rectangular shape. In addition, the size of the opening port of the visual recognition unit 243 is different from the size of the opening port of the visual recognition unit 343.

Figure 44:
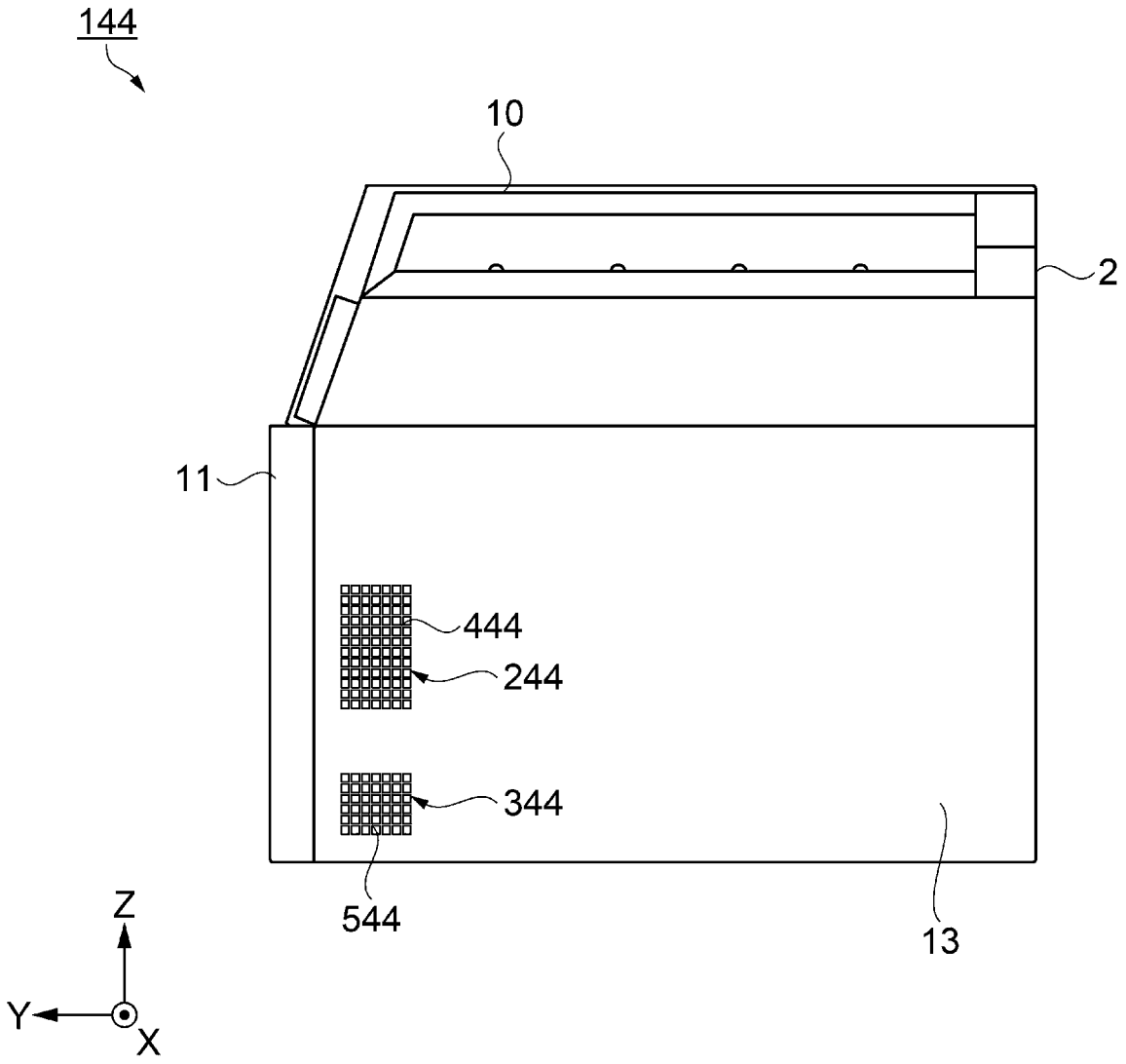
FIG. 44 is a side view showing an external appearance of a printer according to a forty fourth embodiment.

FIG. 44 is a side view showing an external appearance of a printer according to a forty fourth embodiment.

As shown in FIG. 44, on a side wall 13 of the printer 144, visual recognition units 244 and 344 capable of checking a remaining amount of ink in a tank 21 and a state of a waste liquid receiving unit 91 are provided. Light transmitting members 444 and 544 are provided in each of the visual recognition units 244 and 344. Each of the visual recognition units 244 and 344 has a plurality of opening ports. The sizes of each of the opening ports are relatively small and each opening port is formed in a rectangular shape.

The plurality of opening ports is arranged along a Y axis direction and a Z axis direction. The shape of the opening ports in each of the visual recognition units 244 and 344 may be a diamond shape or the like.

Figure 45:
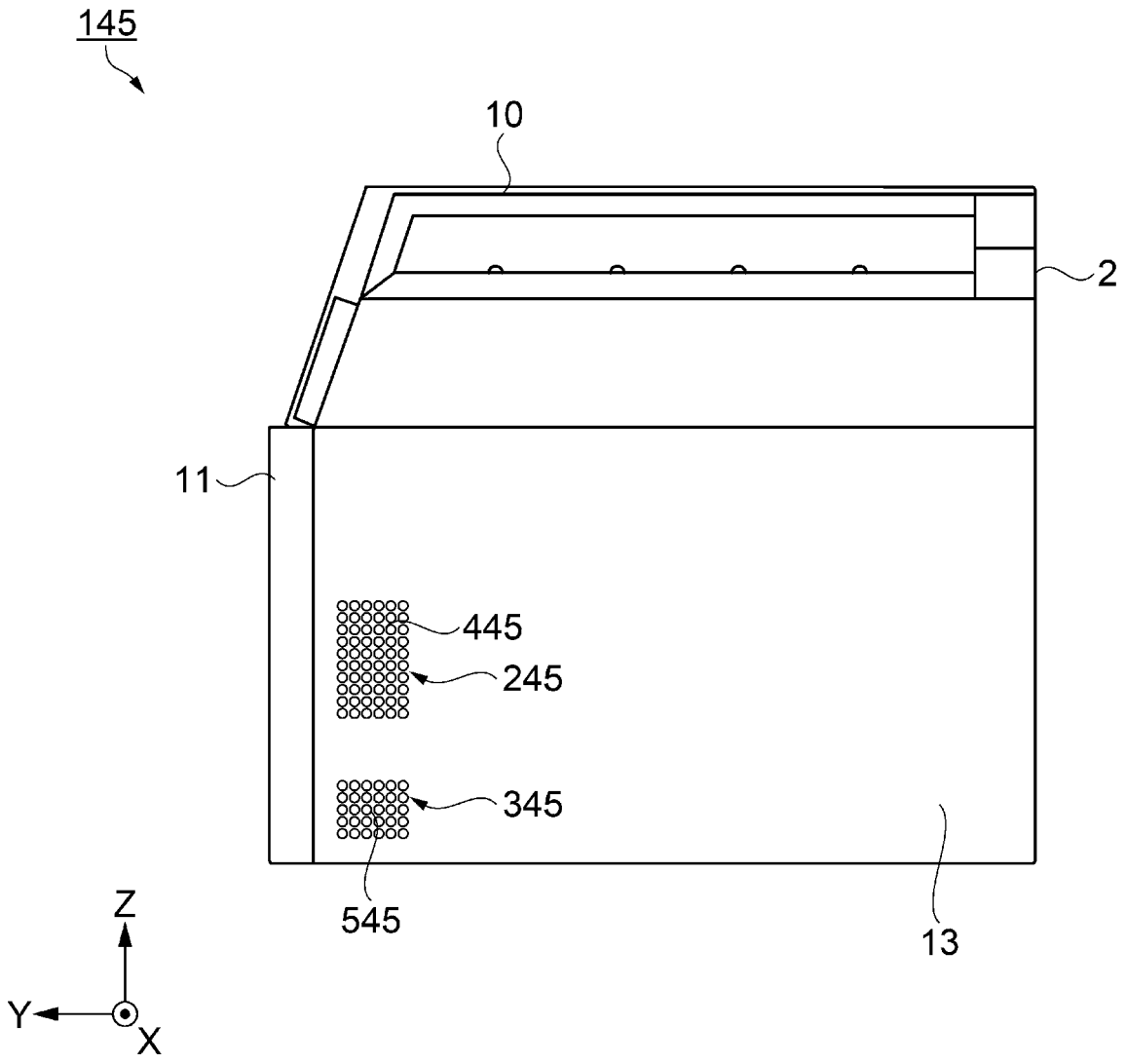
FIG. 45 is a side view showing an external appearance of a printer according to a forty fifth embodiment.

FIG. 45 is a side view showing an external appearance of a printer according to a forty fifth embodiment.

As shown in FIG. 45, on a side wall 13 of the printer 145, visual recognition units 245 and 345 capable of checking a remaining amount of ink in a tank 21 and a state of a waste liquid receiving unit 91 are provided. Light transmitting members 445 and 545 are provided in each of the visual recognition units 245 and 345. Each of the visual recognition units 245 and 345 has a plurality of opening ports. The sizes of each of the opening ports are relatively small and each opening port is formed in a circular shape.

The plurality of opening ports is arranged along a Y axis direction and a Z axis direction. The shape of the opening ports in each of the visual recognition units 245 and 345 may be an elliptic shape or the like.

Figure 46:
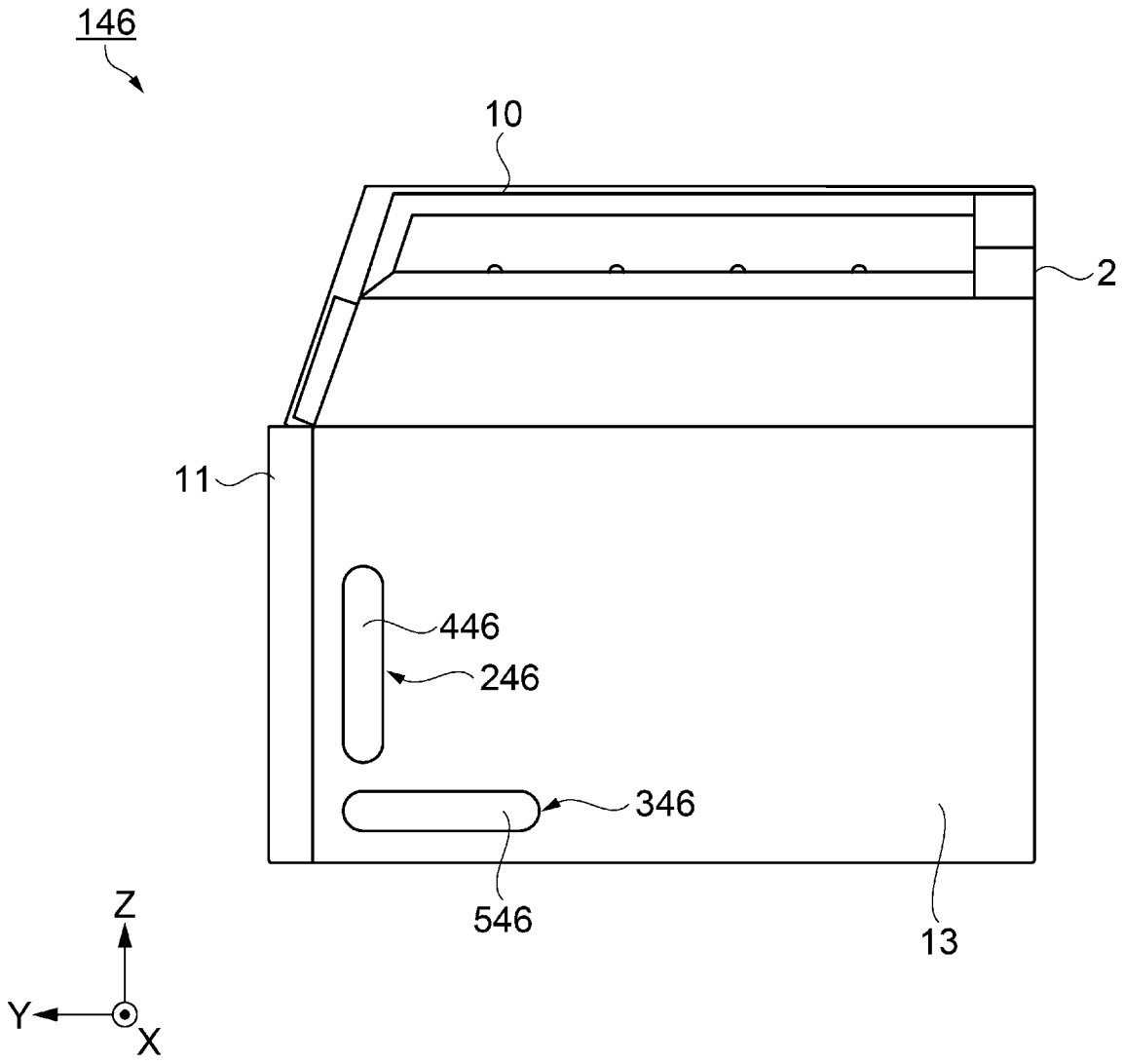
FIG. 46 is a side view showing an external appearance of a printer according to a forty sixth embodiment.

FIG. 46 is a side view showing an external appearance of a printer according to a forty sixth embodiment.

As shown in FIG. 46, on a side wall 13 of the printer 146, visual recognition units 246 and 346 capable of checking a remaining amount of ink in a tank 21 and a state of a waste liquid receiving unit 91 are provided. Light transmitting members 446 and 546 are provided in each of the visual recognition units 246 and 346. As shown in FIG. 46, some parts of the visual recognition units 246 and 346 have a curved portion.

Figure 47:
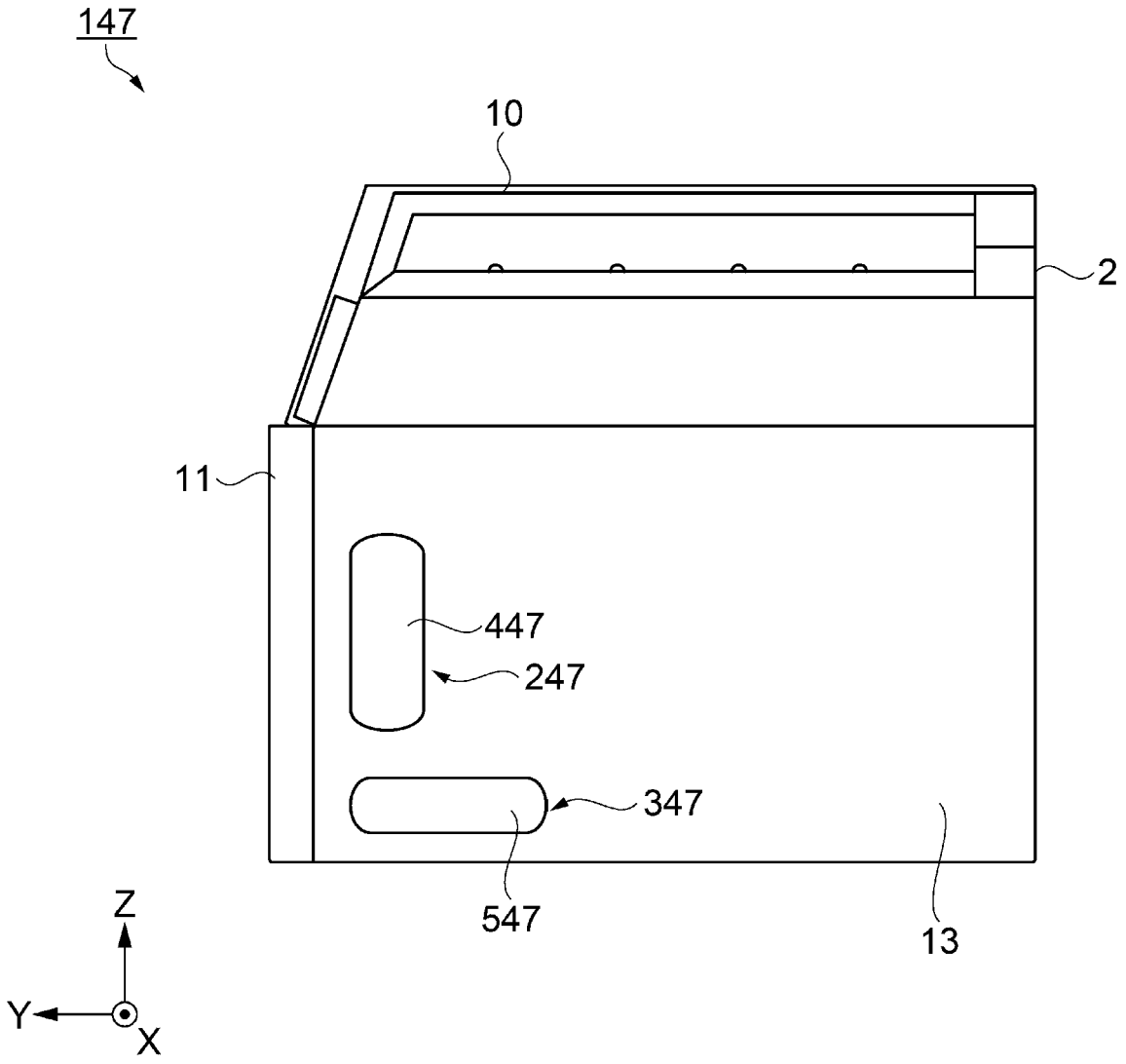
FIG. 47 is a side view showing an external appearance of a printer according to a forty seventh embodiment.

FIG. 47 is a side view showing an external appearance of a printer according to a forty seventh embodiment.

As shown in FIG. 47, on a side wall 13 of the printer 147, visual recognition units 247 and 347 capable of checking a remaining amount of ink in a tank 21 and a state of a waste liquid receiving unit 91 are provided. Light transmitting members 447 and 547 are provided in each of the visual recognition units 247 and 347. As shown in FIG. 47, some parts of the visual recognition units 247 and 347 have a curved portion.

Figure 48:
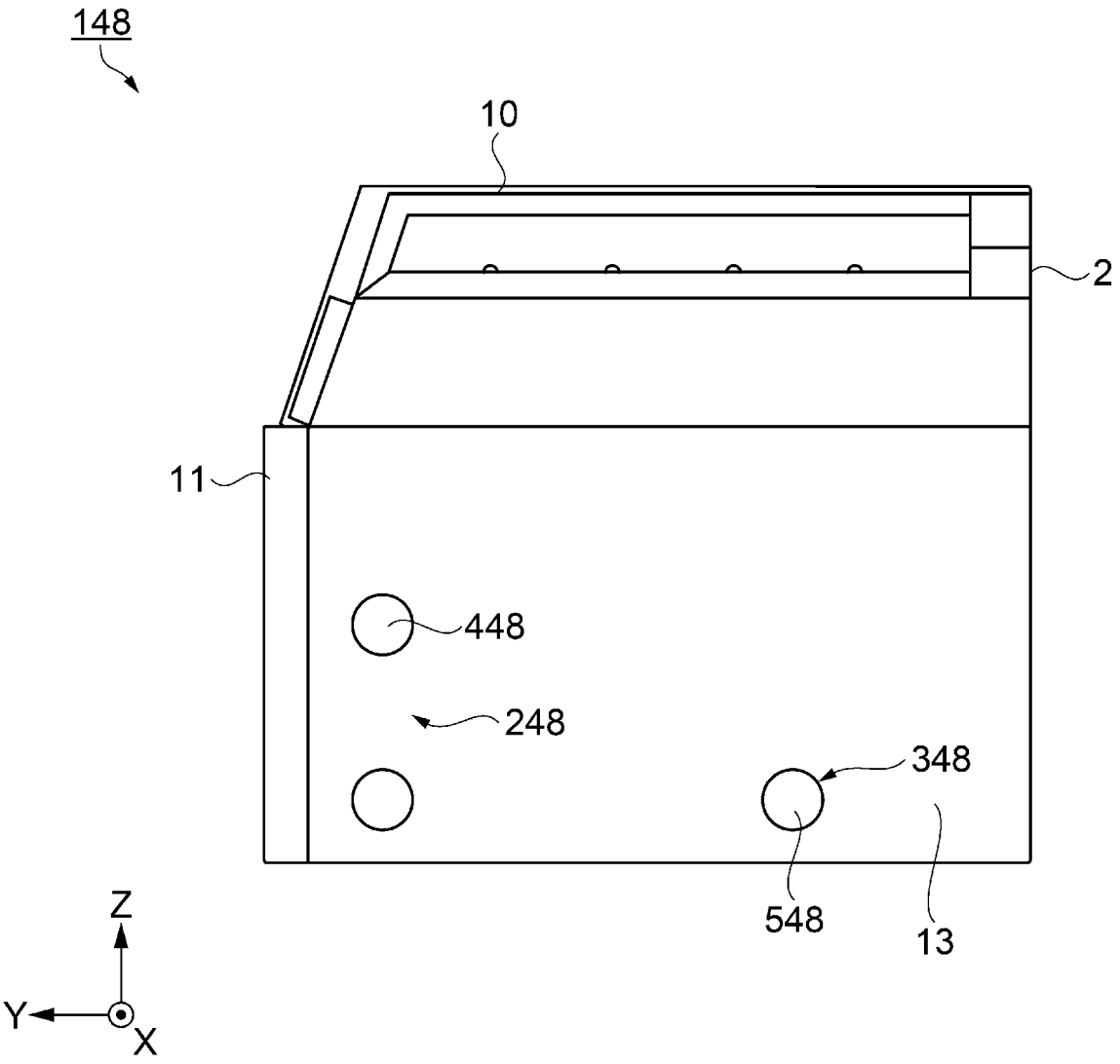
FIG. 48 is a side view showing an external appearance of a printer according to a forty eighth embodiment.

FIG. 48 is a side view showing an external appearance of a printer according to a forty eighth embodiment.

As shown in FIG. 48, on a side wall 13 of the printer 148, visual recognition units 248 and 348 capable of checking a remaining amount of ink in a tank 21 and a state of a waste liquid receiving unit 91 are provided. Light transmitting members 448 and 548 are provided in each of the visual recognition units 248 and 348. As shown in FIG. 48, the opening ports of each of the visual recognition units 248 and 348 are formed in a circular shape. Note that, a plurality of opening ports of each of the visual recognition units 248 and 348 may be formed.

Figure 49:
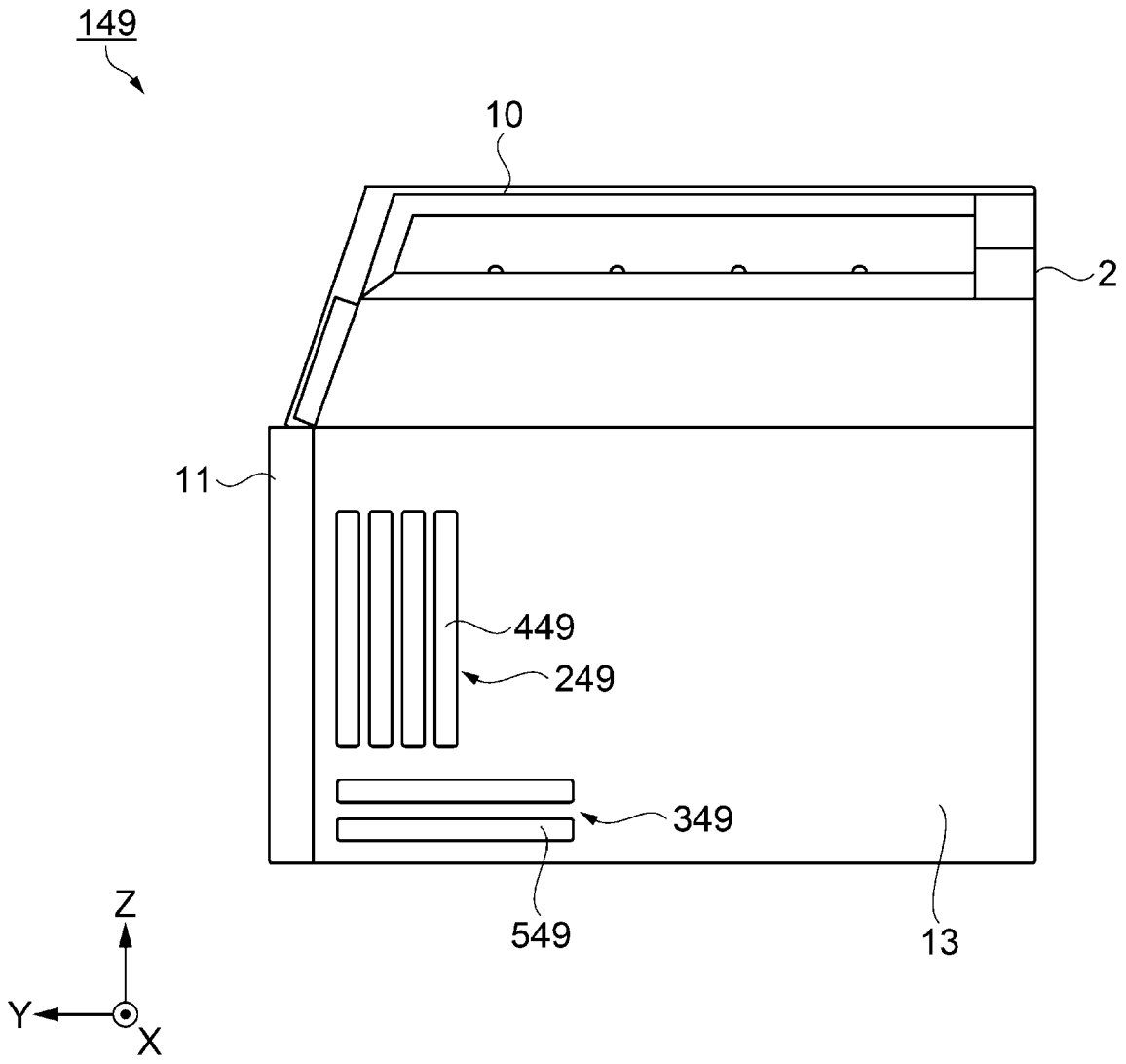
FIG. 49 is a side view showing an external appearance of a printer according to a forty ninth embodiment.

FIG. 49 is a side view showing an external appearance of a printer according to a forty ninth embodiment.

As shown in FIG. 49, on a side wall 13 of the printer 149, visual recognition units 249 and 349 capable of checking a remaining amount of ink in a tank 21 and a state of a waste liquid receiving unit 91 are provided. Light transmitting members 449 and 549 are provided in each of the visual recognition units 249 and 349. As shown in FIG. 49, the opening ports of each of the visual recognition units 249 and 349 are formed in rectangular shape. The opening ports of the visual recognition unit 249 are arranged along a Y axis. The opening ports of the visual recognition unit 349 are arranged along a Z axis.

Figure 50:
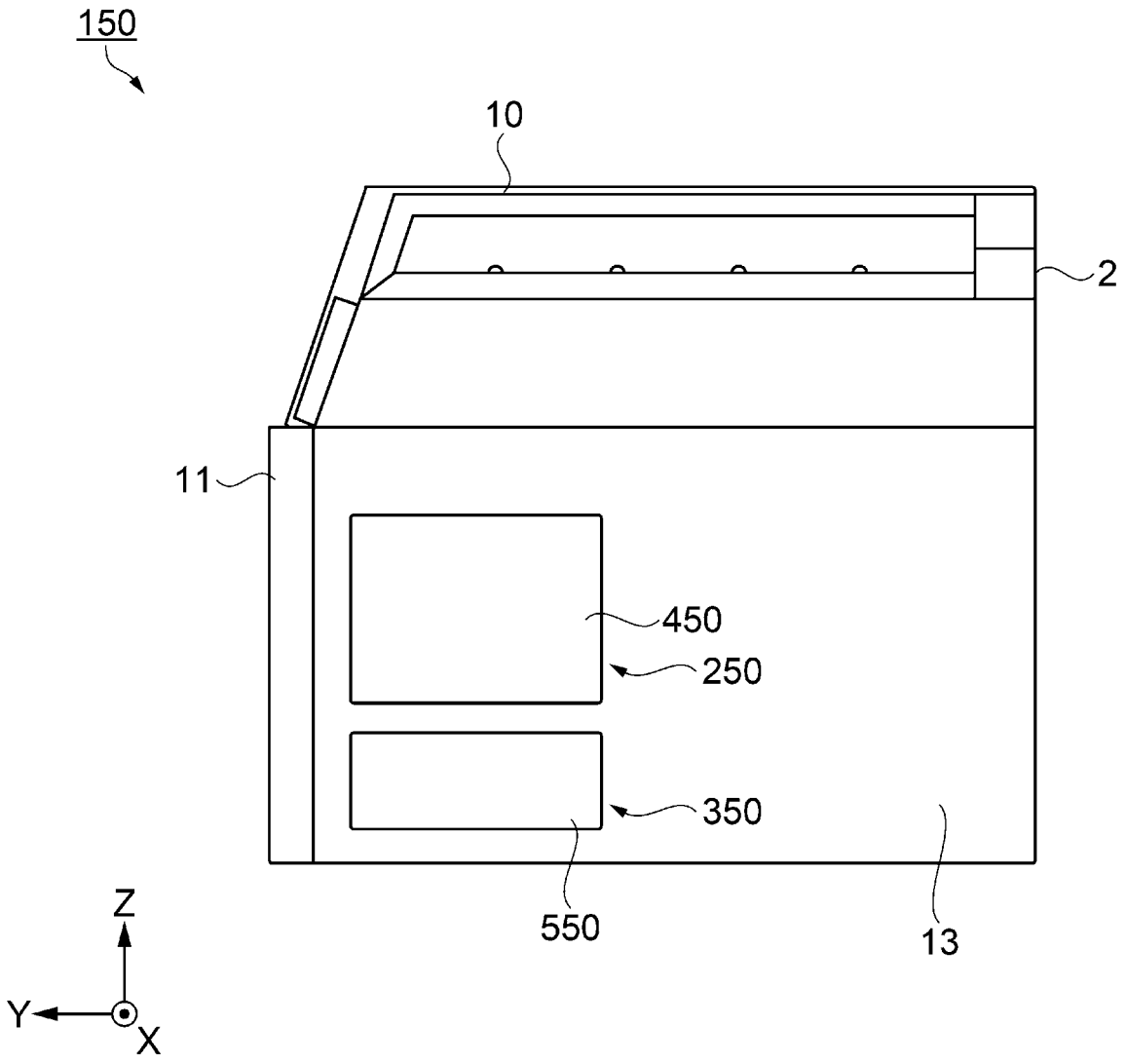
FIG. 50 is a side view showing an external appearance of a printer according to a fiftieth embodiment.

FIG. 50 is a side view showing an external appearance of a printer according to a fiftieth embodiment.

As shown in FIG. 50, on a side wall 13 of the printer 150, visual recognition units 250 and 350 capable of checking a remaining amount of ink in a tank 21 and a state of a waste liquid receiving unit 91 are provided. Light transmitting members 450 and 550 are provided in each of the visual recognition units 250 and 350. As shown in FIG. 50, the opening ports of each of the visual recognition units 250 and 350 are formed in rectangular shape. In addition, the size of the opening port of the visual recognition unit 250 is different from the size of the opening port of the visual recognition unit 350.

Note that, in the forty second to the fiftieth embodiments, the shape of each visual recognition unit is taken as an example, however, the invention is not limited thereto, and the shape of the other visual recognition unit described above can be appropriately set.

Further, the invention is not limited to the above-described embodiments, and various modifications, improvements, or the like can be added to the above-described embodiments. Modification examples will be described below.

Modification Example 1

In the above embodiments, the waste liquid receiving unit 91 is disposed in the lower part of the tank 21, however, the invention is not limited thereto. For example, the tank 21 and the waste liquid receiving unit 91 may be arranged in parallel along the X axis. Even in this case, the opening/closing unit 40 is provided to cover the tank 21 and the waste liquid receiving unit 91. The opening/closing unit 40 is provided with a visual recognition unit capable of checking the remaining amount of ink in the tank 21 and the state of the waste liquid receiving unit 91. Even in this case, the same effect as described above can be obtained.

For example, the waste liquid receiving unit 91 may be disposed an upper part of the tank 21.

Further, although the visual recognition units are provided in each of the tank 21 and the waste liquid receiving unit 91, a configuration may be adopted in which the tank 21 and the waste liquid receiving unit 91 can be visually recognized by one visual recognition unit.

Modification Example 2

The switching mechanism of the above embodiment is configured to attach/detach the visual recognition units 201 and 301, however, the invention is not limited thereto. For example, the switching mechanism may be configured to be electrically switchable. Specifically, a liquid crystal panel is installed in the visual recognition units 201 and 301, the visual recognition units 201 and 301 are set in a first state which is a light transmitting state (a state in which the state of the tank 21 and the waste liquid receiving unit 91 can be visually recognized) when a driving power of the liquid crystal panel is turned on, and the visual recognition units 201 and 301 are set in a second state which is a light blocking state in which light is blocked (a state in which the visibility of the tank 21 and the waste liquid receiving unit 91 is low) when the driving power is turned off. In this way, it is possible to easily switch between the first state and the second state.

Modification Example 3

Each of the configurations according to the first to fiftieth embodiments may be appropriately combined and applied.

Modification Example 4

In the above embodiment (for example, the first embodiment), the tank 21 and the waste liquid receiving unit 91 are disposed on the end side in the +X direction of the printer 101, and the opening/closing unit 40 (visual recognition units 201 and 301) is provided corresponding to the tank 21 and the waste liquid receiving unit 91, but the invention is not limited thereto. The tank 21 and the waste liquid receiving unit 91 may be disposed on the end side in the −X direction of the printer 101 and the opening/closing unit 40 (visual recognition units 201 and 301) may also be disposed on the end side in the −X direction in the same way. Even in this case, the same effect as described above can be obtained.

Contents derived from the embodiment will be described below.

An advantage of some aspects of the invention is to provide a recording apparatus including a recording unit that performs a recording by ejecting a liquid on a medium; a carriage that includes the recording unit in a bottom portion and is movable in a width direction intersecting a medium transporting direction; a casing that has the carriage therein and constitutes an external appearance of the apparatus; an adapter that is mounted on an upper portion of the recording unit and accommodates the liquid to be supplied to the recording unit; at least one liquid accommodating unit that supplies the liquid to the adapter through a tube and includes a filling port into which the liquid can be filled; and a waste liquid receiving unit that receives the liquid discharged as a waste liquid during a maintenance operation of the recording unit, in which the casing has a cover for covering both the liquid accommodating unit and the waste liquid receiving unit.

According to this configuration, by opening the cover, the liquid accommodating unit and the waste liquid receiving unit can be exposed, and it is possible to easily replenish the liquid to the liquid accommodating unit or exchange the waste liquid receiving unit or the like. That is, instead of separately providing the cover for the liquid accommodating unit and the waste liquid receiving unit, one cover is provided to cover the liquid accommodating unit and the waste liquid receiving unit, so that the configuration of the apparatus is simplified. Also, by opening one cover, it is possible to replenish the liquid to the liquid accommodating unit, exchange the waste liquid receiving unit, or the like, thereby enhancing the user's convenience.

In the above recording apparatus, it is preferable that the waste liquid receiving unit be provided in a lower part of the liquid accommodating unit.

Since the waste liquid receiving unit is disposed at a lower part in the gravity direction, the waste liquid (liquid) can be efficiently received.

The cover of the recording apparatus may be provided with a visual recognition unit capable of checking a remaining amount of the liquid of the liquid accommodating unit and a state of the waste liquid receiving unit.

According to this configuration, it is possible to easily check a status of the liquid accommodating unit (the remaining amount of the liquid or the state near the filling port) and the status of the waste liquid receiving unit via the visual recognition unit.

The visual recognition unit of the recording apparatus may be made of a light transmitting member capable of transmitting a visible light.

According to this configuration, since the visual recognition unit is formed of the light transmitting member, it is possible to check the condition of the liquid accommodating unit and the waste liquid receiving unit, and to prevent contact with the liquid accommodating unit and the waste liquid receiving unit by the user's fingers or the like.

The visual recognition unit of the recording apparatus may be provided at a position where the liquid accommodating unit can be visually recognized and at a position where the waste liquid receiving unit can visually recognize.

According to this configuration, it is possible to easily check a status of the liquid accommodating unit (the remaining amount of the liquid or the state near the filling port) and the status of the waste liquid receiving unit through the visual recognition unit.

The cover of the recording apparatus may have a switching mechanism capable of switching between a first state in which a state of the visual recognition unit can be visually recognized and a second state in which visibility is low.

According to this configuration, for example, by setting the cover to the first state when the recording apparatus is in use and setting the cover to the second state when the recording apparatus is not in use, it is possible to make it difficult to see the liquid accommodating unit and the waste liquid receiving unit except when the recording apparatus is in use, and it is possible to improve design quality.

The switching mechanism of the recording apparatus may have a configuration capable of attaching/detaching the visual recognition unit.

According to this configuration, the visual recognition unit (light transmitting member) can be attached/detached, for example, it is possible to change the visual recognition unit desired by the user, and it is possible to improve the design quality.

The switching mechanism of the recording apparatus may include a configuration that can be electrically switched.

According to this configuration, for example, it is possible to switch between a case where a power of the recording apparatus is turned on and a case where the power is turned off, and it is possible to easily perform the switching operation.

The present application is a continuation of U.S. patent application Ser. No. 16/282,915, filed Feb. 22, 2019, which claims priority to Japanese Patent Application No. 2018-030482, filed Feb. 23, 2018, the entire disclosures of which are expressly incorporated by reference herein.

What is claimed is:

1. A recording apparatus comprising:

a recording unit that performs a recording by ejecting a liquid on a medium;

a carriage that includes the recording unit in a bottom portion and is movable in a width direction intersecting a medium transporting direction;

a casing that has the carriage therein and constitutes an external appearance of the apparatus;

an adapter that is mounted on an upper portion of the recording unit and accommodates the liquid to be supplied to the recording unit;

at least one liquid accommodating unit that supplies the liquid to the adapter through a tube, and a waste liquid receiving unit that receives the liquid discharged as a waste liquid during a maintenance operation of the recording unit, wherein the casing is provided with a first visual recognition unit capable of checking a remaining amount of the liquid of the liquid accommodating unit and a second visual recognition unit capable of checking a state of the waste liquid receiving unit, the first visual recognition unit and the second visual recognition unit being mounted to an opening/closing unit.

2. The recording apparatus according to claim 1, wherein the opening/closing unit is provided on a side surface of the housing when viewed from the front of the apparatus.

3. The recording apparatus according to claim 2, wherein the opening/closing unit is provided on the front side of the side surface of the casing.

4. The recording apparatus according to claim 1, wherein the first visual recognition unit and the second visual recognition unit are provided on the front side of the casing.

5. The recording apparatus according to claim 1, wherein the liquid accommodation unit includes a filling port into which the liquid can be filled.

* * * * *